US011555261B2

(12) United States Patent
Kuo et al.

(10) Patent No.: US 11,555,261 B2
(45) Date of Patent: Jan. 17, 2023

(54) METHOD FOR MANUFACTURING INTEGRAL SHOE BLANK

(71) Applicant: Wholeknit International Co., Ltd., Apia (WS)

(72) Inventors: Ming-Sheng Kuo, Apia (WS); Yu-Lin Li, Apia (WS); Chien-Hui Yang, Apia (WS)

(73) Assignee: WHOLEKNIT INTERNATIONAL CO., LTD., Apia (WS)

( * ) Notice: Subject to any disclaimer, the term of this patent is extended or adjusted under 35 U.S.C. 154(b) by 157 days.

(21) Appl. No.: 17/099,210

(22) Filed: Nov. 16, 2020

(65) Prior Publication Data

US 2021/0087722 A1 Mar. 25, 2021

Related U.S. Application Data

(63) Continuation of application No. 15/497,965, filed on Apr. 26, 2017, now Pat. No. 10,883,207.

(51) Int. Cl.

| | |
|---|---|
| ***D04B 1/26*** | (2006.01) |
| ***A43B 23/04*** | (2006.01) |
| ***A43B 1/04*** | (2022.01) |
| ***A43B 23/02*** | (2006.01) |
| ***D04B 1/24*** | (2006.01) |

(52) U.S. Cl.

CPC ..... *D04B 1/26* (2013.01); *A43B 1/04* (2013.01); *A43B 23/0205* (2013.01); *A43B 23/042* (2013.01); *D04B 1/24* (2013.01)

(58) Field of Classification Search

CPC ..... A43B 1/04; A43B 23/042; D04B 1/26; D04B 1/265

See application file for complete search history.

(56) References Cited

U.S. PATENT DOCUMENTS

| | | | | |
|---|---|---|---|---|
| 7,748,240 | B1 * | 7/2010 | Cherneski | A41B 11/008 66/185 |
| 8,572,866 | B2 | 11/2013 | Dojan et al. | |
| 8,745,895 | B2 * | 6/2014 | Sokolowski | A43C 1/04 36/89 |
| 8,997,529 | B1 * | 4/2015 | Podhajny | A43C 1/00 36/47 |
| 10,273,605 | B2 | 4/2019 | Kuo et al. | |
| 2003/0089136 | A1 * | 5/2003 | Lynch | D04B 9/40 66/187 |

(Continued)

FOREIGN PATENT DOCUMENTS

| | | | | |
|---|---|---|---|---|
| CN | 106617494 A | * | 5/2017 | A43B 23/0205 |
| EP | 2 805 638 A1 | | 11/2014 | |

(Continued)

*Primary Examiner* — Megan E Lynch

(74) *Attorney, Agent, or Firm* — Muncy, Geissler, Olds & Lowe, P.C.

(57) ABSTRACT

A method for manufacturing an integral shoe blank is provided. In the method, a reinforcement piece is woven by a flat knitting machine during a weave process, and the reinforcement piece is made unperceivable through a subsequent side overturning step when viewing from an exterior of a shoe. Thus, with the reinforcement piece, structural strength of the shoe blank is reinforced while better comfort is provided to the foot by a shoe manufactured from the shoe blank.

4 Claims, 58 Drawing Sheets

(56) References Cited

U.S. PATENT DOCUMENTS

| | | | | |
|---|---|---|---|---|
| 2012/0266362 | A1* | 10/2012 | Craig | D04B 1/26 66/185 |
| 2014/0137434 | A1* | 5/2014 | Craig | A43B 23/024 66/170 |
| 2015/0107307 | A1* | 4/2015 | Kosui | A43B 17/003 2/239 |
| 2015/0223561 | A1 | 8/2015 | Kilgore et al. | |
| 2015/0250256 | A1 | 9/2015 | Pojhajny | |
| 2016/0058099 | A1 | 3/2016 | Panian et al. | |
| 2016/0089578 | A1 | 3/2016 | Liu et al. | |
| 2016/0198798 | A1* | 7/2016 | Ikenaka | D04B 1/22 66/170 |
| 2016/0206045 | A1* | 7/2016 | Meir | D04B 1/123 |
| 2016/0208421 | A1 | 7/2016 | Baines et al. | |
| 2016/0219966 | A1 | 8/2016 | Pojhajny et al. | |
| 2017/0000216 | A1 | 1/2017 | Dua et al. | |
| 2017/0027284 | A1* | 2/2017 | Craig | A43B 23/26 |
| 2017/0188661 | A1* | 7/2017 | Lee | A43C 13/00 |
| 2017/0340064 | A1* | 11/2017 | Boucher | B29D 35/126 |
| 2017/0342612 | A1* | 11/2017 | Kawakami | D04B 15/10 |
| 2018/0042340 | A1* | 2/2018 | Kuo | D04B 1/106 |
| 2018/0140050 | A1* | 5/2018 | Kuo | A43B 23/042 |
| 2018/0168271 | A1* | 6/2018 | Ly | A43B 23/042 |
| 2018/0289099 | A1* | 10/2018 | Bell | A43B 11/00 |
| 2018/0289100 | A1* | 10/2018 | Bell | A43B 1/0081 |

FOREIGN PATENT DOCUMENTS

| | | | | |
|---|---|---|---|---|
| FR | 777533 A | * | 2/1935 | |
| GB | 1253684 A | * | 11/1971 | D04B 1/108 |
| GB | 2516028 B | * | 5/2017 | A43B 1/04 |

* cited by examiner

METHOD FOR MANUFACTURING INTEGRAL SHOE BLANK

CROSS REFERENCE TO RELATED APPLICATIONS

This application is a Continuation of co-pending application Ser. No. 15/497,965, filed on 26 Apr. 2017, for which priority is claimed under 35 U.S.C. § 120; and this application claims priority of Application No. 106108081 filed in TAIWAN on 10 Mar. 2017 under 35 U.S.C. § 119, the entire contents of all of which are hereby incorporated by reference.

FIELD OF THE INVENTION

The present invention relates to a method for manufacturing an integral shoe blank, and particularly to a method for manufacturing an integral shoe blank including a reinforcement piece that reinforces structural strength of a shoe.

BACKGROUND OF THE INVENTION

In a conventional shoe manufacturing method, a shoe is usually spliced from multiple shoe pieces, as disclosed by the U.S. Pat. No. 8,572,866. However, with the evolving changes and trends of the footwear manufacturing industry, knitted/woven shoes have become available, such as Nike™ Free Run Flyknit. Patents associated with knitted footwear may be referred from the U.S. Patent Publication Nos. 2015/0223561, 2015/0250256, 2016/0058099, 2016/0089578, 2016/0219966, 2016/0208421 and 2017/0000216.

Further, the European Patent No. 2805638A1 discloses a footwear and knitting method for knitting a fabric. Although the footwear is seamlessly woven by a flat knitting machine, the footwear completed using the European Patent No. 2805638A1 is identical to the foregoing patents; that is, once the footwear is shaped, the shoe upper is formed merely by a piece of thin fabric. Such fabric provides limited structural strength and may not withstand frequent uses, in a way that the knitted shoe may not have a short lifespan.

Further, the European Patent No. 2805638A1 discloses that, one of the yarns (e.g., the second knitting yarn specified in the European Patent No. 2805638A1) used for knitting the knitted shoe is clad with a material having a lower melting point, such that the woven footwear may have a fixed shape through a thermal process. However, the structural strength formed by only at least two yarns adhered to each other still falls short in meeting requirements of numerous application scenarios.

SUMMARY OF THE INVENTION

It is an object of the present invention to solve unsatisfactory structural strength of a conventional knitted shoe.

To achieve the above object, the present invention provides a method for manufacturing an integral shoe blank. The method includes following steps.

In an interlacing step, an initial shoe edge is woven by knitting at least two yarns in an interlaced manner.

In a shoe upper knitting step, a first shoe upper connected to the initial shoe edge is woven by knitting the at least two yarns, knitting in a reverse direction is performed when a shoe upper stitch count is reached to weave a second shoe upper that faces the first shoe upper, and the first shoe upper is woven in a reverse direction again according to the shoe upper stitch count, hence cyclically knitting the first shoe upper and the second shoe upper.

In a reinforcement piece knitting step, a reinforcement piece is woven by knitting at least one of the yarns when the shoe upper stitch count is reached in the shoe upper knitting step, knitting in a reverse direction is performed when an extension stitch count is reached while knitting the reinforcement piece, and the first shoe upper and the second shoe upper are woven by knitting the at least two yarns according to the shoe upper stitch count when the extension stitch count is again reached, hence cyclically knitting the reinforcement piece, the first shoe upper and the second shoe upper.

In a continual shoe upper knitting step, the first shoe upper and the second shoe upper are cyclically woven by knitting the at least two yarns, and a shoe opening is formed.

In a side overturning step, the first shoe upper and the second shoe upper are folded from the shoe opening to locate the reinforcement piece in an in-shoe space defined by the overturned first shoe upper and second shoe upper to complete the shoe blank.

In one embodiment, the reinforcement piece may be located at a vamp section or a heel section of the shoe blank.

In one embodiment, the continual shoe upper knitting step further includes a sub-step, in which, another reinforcement piece is woven by knitting at least one of the yarns when the shoe upper stitch count is reached while knitting the first shoe upper or the second shoe upper, weaving in a reverse direction is performed when an extension stitch count is reached while knitting the another reinforcement piece, and the first shoe upper and the second shoe upper are woven by knitting the at least two yarns according to the shoe upper stitch count when the extension stitch count is again reached, hence cyclically knitting the another reinforcement piece, the first shoe upper ad the second shoe upper.

In one embodiment, before the interlacing step, the method further includes an outside-upper extension knitting step, in which an extension is woven by knitting at least one of the yarns. One knitted end of the extension is for continuing knitting the initial shoe edge. After the shoe blank is completed, the extension may be a toe support piece disposed at a lower end of the in-shoe space or a sole piece adhered to the second shoe upper.

In one embodiment, one of the two yarns is clad with a hot melt layer.

In one embodiment, the extension stitch count is greater than the shoe upper stitch count.

The present invention further provides another method including the following steps.

In an outside-upper extension knitting step, an extension is woven by knitting at least one of at least two yarns.

In an interlacing step, an initial shoe edge connected to the extension is woven by knitting the at least two yarns in an interlaced manner.

In a shoe upper knitting step, a first shoe upper connected to the initial shoe edge is woven by knitting the at least two yarns, knitting in a reverse direction is performed when a shoe upper stitch count is reached to weave a second shoe upper that faces the first shoe upper by knitting the at least two yarns, and the first shoe upper is woven in a reverse direction according to the shoe upper stitch count, hence cyclically knitting the first shoe upper and the second shoe upper.

In a reinforcement piece knitting step, a reinforcement piece is woven by knitting at least one of the yarns when the shoe upper stitch count is reached in the shoe upper knitting step, knitting in a reverse direction is performed when an extension stitch count is reached while knitting the reinforcement piece, and the first shoe upper and the second shoe upper are woven by knitting the at least two yarns according to the shoe upper stitch count when the extension stitch count is again reached, hence cyclically knitting the reinforcement piece, the first shoe upper and the second shoe upper.

In a continual shoe upper knitting step, the first shoe upper and the second shoe upper are cyclically woven by knitting the at least two yarns.

In a lining knitting step, a first lining connected to the first shoe upper is woven by knitting the at least two yarns, knitting in a reverse direction is performed when the shoe upper stitch count is reached to weave a second lining that faces the first lining and is connected to the second shoe upper by knitting the at least two yarns, and the first lining is woven in a reverse direction according to the shoe upper stitch count, hence cyclically knitting the first lining and the second lining, with ends of the first lining and second lining forming a shoe opening.

In a side overturning step, the first lining and the second lining are folded from the shoe opening, and the first shoe upper and the second shoe upper are simultaneously drawn from the shoe opening for side overturning to locate the reinforcement piece and the extension in an in-shoe space defined by the overturned first shoe upper and second shoe upper. The extension may be a toe support piece disposed at a lower end of the in-shoe space or a sole piece adhered to the second shoe upper.

In a lining tucking step, the overturned first lining and second lining are tucked towards the in-shoe space, and the ends of the first lining and second lining are secured at the lower end of the in-shoe space to complete a shoe blank.

In one embodiment, after the lining knitting step, the method further includes an outside-upper another extension knitting step, in which, another extension connected to the end of the first lining or the end of the second lining is woven by knitting at least one of the yarns. Further, in the lining tucking step, the another extension is tucked into the in-shoe opening together with the first lining and the second lining. The extension and the another extension are respectively the toe support piece disposed at the lower end of the in-shoe space and the sole piece adhered to the second lining.

In one embodiment, before tucking the first lining and the second lining into the in-shoe space in the lining tucking step, edges of the first lining and the second lining are sewn.

In one embodiment, the continual shoe upper knitting step further includes a sub-step, in which, another reinforcement piece is woven by knitting at least one of the yarns when the shoe upper stitch count is reached while knitting the first shoe upper or the second shoe upper, knitting in a reverse direction is performed when an extension stitch count is reached while knitting the another reinforcement piece, and the first shoe upper and the second shoe upper are woven by knitting the at least two yarns according to the shoe upper stitch count when the extension stitch count is again reached, hence cyclically knitting the another reinforcement piece, the first shoe upper ad the second shoe upper.

In one embodiment, one of the two yarns is clad with a hot melt layer.

In one embodiment, the extension stitch count is greater than the shoe upper stitch count.

In one embodiment, the knitting length of the extension is shorter than the knitting lengths of the first shoe upper and the second shoe upper.

The present invention further provides another method including following steps.

In an outside-upper extension knitting step, an extension is woven by knitting at least one of at least two yarns.

In an interlacing step, an initial shoe edge connected to the extension is woven by knitting the at least two yarns in an interlaced manner.

In a lining knitting step, a first lining connected to the initial shoe edge is woven by knitting the at least two yarns, knitting in a reverse direction is performed when a shoe upper stitch count is reached to weave a second lining that faces the first lining, and the first lining is woven in a reverse direction according to the shoe upper stitch count, hence cyclically knitting the first lining and the second lining.

In a reinforcement piece knitting step, a reinforcement piece is woven by knitting at least one of the yarns when the shoe upper stitch count is reached in the lining knitting step, knitting in a reverse direction is performed when an extension stitch count is reached while knitting the reinforcement piece, and the first lining and the second lining are woven by knitting the at least two yarns according to the shoe upper stitch count when the extension stitch count is again reached, hence cyclically knitting the reinforcement piece, the first shoe upper and the second shoe upper.

In a continual lining knitting step, the first lining and the second lining are cyclically woven by knitting the at least two yarns.

In a shoe upper knitting step, a first shoe upper connected to the first lining is woven by knitting the at least two yarns, knitting in a reverse direction is performed when the shoe upper stitch count is reached to weave a second shoe upper that faces the first shoe upper and is connected to the second lining, and the first shoe upper is woven in a reverse direction according to the shoe upper stitch count, hence cyclically knitting the first shoe upper and the second shoe upper, with ends of the first shoe upper and the second shoe upper forming a shoe opening.

In a securing step, the reinforcement piece is secured on the first lining, and the extension is folded to come into contact with the first lining or the second lining.

In a side overturning step, the first shoe upper and the second shoe upper are folded from the shoe opening to cause the overturned first shoe upper and second shoe upper to clad on the extension and the reinforcement piece, and the ends of the first shoe upper and the second shoe upper are connected to complete a shoe blank. The extension may be a toe support piece disposed at a toe section of the shoe blank and a sole piece adhered to the second shoe upper.

In one embodiment, after the shoe upper knitting step, the method further includes an outside-upper another extension knitting step, in which, another extension connected to the end of the first lining or the end of the second lining is woven by knitting at least one of the yarns. In the side overturning step, after the first shoe upper and the second shoe upper are connected, the another extension is stacked at the first shoe upper or the second shoe upper. The another extension serves as the toe support piece when stacked at the first shoe upper, or serves as the sole piece when stacked at the second shoe upper.

In one embodiment, the continual lining knitting step further includes a sub-step, in which, another reinforcement is woven by knitting at least one of the yarns when the shoe upper stitch count is reached while knitting the first lining or the second lining, knitting in a reverse direction is performed when an extension stitch count is reached while knitting the another reinforcement piece, and the first lining and the second lining are woven by knitting the at least two yarns according to the shoe upper stitch count when the extension stitch count is again reached, hence cyclically knitting the another reinforcement piece, the first lining and the second lining.

In one embodiment, one of the two yarns is clad with a hot melt layer.

In one embodiment, the extension stitch count is greater than the shoe upper stitch count.

In one embodiment, in the side overturning step, side overturning of the first shoe upper stops at a connecting position of the first shoe upper and the first lining, and side overturning of the second shoe upper stops at a connecting position of the second shoe upper and the second lining.

The embodiments of the present invention provide following features compared to the prior art. In the present invention, a reinforcement piece is integrally woven during the knitting process of a flat knitting machine, and the reinforcement piece is hidden in the in-shoe space or clamped between the first shoe upper and the first lining in the subsequent side overturning step. Thus, the manufactured shoe blank is provided with reinforced structural strength through the reinforcement piece as well as better comfort for the foot using a shoe body manufactured from the shoe blank. Further, during the knitting process of the present invention, at least one extension may be integrally woven. The at least one extension further reinforces the structural strength or decorates an appearance of the shoe blank.

DETAILED DESCRIPTION OF THE PREFERRED EMBODIMENTS

Figure 1:
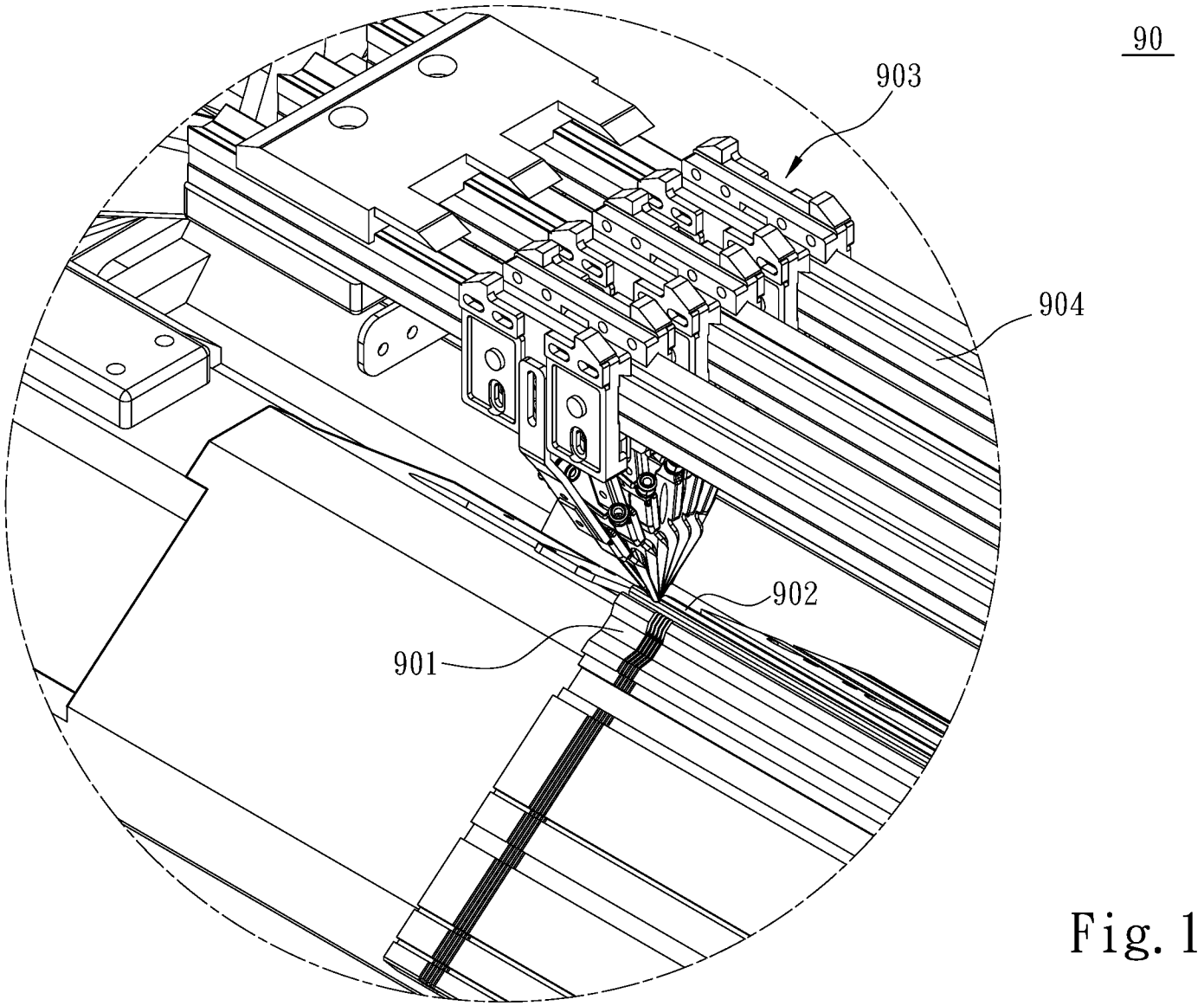
FIG. 1 is a partial schematic diagram of a flat knitting machine.

Referring to FIG. 1, the present invention provides a method for manufacturing an integral shoe blank. Steps associated with knitting in the method disclosed by the present invention are completed by a flat knitting machine 90, and performed by a front needle bed 901 and a back needle bed 902 of the flat knitting machine 90. Structural details of the front needle bed 901 and the back needle bed 902 are generally known to one person skilled in the art, and shall be omitted herein. An operating staff of the flat knitting machine 90 may configure the knitting scheduling of the front needle bed 901 and the back needle bed 902 according to the method of the present invention. Further, a yarn feeding mechanism 903 of the flat knitting machine 90 moves along a lateral track 904. More specifically, the yarn feeding mechanism 903 moves from an initial position towards an ending position on the lateral track 904, and moves back from the ending position towards the initial position, hence cyclically causing the front needle bed 901 and the back needle bed 902 to weave a fabric. Further, the yarn feeding mechanism 903 is implemented in coordination with a nose (not shown), which controls the knitting operations of the front needle bed 901 and the back needle bed 902.

Figure 2:
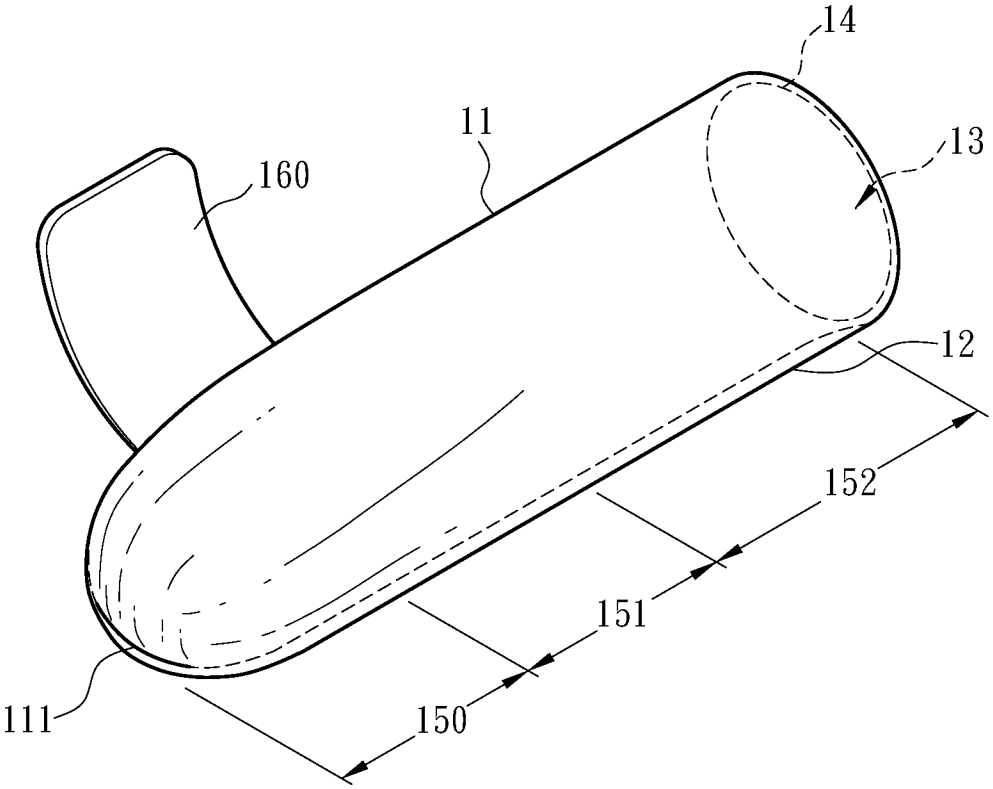
FIG. 2 is a perspective structural schematic diagram of a shoe blank according to a first embodiment of the present invention.
Figure 3:
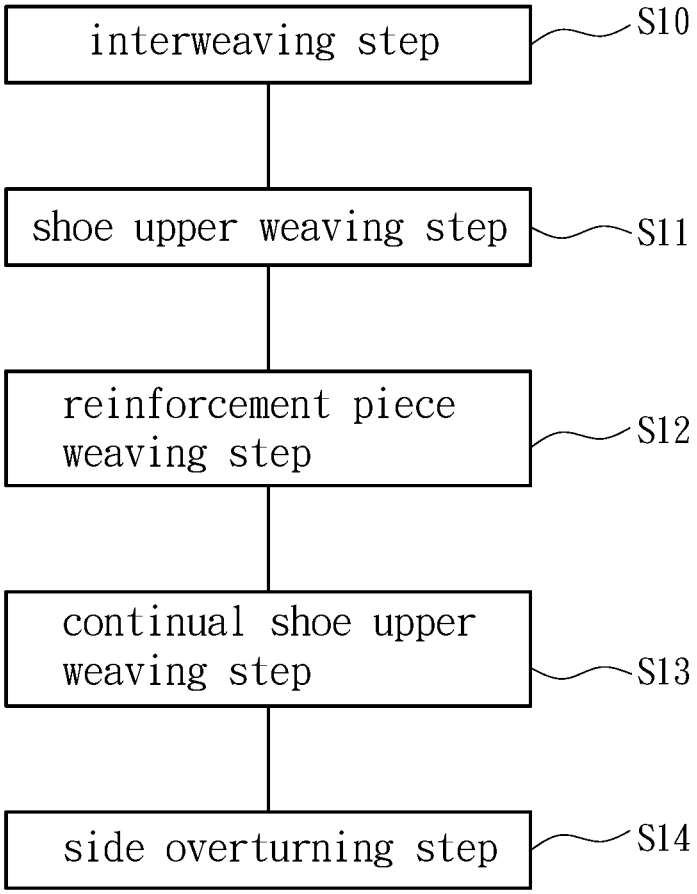
FIG. 3 is a flowchart of steps of a method according to the first embodiment of the present invention.
Figure 4:
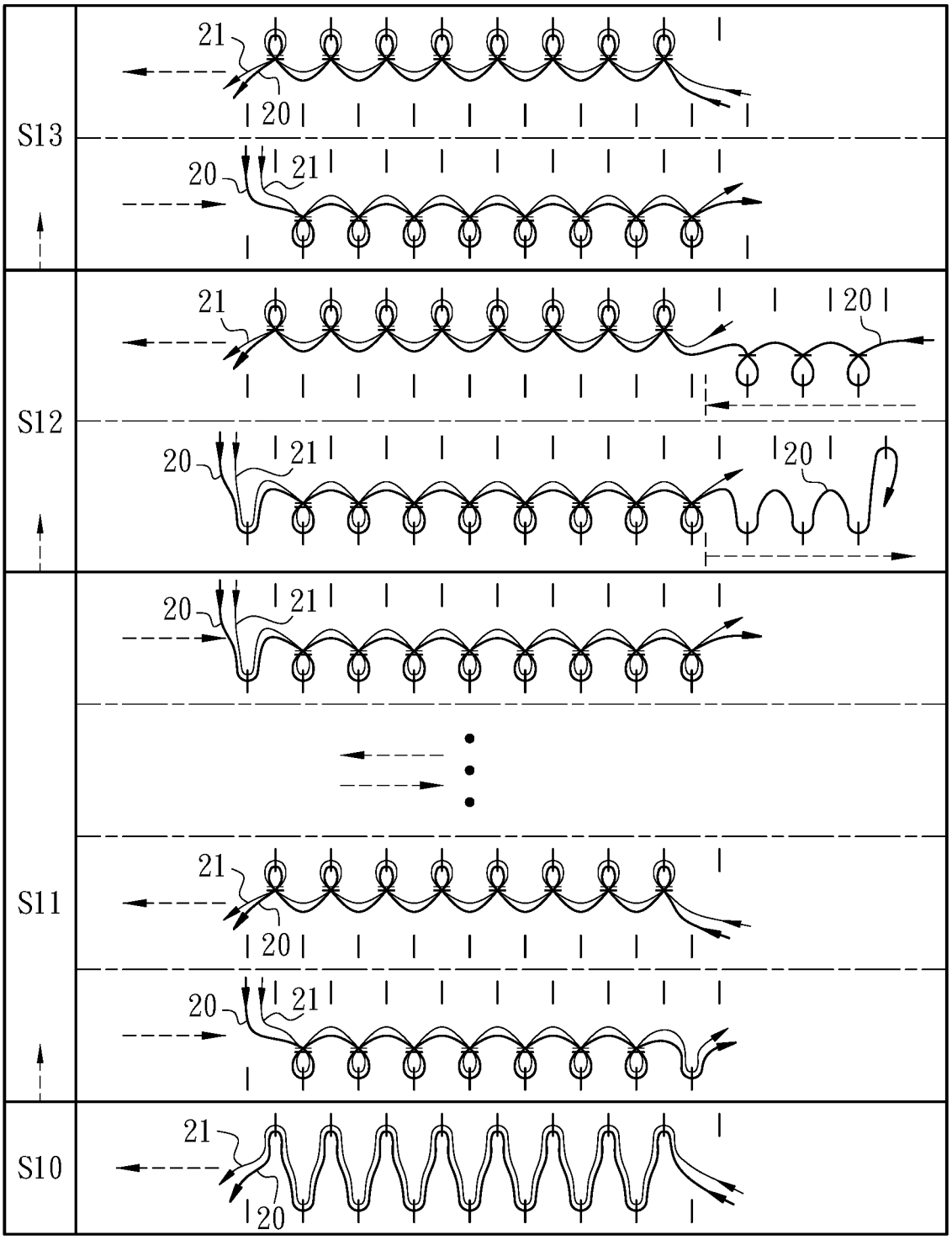
FIG. 4 is a schematic diagram of a knitting process according to the first embodiment of the present invention.

Referring to FIG. 2, a basic structure of the shoe blank 10 is first given below. The shoe blank 10 is a semi-finished product integrally formed and woven by the flat knitting machine 90, and completed through a side overturning step. The shoe blank 10 includes a first shoe upper 11, a second shoe upper 12 that faces the first shoe upper 12, an in-shoe space 13 defined by the first shoe upper 11 and the second shoe upper 13, and a shoe opening 14 connected to the in-shoe space 13. Further, the shoe blank 10 of the present invention may be divided into a toe section 150, a vamp section 151 and a heel section 152 for illustration purposes in the description below. Referring to FIG. 2 to FIG. 4, the method according to an embodiment includes following steps.

In an interlacing step S10, an initial shoe edge 111 is woven by knitting at least two yarns 20 and 21 in an interlaced manner.

In a show upper knitting step S11, the first shoe upper 11 connected to the initial shoe edge 111 is woven by knitting the at least two yarns 20 and 21, knitting in a reverse direction is performed when a shoe upper stitch count is reached to weave the second shoe upper 12 that faces the first shoe upper 11 by knitting the two yarns 20 and 21, and the first shoe upper 11 is again woven in a reverse direction according to the shoe upper stitch count, hence cyclically knitting the first shoe upper 11 and the second shoe upper 12.

In a reinforcement piece knitting step S12, a reinforcement piece 160 is woven by knitting at least one of the yarns 20 and 21 when the shoe upper stitch count is reached in the shoe upper knitting step S11, knitting in a reverse direction is performed when an extension stitch count is reached while knitting the reinforcement piece 160, and the first shoe upper 11 and the second shoe upper 12 are woven by knitting the at least two yarns 20 and 21 according to the shoe upper stitch count when the extension stitch count is again reached, hence cyclically knitting the reinforcement piece 160, the first shoe upper 11 and the second shoe upper 12.

In a continual shoe upper knitting step S13, the first shoe upper 11 and the second shoe upper 12 are cyclically woven by knitting the two yarns 20 and 21, and the shoe opening 14 is formed.

In a side overturning side S14, the first shoe upper 11 and the second shoe upper 12 are folded from the shoe opening 14 to locate the reinforcement piece 160 in the in-shoe space 13 defined by the overturned first shoe upper 11 and second shoe upper 12, thus completing the shoe blank 10.

Figure 5A:
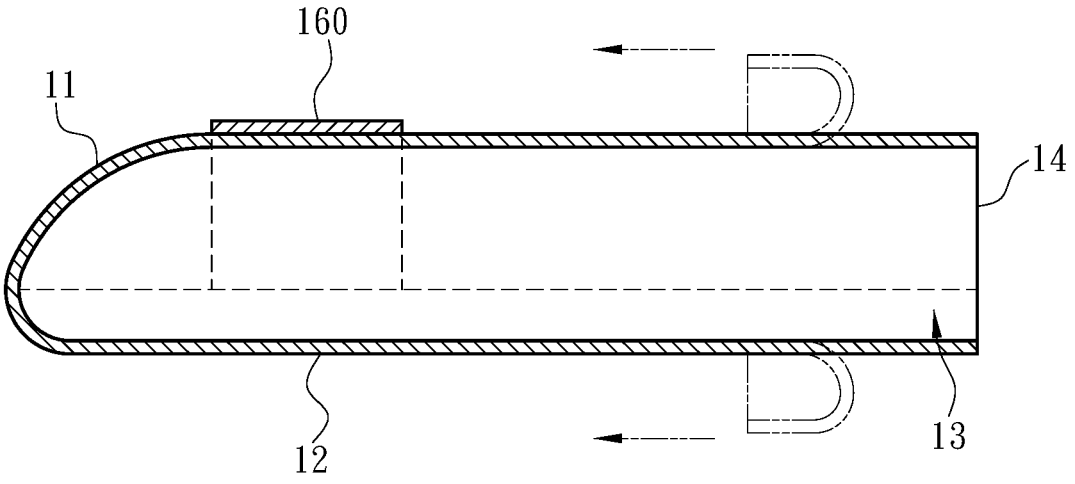
FIG. 5A to FIG. 5C are first to third continuous schematic diagrams of a folding and overturning process according to the first embodiment of the present invention.
Figure 5B:
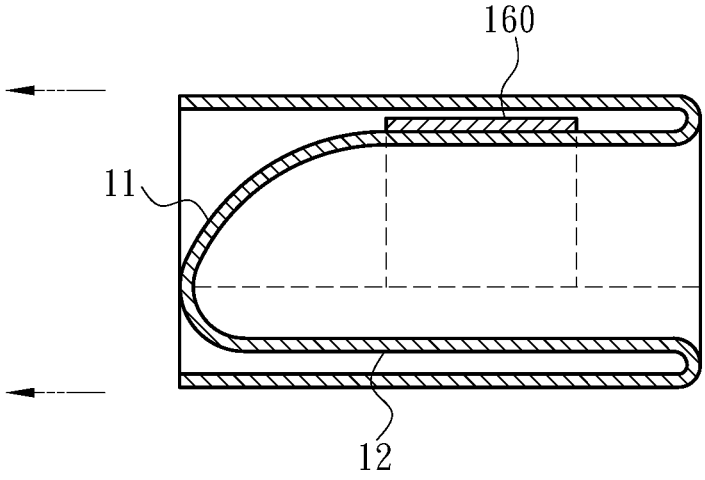
Figure 5C:
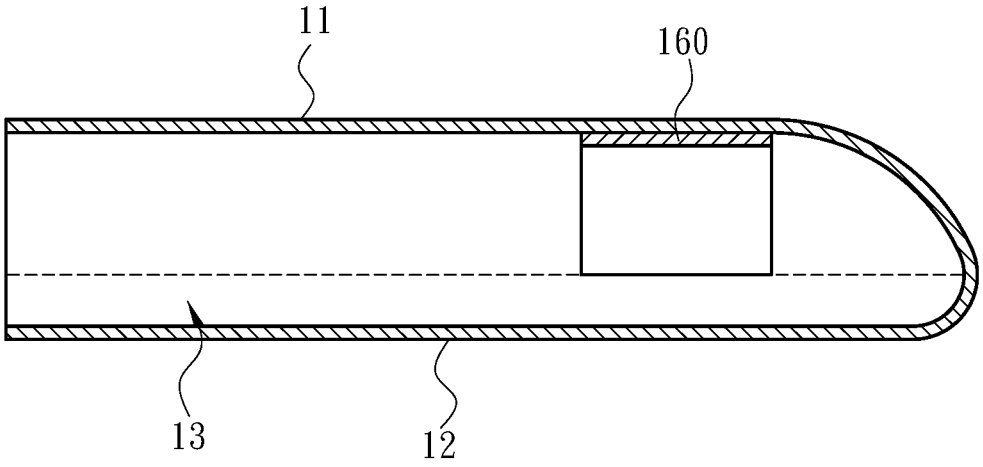

Referring to FIG. 5A to FIG. 5C, at the beginning of the implementation, the flat knitting machine 90 is configured with scheduling of the front needle bed 901 and the back needle bed 902 according to the method. In the interleaving step S10, the flat knitting machine 90 causes the front needle bed 901 and the back needle bed 902 to knit simultaneously to cause the two yarns 20 and 21 to be interlaced to form the initial shoe edge 111. After the initial shoe edge 111 is completely woven, unbroken-yarn knitting is continued to perform the shoe upper knitting step S11. The shoe upper knitting step S11 of the present invention is primarily implemented by a tubular method using the flat knitting machine 90. During the knitting process of the shoe upper knitting step S11, the front needle bed 901 weaves the first shoe upper 11 in an extended manner from an end of one side of the initial shoe edge 111. When the front needle bed 901 reaches the shoe upper stitch count while knitting the first shoe upper 11, the flat knitting machine 90 continues unbroken-yarn knitting and performs yarn feeding in a reverse direction to cause the back needle bed 902 to continue knitting the second shoe upper 12 by knitting the two yarns 20 and 21. After that, each time the front needle bed 901 or the back needle bed 902 reaches the shoe upper stitch count during the knitting process, the flat knitting machine 90 performs knitting in a reverse direction, hence cyclically knitting the first shoe upper 11 and the second shoe upper 12. Further, the shoe upper stitch count of the present invention may be a variable value instead of being limited to a constant value, and the variable value may be correspondingly set according to a shoe model to be later completed. For example, the shoe upper stitch count of the toe section 150 is greater than the shoe upper stitch count of the vamp section 151. Further, the knitting schedule of the shoe upper knitting step S11 is correspondingly designed according to the size of the shoe blank 10.

Further, the two yarns 20 and 21 forming the shoe blank 10 may be in different colors, which present different colors at inner and outer surfaces of the first shoe upper 11 and the second shoe upper 12. In other words, when the two yarns 20 and 21 are in different colors, a technical front color of a fabric and a technical back color of the fabric are different. Further, one of the two yarns 20 and 21 may be clad by a hot melt layer. Thus, when the shoe blank 10 is completed, it may be placed into a mold and be appropriately heated to allow one of the yarns 20 and 21 clad with the hot melt layer to melt, and the shoe blank 10 may then shape according to an appearance of the mold to complete a knitted shoe prototype 100. Further, the two yarns 20 and 21 of the present invention may be intertwined from twisting.

In the present invention, a trigger point for entering the reinforcement piece knitting step S12 from the shoe upper knitting step S11 is determined according to the design of the shoe blank 10. For example, when the back needle bed 902 reaches the shoe upper stitch count while knitting the second shoe upper 12, and the first shoe upper 11 and the second shoe upper 12 have reached predetermined lengths, the yarn feeding mechanism 903 is controlled to progress in a non-reversed direction and to weave the reinforcement piece 160 along the current knitting direction by knitting the at least one of the yarns 20 and 21. During the process of knitting the reinforcement piece 160, the flat knitting machine 90 controls the nose to weave in a non-reversed manner and the front needle bed 901 to weave the reinforcement piece 160, such that the reinforcement piece 160 protrudes from edges of the first shoe upper 11 and the second shoe upper 12 when the reinforcement piece 160 is completely woven to appear like a wing. Further, during the knitting process of the reinforcement piece 160, when the front needle bed 901 reaches the extension stitch count while knitting the reinforcement piece 160, the flat knitting machine 90 continues knitting the reinforcement piece 160 in a reverse direction. After that, when the front needle bed 901 again reaches the extension stitch count, the flat knitting machine 90 controls the front needle bed 901 and the back needle bed 902 to continuously weave the first shoe upper 11 and the second shoe upper 12 by knitting the two yarns 20 and 21. Details of the knitting process of the first shoe upper 11 and the second shoe upper 12 are as described in shoe upper knitting step S11, and shall be omitted. Further, the extension stitch count of the present invention may be adjusted according to the pattern of the reinforcement piece 160; that is, the extension stitch count may be a variable value. However, the extension stitch count is greater than the shoe upper stitch count. Thus, the length of the reinforcement piece 160 is made greater than the length of the first shoe upper 11 or the second shoe upper 12, so as to more substantially support the first shoe upper 12 or the second shoe upper 12.

Referring to FIG. 4, the continual shoe upper knitting step S13 follows the reinforcement piece knitting step S12. Details of the knitting process of the continual shoe upper knitting step S13 are similar to those of the shoe upper knitting step S11. In the continual shoe upper knitting step S13, in continuation from a knitting ending point of the reinforcement piece knitting step S12, the front needle bed 901 and the back needle bed 902 continue knitting the first shoe upper 11 and the second shoe upper 12, and shape the shoe opening 14, with the side overturning step S14 performed next. Further, an end part of the knitting process of the continual shoe upper knitting step S13 may be conducted by a different knitting method to provide the shoe blank 10 with a contracted opening (not shown).

Figure 6:
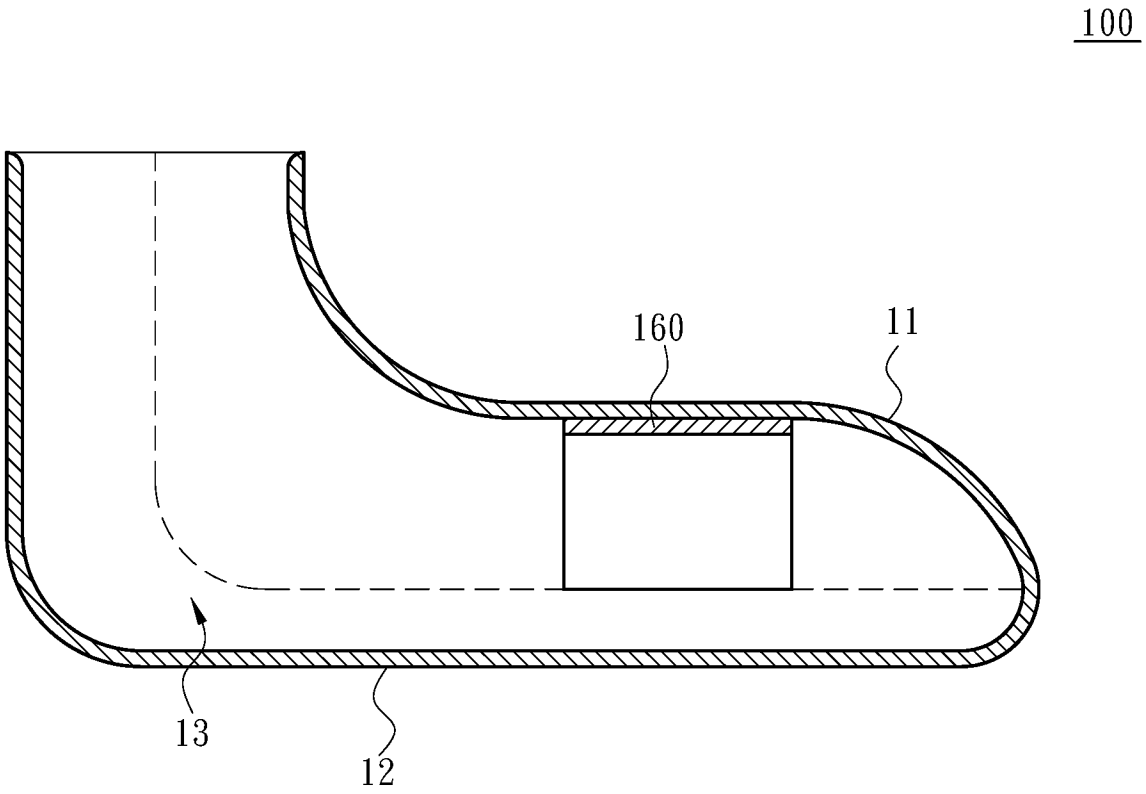
FIG. 6 is a sectional schematic diagram of a knitted shoe prototype according to the first embodiment of the present invention.

The implementation of the side overturning step S14 may be completed through a machine or a human operation without involving the flat knitting machine 90. At the beginning of the implementation, the reinforcement piece 160 may be placed on the first shoe upper 11 or the second shoe upper 12, ends of the first shoe upper 11 and the second shoe upper 12 are held firmly, and the first shoe upper 11 and the second shoe upper 12 are folded from the shoe opening 14. Thus, the reinforcement piece 160 becomes located in the in-shoe space 13 defined by the overturned first shoe upper 11 and second shoe upper 12, hence completing the shoe blank 10. Accordingly, by performing an appropriate processing on the shoe blank 10, e.g., a heating process or a paint spray process, a knitted shoe prototype 100 (as shown in FIG. 6) may be completed. A knitted shoe may then be manufactured by additionally adhering a shoe sole (not shown) to a lower surface of the knitted shoe prototype 100. Further, the reinforcement piece 160 of the present invention may be stacked on the first shoe upper 11 or the second shoe upper 12 to provide support and reinforcement, and may be set and formed at the vamp section 151 or the heel section 152 according to actual requirements.

Figure 7:
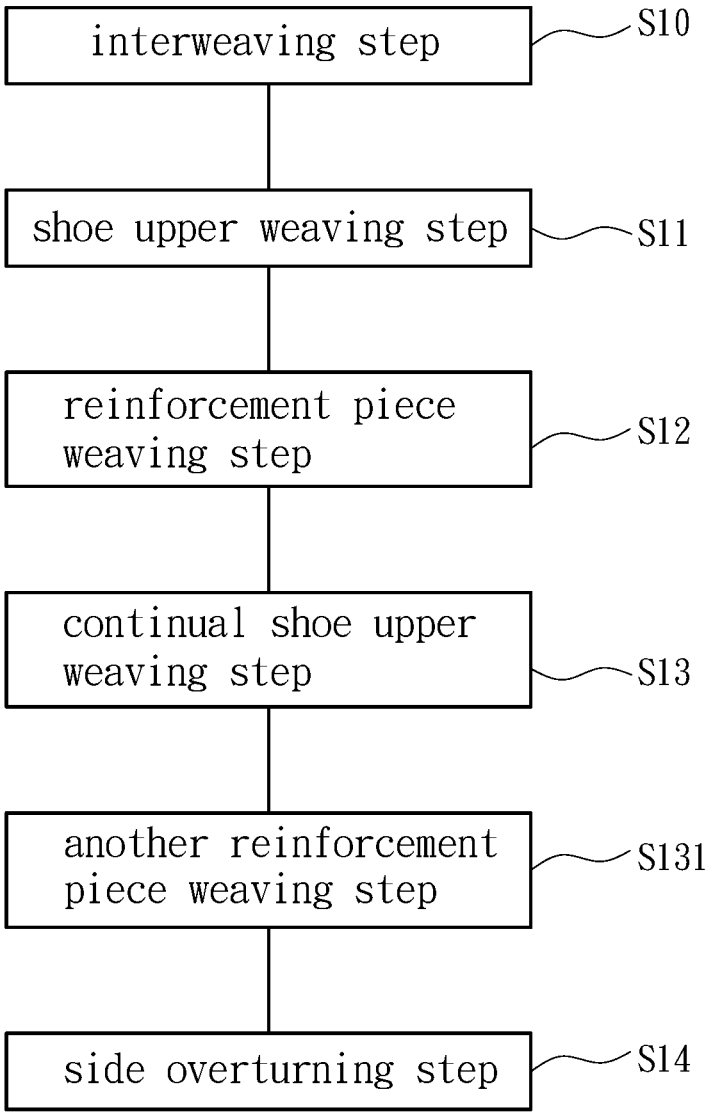
FIG. 7 is a flowchart of steps of a method according to a second embodiment of the present invention.
Figure 8:
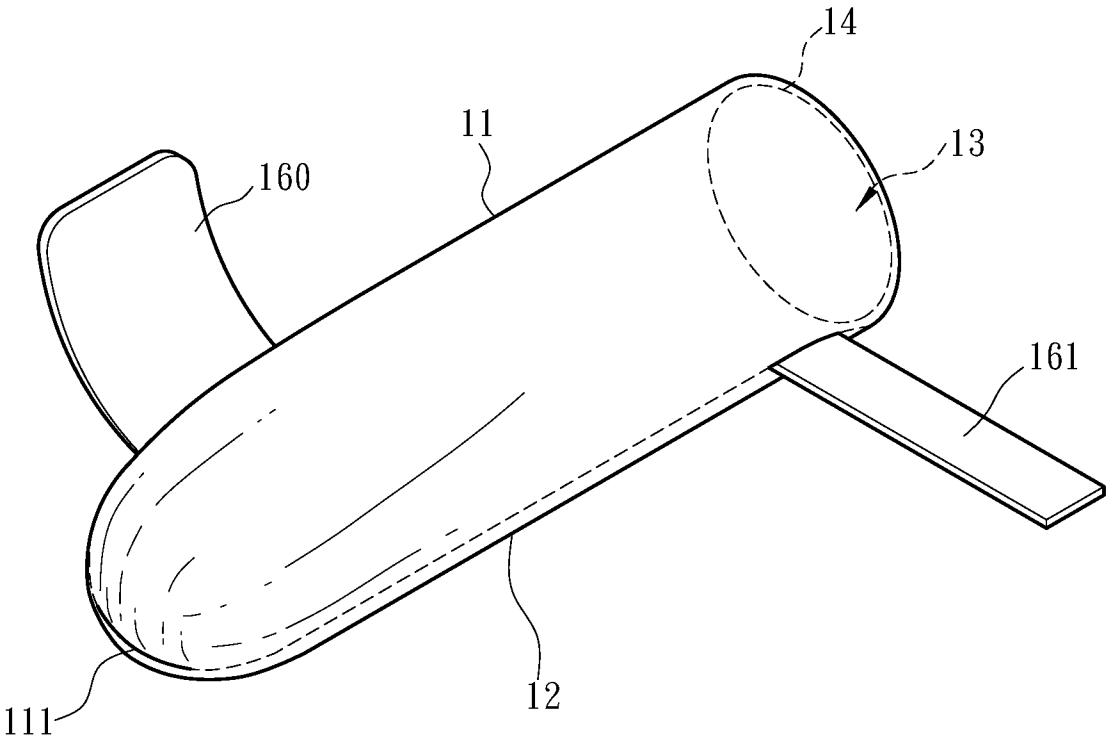
FIG. 8 is a perspective structural schematic diagram of a shoe blank according to the second embodiment of the present invention.

Referring to FIG. 7 and FIG. 8, the reinforcement piece 160 of the present invention is not limited to being implemented in a single quantity. In one embodiment, the continual shoe upper knitting step S13 further includes a sub-step S131. In the sub-step S131, another reinforcement piece 161 is woven by knitting at least one of the yarns 20 and 21 when the shoe upper stitch count is reached while knitting the first shoe upper 11 or the second shoe upper 12, knitting in a reverse direction is performed when the extension stitch count is reached while knitting the another reinforcement piece 161, and the first shoe upper 11 and the second shoe upper 12 are woven by knitting the at least two yarns 20 and 21 according to the shoe upper stitch count when the extension stitch count is again reached, hence cyclically knitting the another reinforcement piece 161, the first shoe upper 11 and the second shoe upper 12. Further, in the side overturning step S14, the another reinforcement piece 161 is together placed with the reinforcement piece 160 into the in-shoe space 13 defined by the overturned first shoe upper 11 and second shoe upper 12, and together with the reinforcement piece 160 provide the shoe blank 10 with support.

Figure 9:
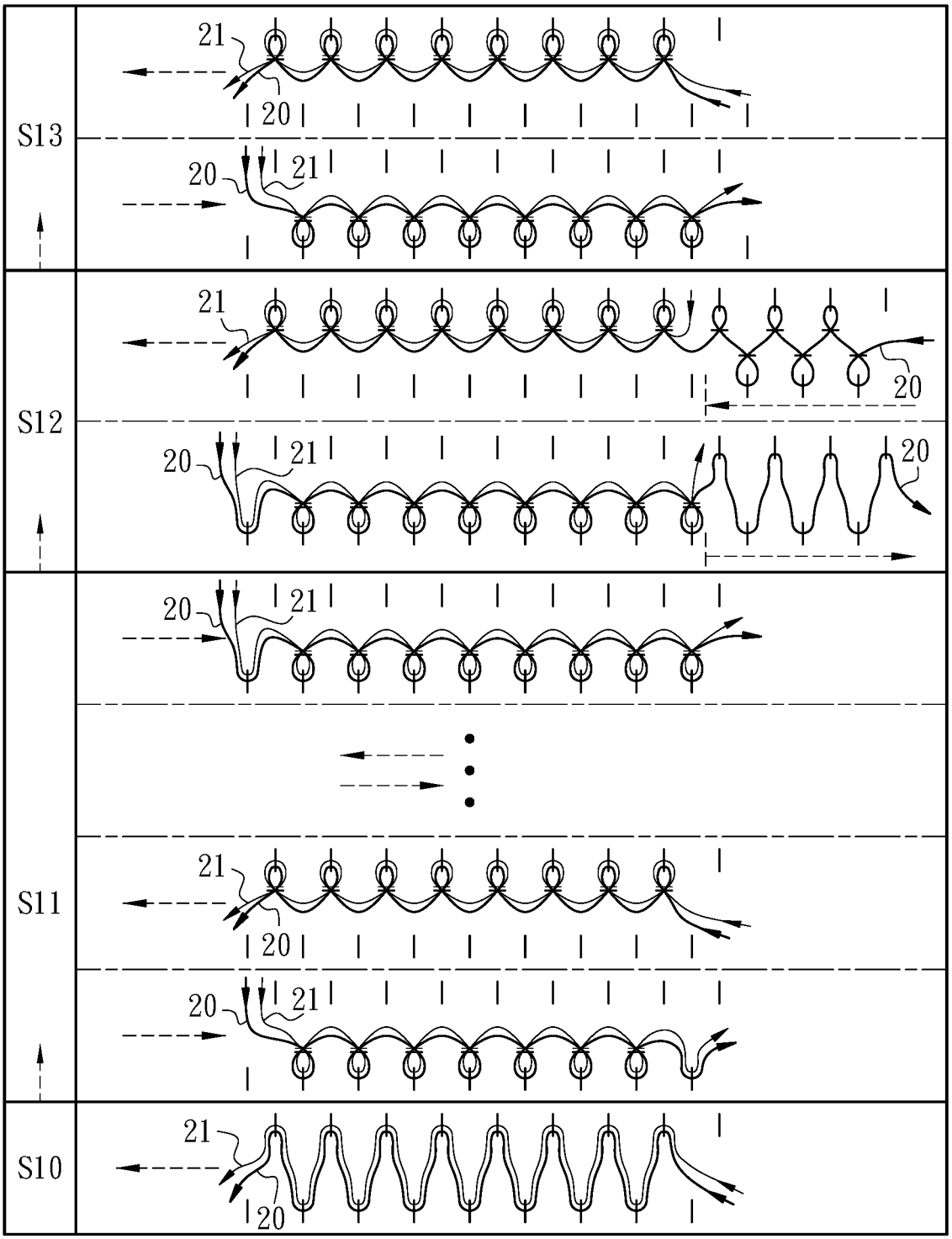
FIG. 9 is a schematic diagram of a knitting process according to a third embodiment of the present invention.
Figure 10:
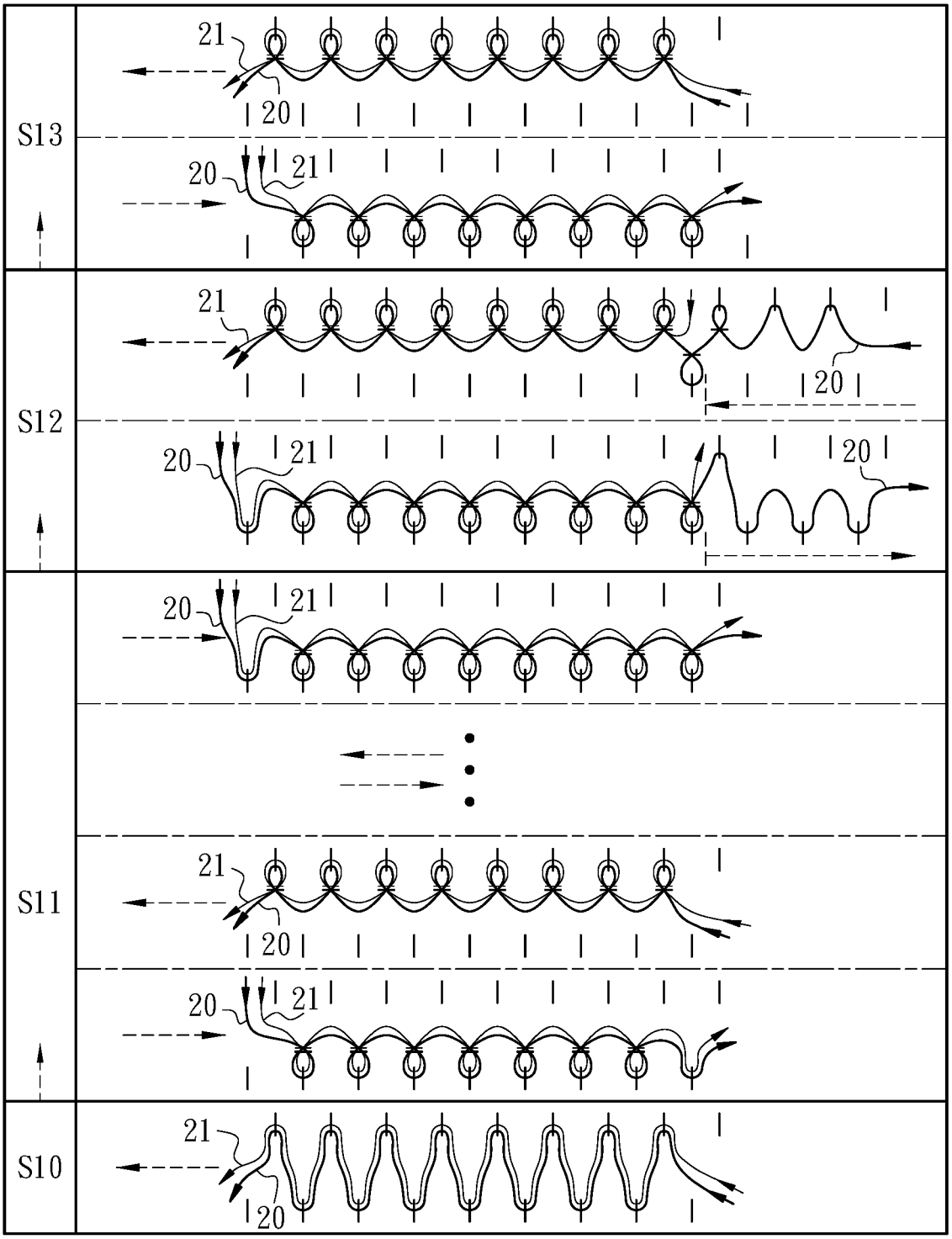
FIG. 10 is a schematic diagram of a knitting process according to a fourth embodiment of the present invention.

Further, the knitting method of the reinforcement piece 160 is not limited being performed by single-sided knitting shown in FIG. 4, and may also be performed by dual-sided knitting, or in continuation of a tubular knitting approach of the first shoe upper 11 and the second shoe upper 12. Referring to FIG. 9 showing dual-sided knitting, during a dual-sided knitting process, the flat knitting machine 90 simultaneously controls the front needle bed 901 and the back needle bed 902 to weave the reinforcement piece 160. Further, referring to FIG. 10 showing tubular knitting, the flat knitting machine 90 utilizes the front needle bed 901 to perform an initial knitting process of the reinforcement piece 160, and then utilizes the back needle bed 902 to continue knitting the reinforcement piece 160 in a reverse direction when the front needle bed 901 reaches the extension stitch count. Thus, the reinforcement piece 160 appears as a tubular shape, and forms a space (not shown) that is in communication with the in-shoe space 13.

Figure 11:
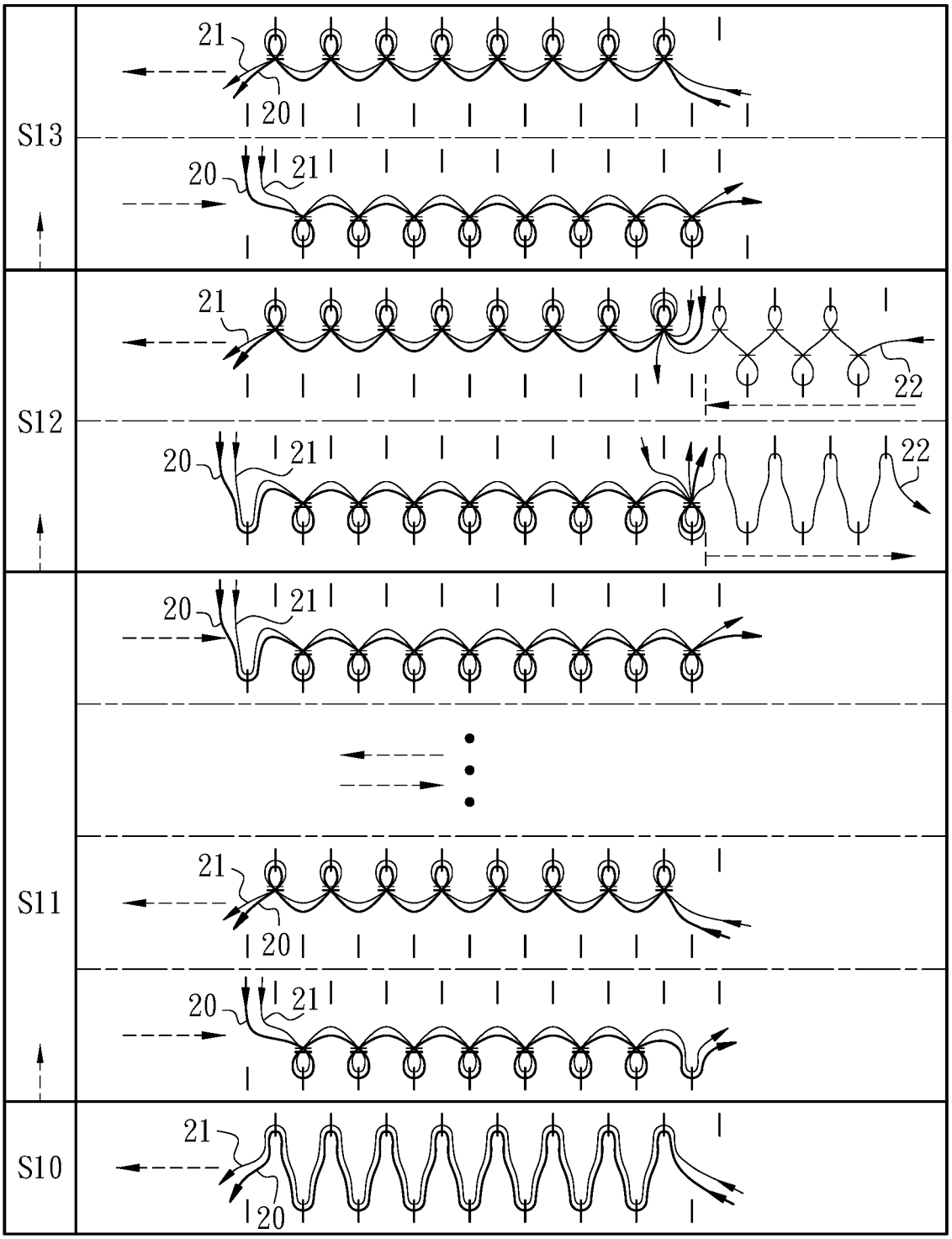
FIG. 11 is a schematic diagram of a knitting process according to a fifth embodiment of the present invention.
Figure 12:
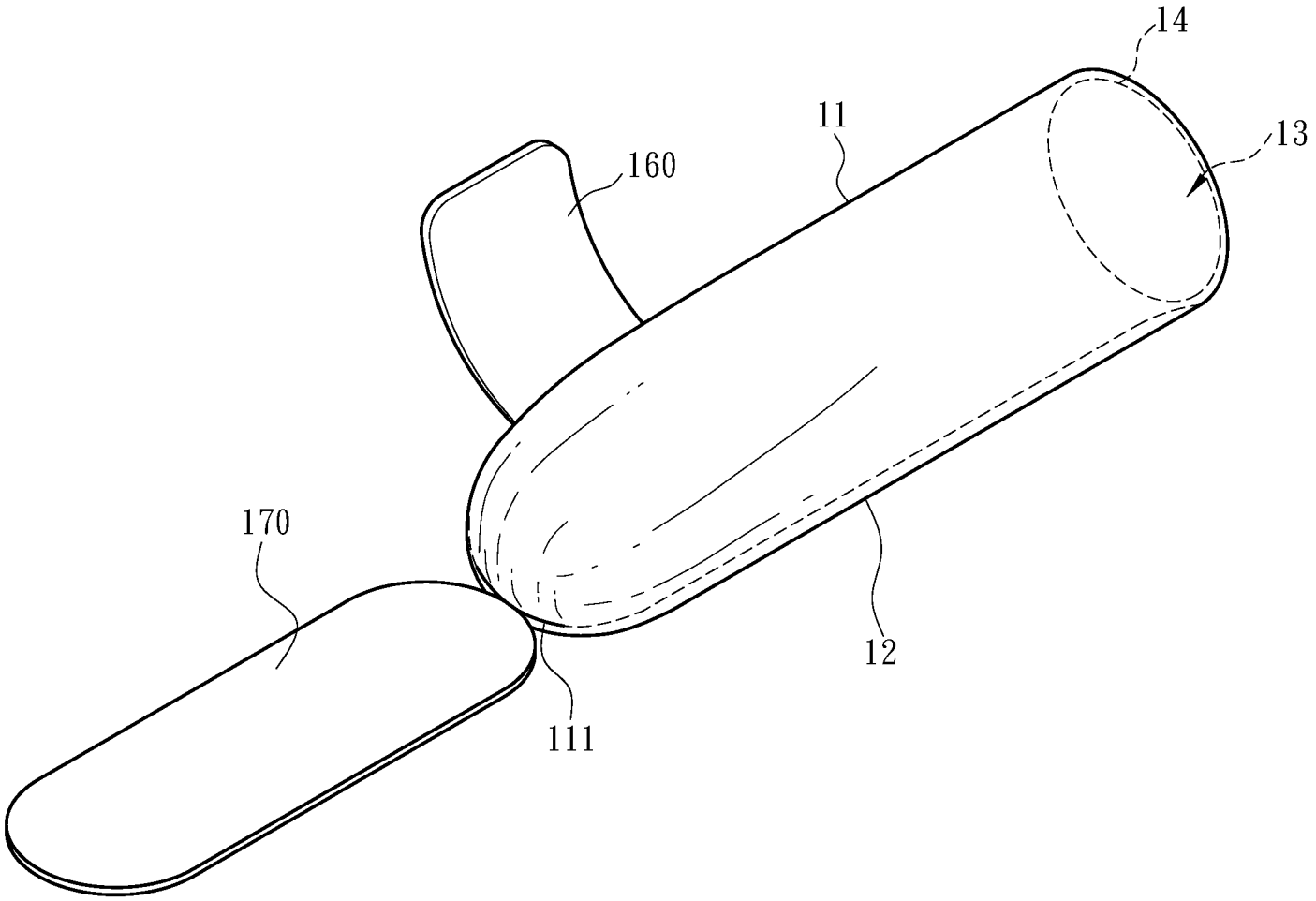
FIG. 12 is a perspective structural schematic diagram of a shoe blank according to a sixth embodiment of the present invention.
Figure 13:
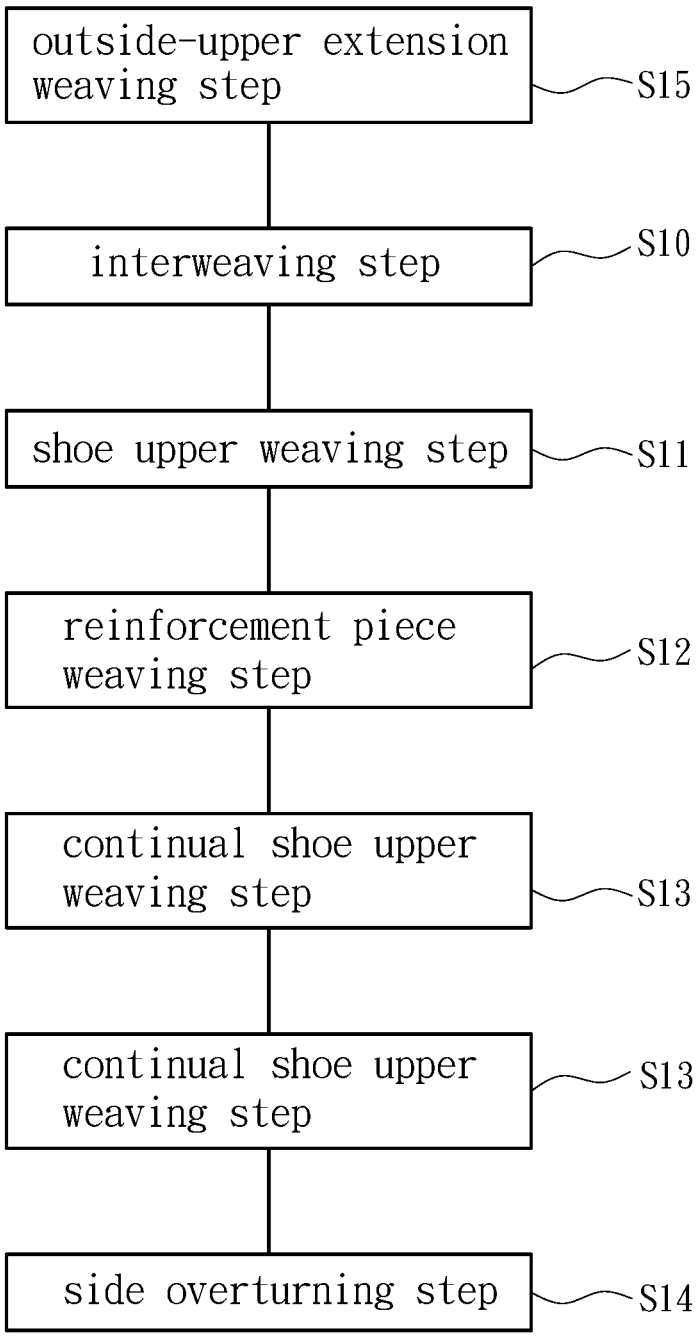
FIG. 13 is a flowchart of steps of a method according to the sixth embodiment of the present invention.
Figure 14:
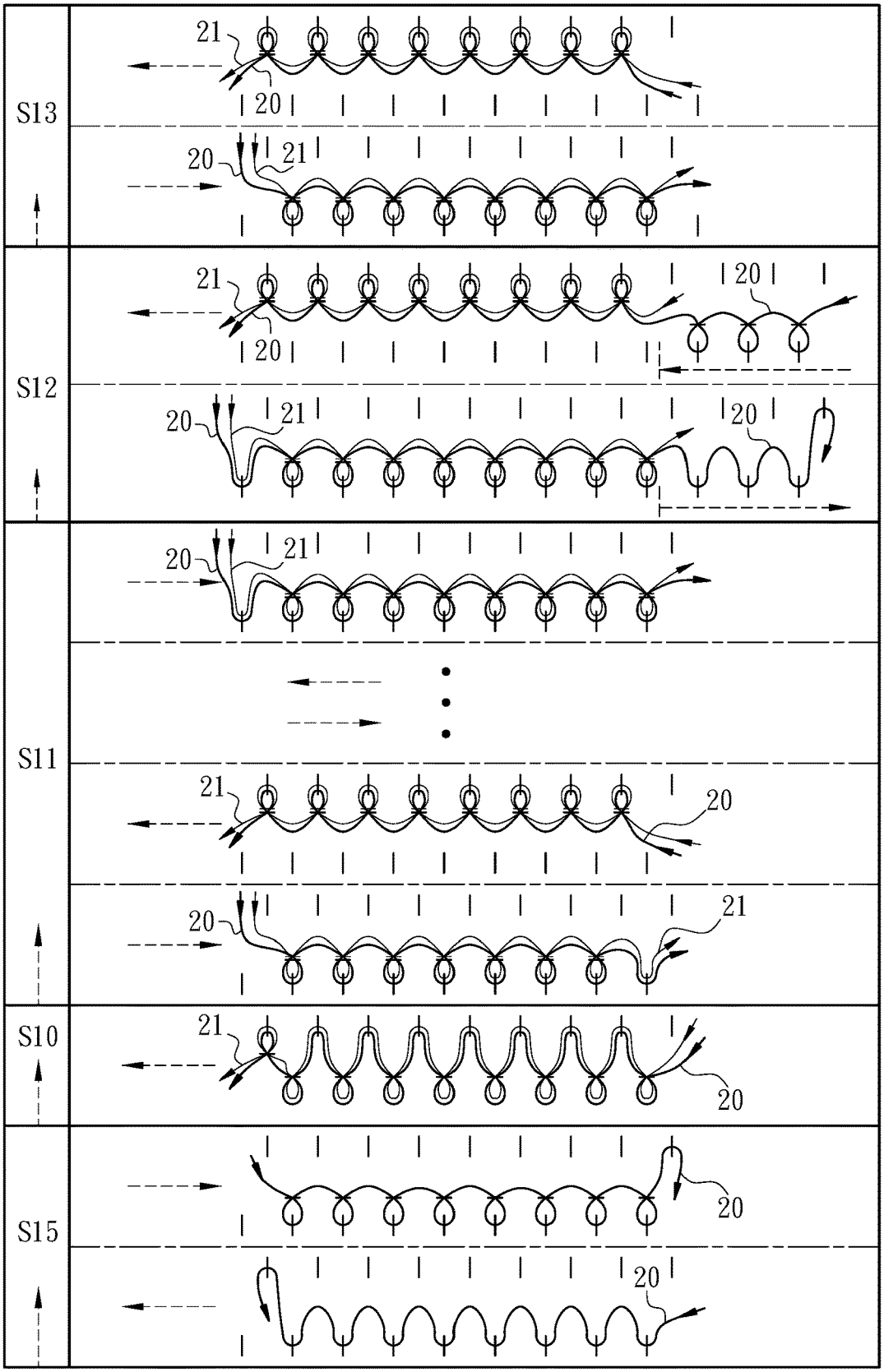
FIG. 14 is a schematic diagram of a knitting process according to the sixth embodiment of the present invention.
Figure 15A:
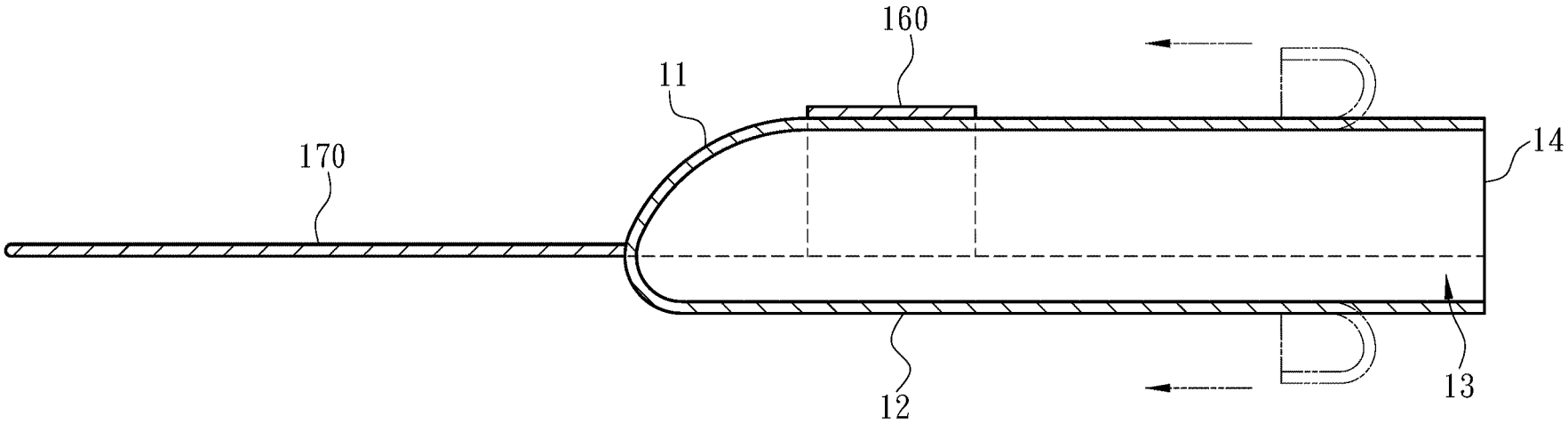
FIG. 15A to FIG. 15C are first to third continuous schematic diagrams of a folding and overturning process according to the sixth embodiment of the present invention.
Figure 15B:
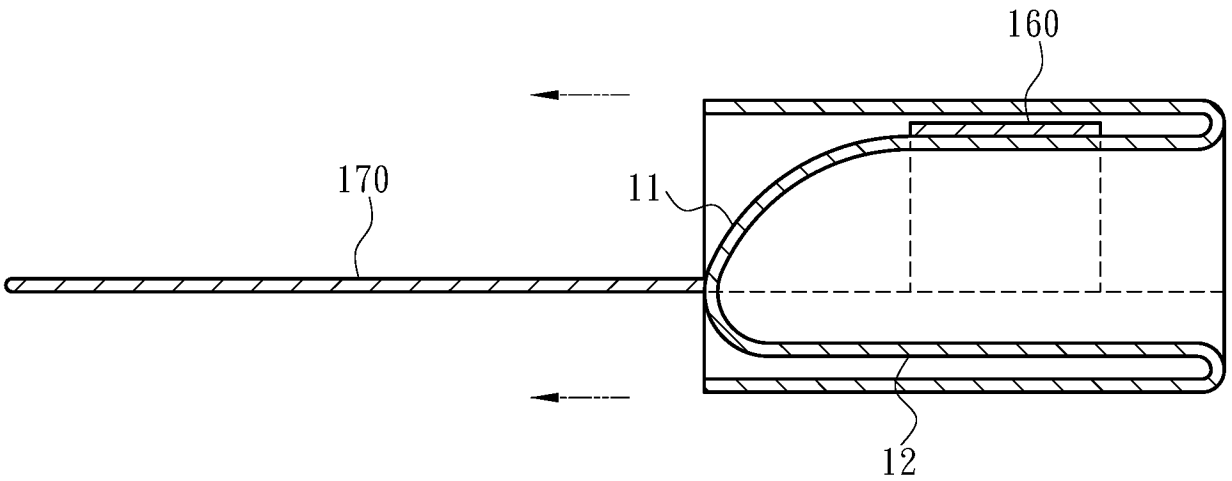
Figure 15C:
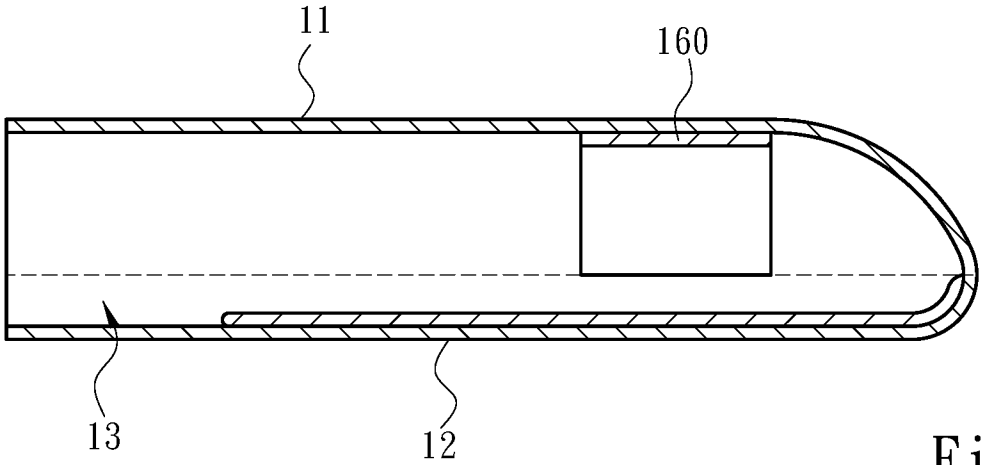
Figure 16:
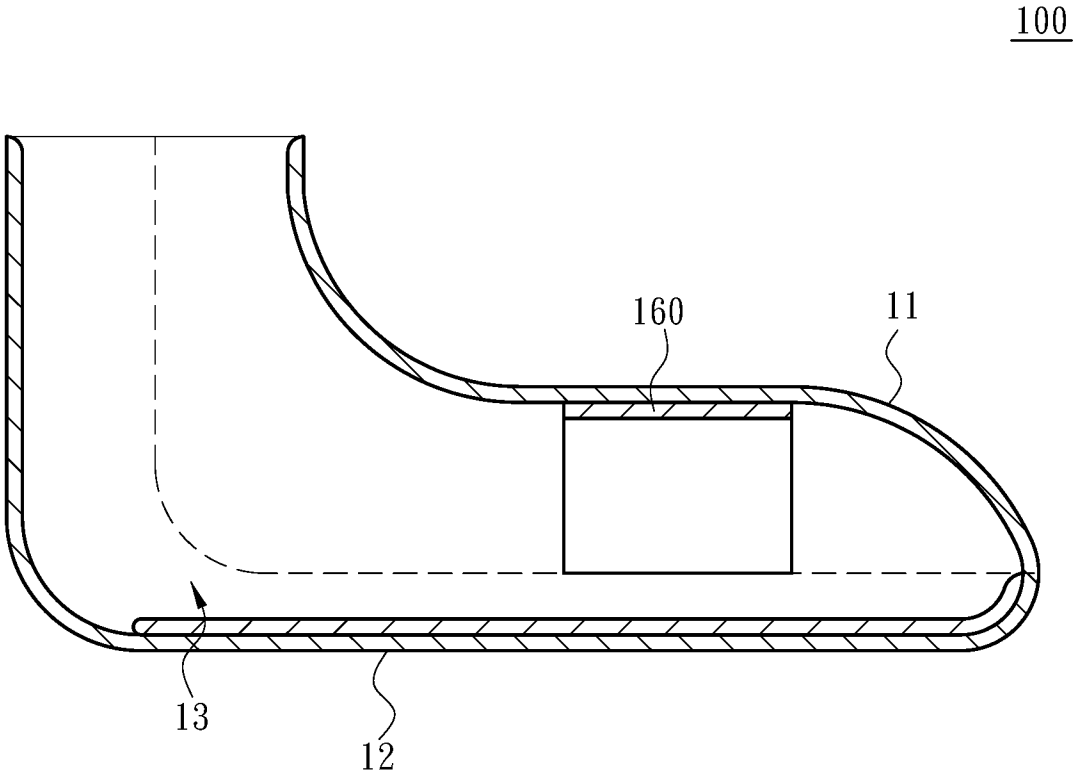
FIG. 16 is a sectional schematic diagram of a knitted shoe prototype according to the sixth embodiment of the present invention.
Figure 17:
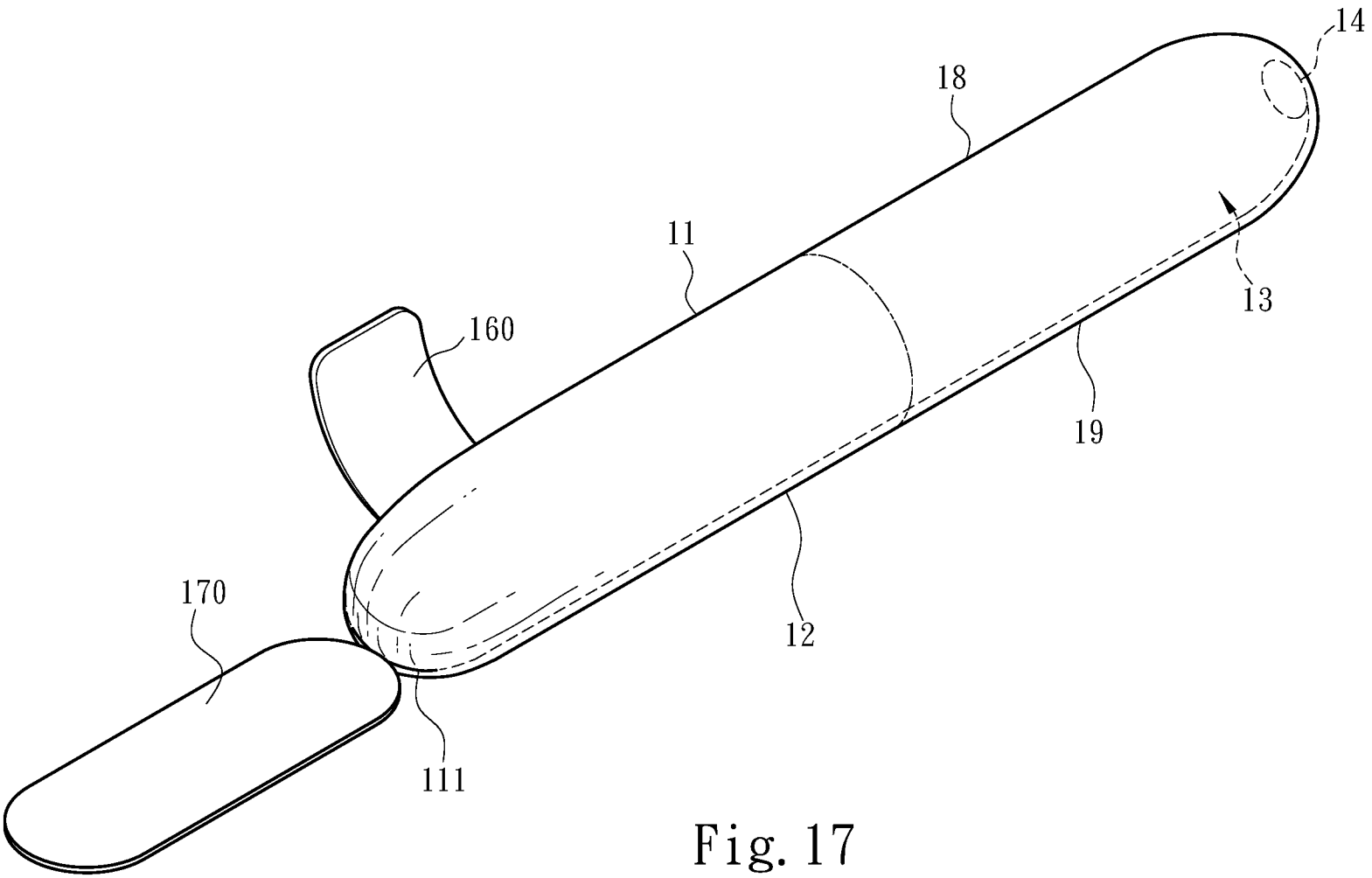
FIG. 17 is a perspective structural schematic diagram of a shoe blank according to a seventh embodiment of the present invention.
Figure 18:
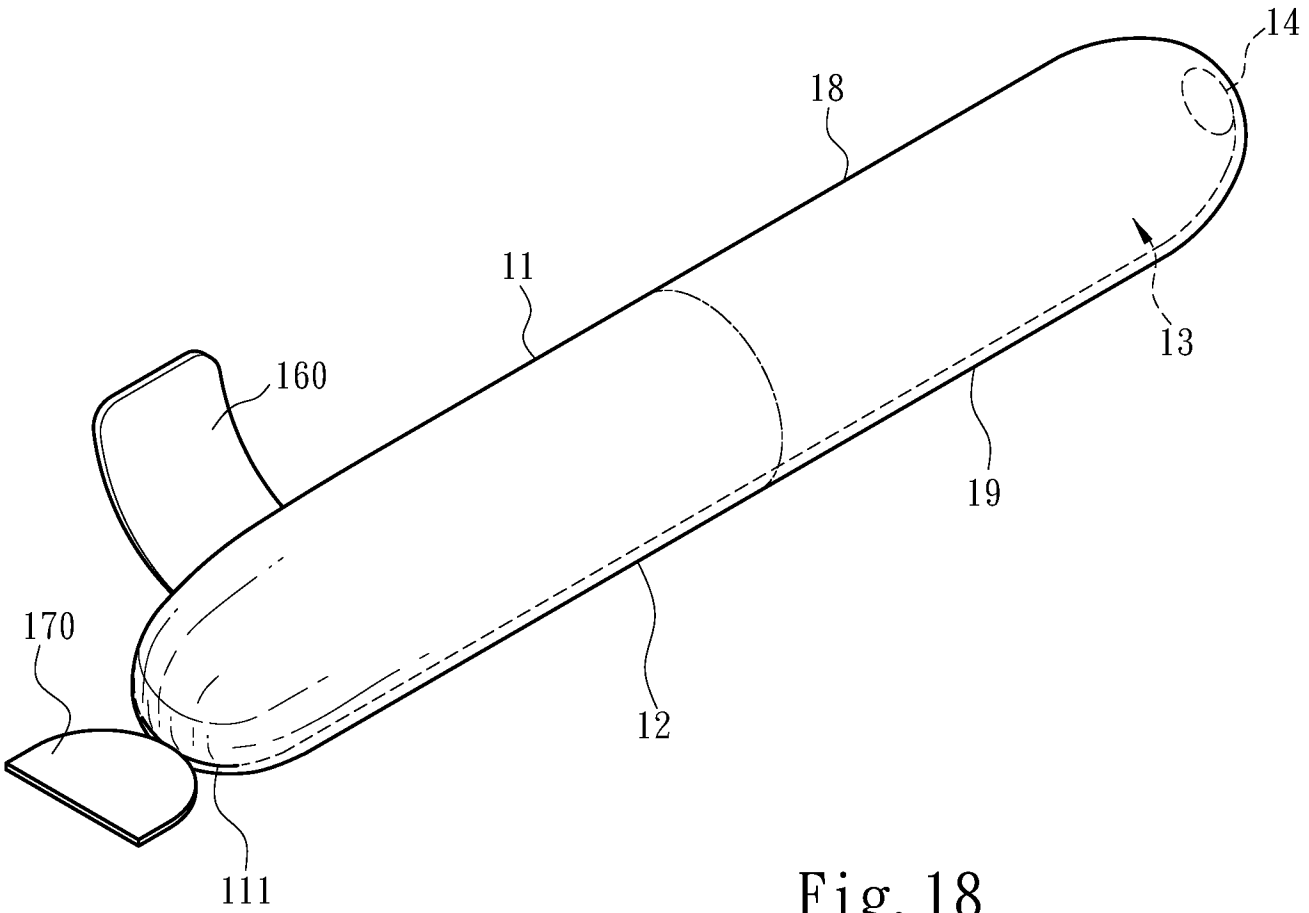
FIG. 18 is a perspective structural schematic diagram of a shoe blank according to an eighth embodiment of the present invention.
Figure 19:
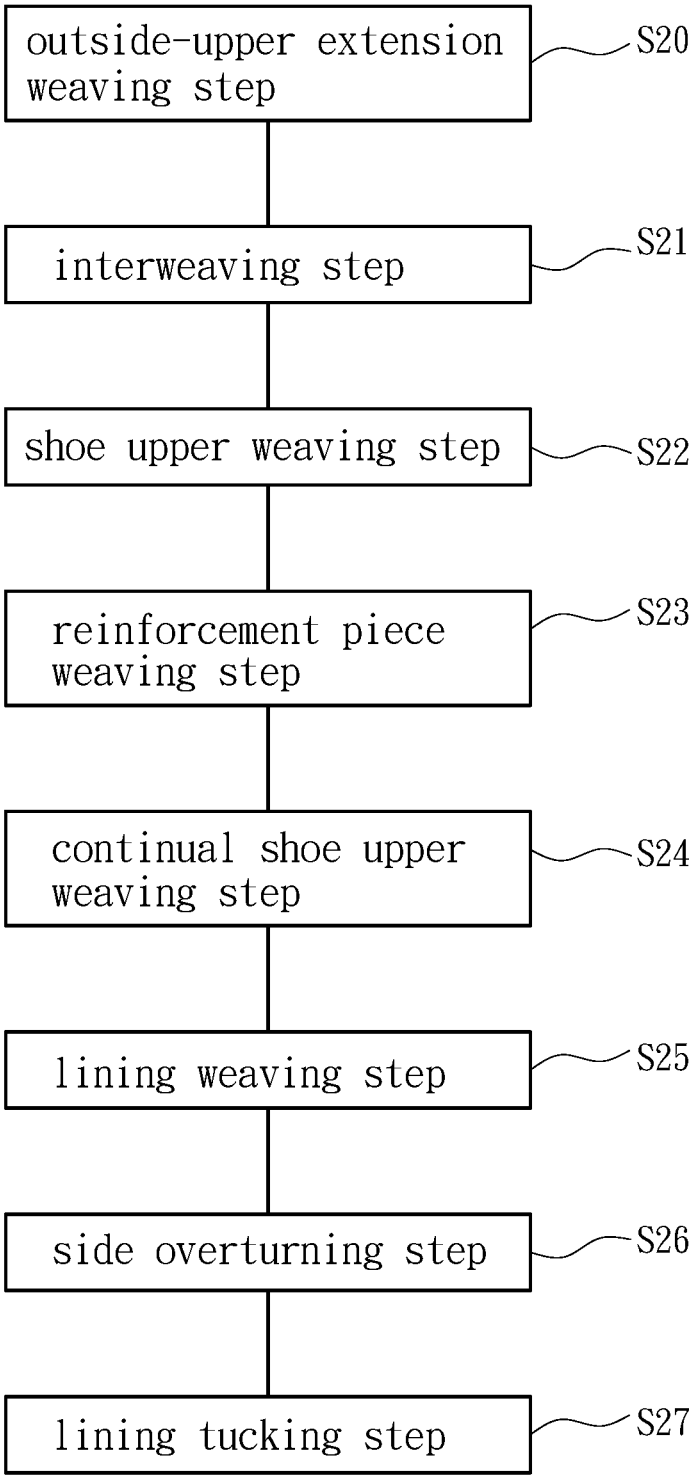
FIG. 19 is a flowchart of steps of a method according to the seventh embodiment of the present invention.
Figure 20A:
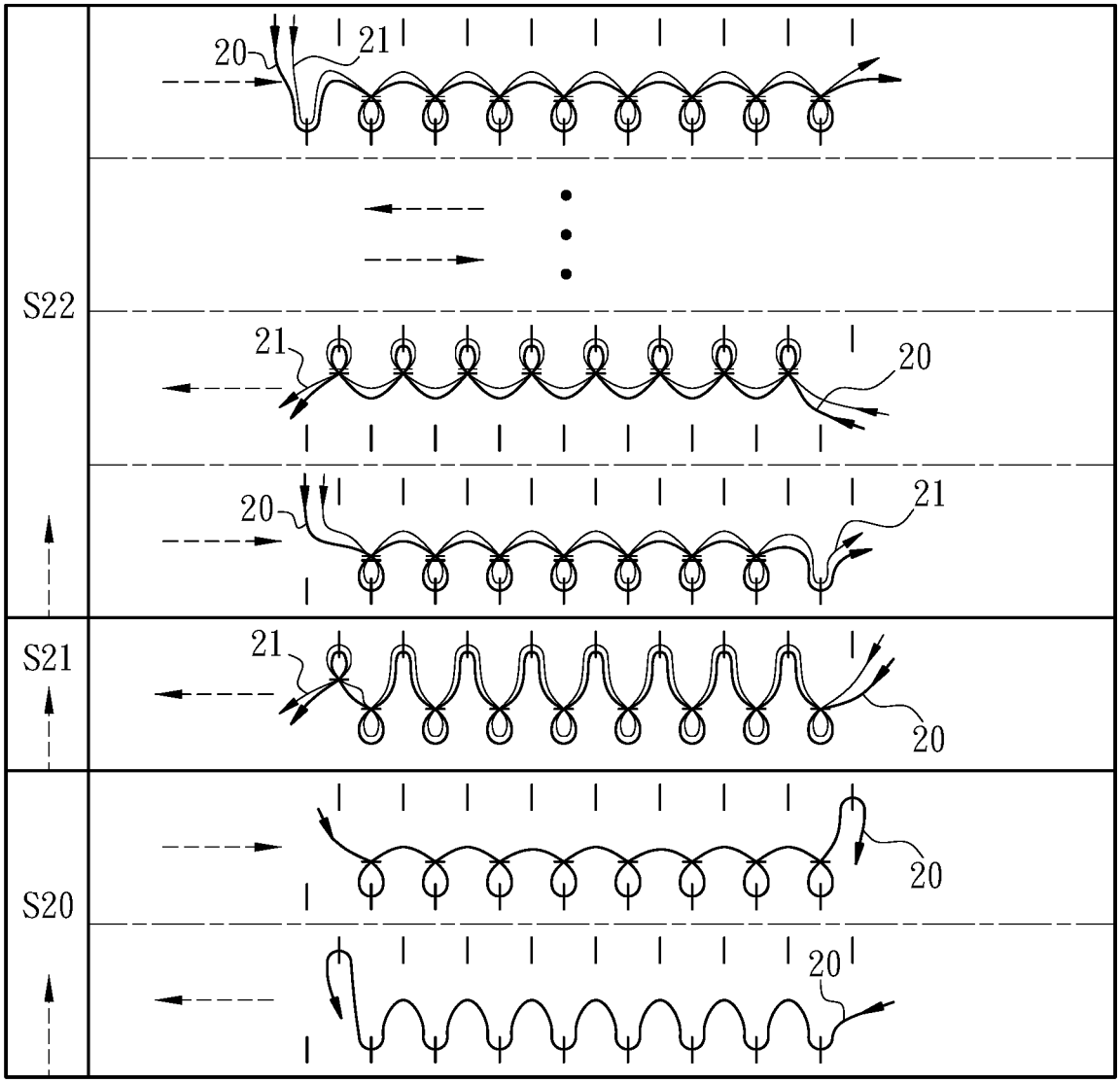
FIG. 20A and FIG. 20B are schematic diagrams of a knitting process according to the seventh embodiment of the present invention.
Figure 20B:
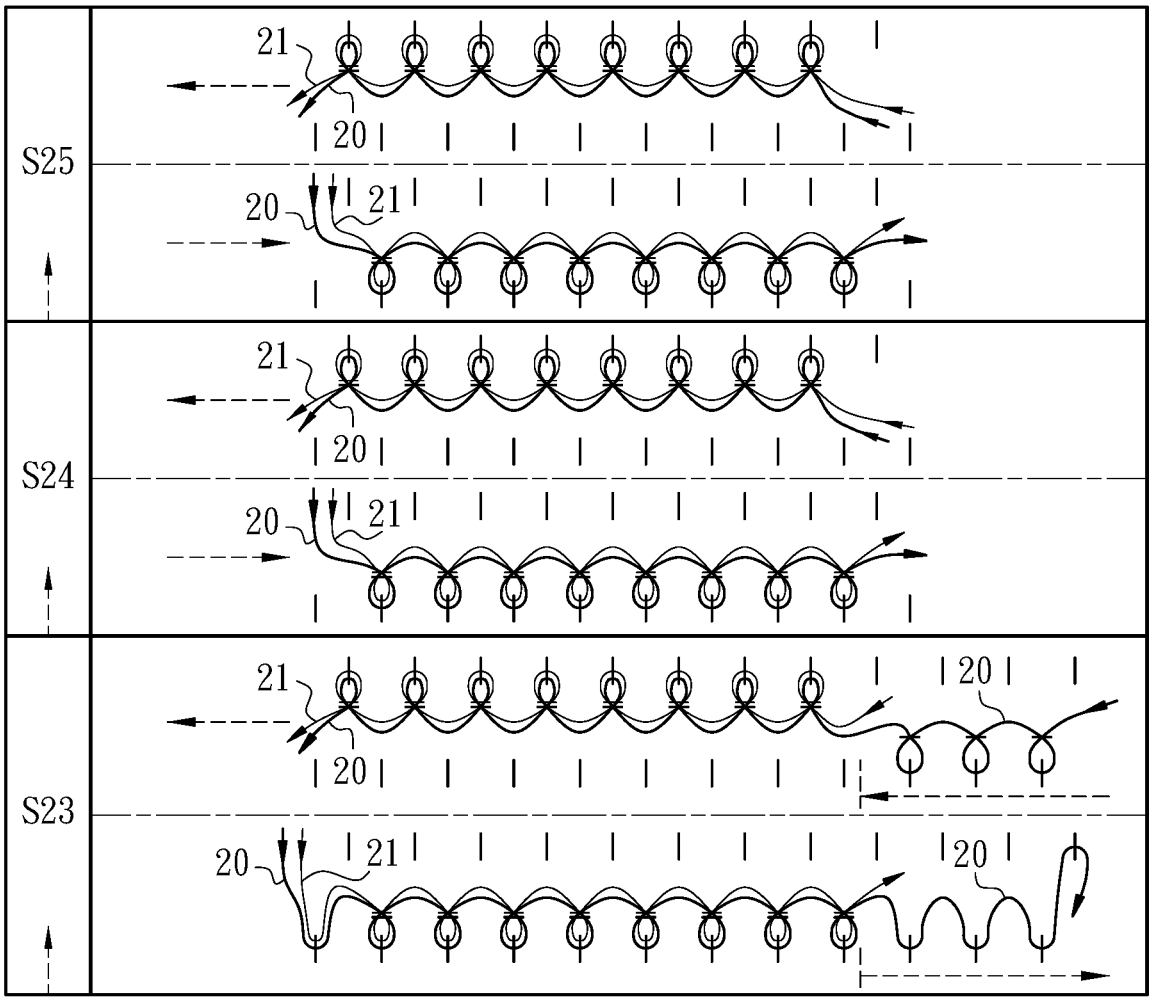

Referring to FIG. 11, in addition to knitting the reinforcement piece 160 of the present invention from the yarn 20 (or 21) that forms the first shoe upper 11 or the second shoe upper 12, while knitting the reinforcement piece 160 in the reinforcement piece knitting step S12, the flat knitting machine 90 may suspend feeding of the yarn 20 (or 21), and feed a new yarn 22 to weave the reinforcement piece 160. Implementation details of adjusting such yarn feeding are generally known to one person skilled in the art, and shall be omitted herein. Thus, the color of the reinforcement piece 160 may be made different from that of the body of the shoe blank 10 to provide the shoe blank 10 with overall color variations.

Referring to FIG. 12 to FIG. 16, in one embodiment, before the interleaving step S10, the method further includes an outside-upper extension knitting step S15, in which an extension 170 is woven by knitting at least one of the yarns 20 and 21. A knitting ending point of the extension 170 is for continuing knitting the initial shoe edge 111, and the extension 170 may serve as a toe support piece disposed at a lower end of the in-shoe space 13 or a sole piece adhered to the second shoe upper 12. More specifically, the front needle bed 901 and the back needle bed 902 of the flat knitting machine 90 are set to first knit at least one of the yarns 20 and 21 at the beginning of knitting the shoe blank 10 to form the extension 170. The stitch count of the extension 170 is determined with reference to the shoe upper stitch count of the first shoe upper 11 or the second shoe upper 12, such that the size of the woven extension 170 at least corresponds to the size of the first shoe upper 11. Further, during the process of knitting the extension 170, the length of the extension 170 may be adjusted according to whether the extension 170 is to serve as the toe support piece or the sole piece. Further, the length of the extension 170 serving as the toe support piece is shorter than the length of the extension serving as the sole piece. After the extension 170 is completely woven, the interlacing step S10, the shoe upper knitting step S11, the reinforcement piece knitting step S12, the continual shoe upper knitting step S13 and the side overturning step S14 are performed. During the implementation process of the side overturning step S14, the extension 170 is first sewn or adhered according to application requirements, and is together with the reinforcement piece 160 placed into the in-shoe space 13 defined by the overturned first shoe upper 11 and second shoe upper 12. Further, the knitting method of the extension 170 may be single-sided knitting or dual-sided knitting, and may further use a yarn different from those for knitting the first shoe upper 11 and the second shoe upper 12. Further, during the knitting process of the present invention, at least one additional part having an identical pattern as the extension 170 may be woven in continuation from the extension 170. The additional part and the extension may be stacked to increase the structural strength provided by the extension 170.

Referring to FIG. 17 to FIG. 22, in one embodiment, the method includes following steps.

An outside-upper extension knitting step S20, the extension 170 is woven by knitting at least one of the yarns 20 and 21.

In an interlacing step S21, the initial shoe edge 111 connected to the extension 170 is woven by knitting the at least two yarns 20 and 21 in an interlaced manner.

In a shoe upper knitting step S22, the first shoe upper 11 connected to the initial shoe edge 111 is woven by knitting the at least two yarns 20 and 21, knitting in a reverse direction is performed when the shoe upper stitch count is reached to weave the second shoe upper 12 that faces the first shoe upper 11 by knitting the two yarns 20 and 21, and the first shoe upper 11 is woven in a reverse direction according to the shoe upper stitch count, hence cyclically knitting the first shoe upper 11 and the second shoe upper 12.

In a reinforcement piece knitting step S23, the reinforcement piece 160 is woven by knitting at least one of the yarns 20 and 21 when the shoe upper stitch count is reached in the shoe upper knitting step S22, knitting in a reverse direction is performed when the extension stitch count is reached while knitting the reinforcement piece 160, and the first shoe upper 11 and the second shoe upper 12 are woven by knitting the at least two yarns 20 and 21 according to the shoe upper stitch count when the extension stitch count is again reached, hence cyclically knitting the reinforcement piece 160, the first shoe upper 11 and the second shoe upper 12.

In a continual shoe upper knitting step S24, the first shoe upper 11 and the second shoe upper 12 are cyclically woven by knitting the two yarns 20 and 21.

In a lining knitting step S25, a first lining 18 connected to the first shoe upper 11 is woven by knitting the at least two yarns 20 and 21, knitting in a reverse direction is performed when the shoe upper stitch count is reached to weave a second lining 19 that faces the first lining 18 and is connected to the second shoe upper 12 by knitting the two yarns 20 and 21, and the first lining 18 is woven in a reverse direction according to the shoe upper stitch count, hence cyclically knitting the first lining 18 and the second lining 19. Ends of the first lining 18 and the second lining 19 form the shoe opening 14.

In a side overturning step S26, the first lining 18 and the second lining 19 are folded from the shoe opening 14, and the first shoe upper 11 and the second shoe upper 12 are simultaneously drawn to be overturned, so as to locate the reinforcement piece 160 and the extension 170 in the in-shoe space 13 defined by the overturned first shoe upper 11 and second shoe upper 12. The extension 170 may be the toe support piece disposed at the lower end of the in-shoe space 13 or the sole piece adhered to the second shoe upper 12.

In a lining tucking step S27, the overturned first lining 18 and second lining 19 are tucked towards the in-shoe space 13, and ends of the first lining 18 and the second lining 19 are secured to the lower end of the in-shoe space 13 to complete the shoe blank 10.

Referring to FIG. 17 to FIG. 22, more specifically, at the beginning of the implementation of the embodiment, the front needle bed 901 and the back needle bed 902 of the flat knitting machine 90 are set to first knit at least one of the yarns 20 and 21 at the beginning of knitting the shoe blank 10 to form the extension 170. After the extension 170 is completely woven, the flat knitting machine 90 causes the front needle bed 901 and the back needle bed 902 to knit simultaneously to cause the two yarns 20 and 21 to be interlaced to form the initial shoe edge 111. After the initial shoe edge 111 is completely woven, unbroken-yarn knitting is continued to perform the shoe upper knitting step S22. During the knitting process of the shoe upper knitting step S22, the front needle bed 901 weaves the first shoe upper 11 in an extended manner from an end of one side of the initial shoe edge 111. When the front needle bed 901 reaches the shoe upper stitch count while knitting the first shoe upper 11, the flat knitting machine 90 continues unbroken-yarn knitting and performs yarn feeding in a reverse direction to cause the back needle bed 902 to continue knitting the second shoe upper 12 by knitting the two yarns 20 and 21. After that, each time the front needle bed 901 or the back needle bed 902 reaches the shoe upper stitch count during the knitting process, the flat knitting machine 90 performs knitting in a reverse direction, hence cyclically knitting the first shoe upper 11 and the second shoe upper 12. The reinforcement piece knitting step S23 is then performed. At the beginning of the reinforcement piece knitting step S23, the flat knitting machine 90 is at the knitting ending point of the first shoe upper 11 or the second shoe upper 12, the yarn feeding mechanism 903 is controlled to progress in a non-reversed direction, and the flat knitting machine 90 continues knitting the reinforcement piece 160 along the current knitting direction by knitting the at least one of the yarns 20 and 21. During the process of knitting the reinforcement piece 160, the flat knitting machine 90 controls the nose to progress in a non-reversed direction for knitting and the front needle bed 901 to weave the reinforcement piece 160, such that the woven reinforcement piece 160 protrudes from edges of the first shoe upper 11 and the second shoe upper. Further, the during the process of knitting the reinforcement piece 160, the flat knitting machine 90 continues knitting the reinforcement piece 160 in a reverse direction when the front needle bed 901 reaches the extension stitch count while knitting the reinforcement piece 160, and causes the front needle bed 901 and the back needle bed 902 to continue knitting the first shoe upper 11 and the second shoe upper 12 by knitting the two yarns 20 and 21 when the extension stitch count is again reached. Details of the knitting process of the first shoe upper 11 and the second shoe upper 12 are as described in the shoe upper knitting step S22, and shall be omitted herein. Further, the extension stitch count is greater than the shoe upper stitch count.

The continual shoe upper knitting step S24 is performed after the reinforcement piece knitting step S23 is completed. The continual shoe upper knitting step S24 is similar to the knitting method in the shoe upper knitting step S22. In the continual shoe upper knitting step S24, from the knitting ending point of the reinforcement piece knitting step S23, the front needle bed 901 and the back needle bed 902 continue knitting the first shoe upper 11 and the second shoe upper 12. The lining knitting step S25 follows after the reinforcement piece knitting step S24 is completed. In the lining knitting step S25, a knitting starting point is the end of the first shoe upper 11 or the second shoe upper 12, e.g., an intersection of the first shoe upper 11 and the second shoe upper 12. The flat knitting machine 90 causes the front needle bed 901 and the back needle bed 902 to weave the second lining 19 connected to the second shoe upper 12 by knitting the two yarns 20 and 21. When the back needle bed 902 reaches the shoe upper stitch count while knitting the second lining 19, the flat knitting machine 90 performs unbroken-yarn knitting and causes the yarn feeding mechanism 903 to perform yarn feeding in a reverse direction to weave the first lining 18 connected to the first shoe upper 11 by the front needle bed 901, hence cyclically knitting the first lining 18 and the second lining 19 in an unbroken-yarn manner to complete the knitting process. Further, although the knitting process of the second lining 19 is given as an example in this embodiment, the knitting sequences of the first lining 18 and the second lining 19 may be modified according to knitting scheduling settings in practice. Further, the knitting method of the first lining 18 and the second lining 19 may be identical to that of the first shoe upper 11 and the second shoe upper 12. Further, the knitting lengths of the first lining 18 and the second lining 19 may be similar to those of the first shoe upper 11 and the second shoe upper 12.

Figure 21A:
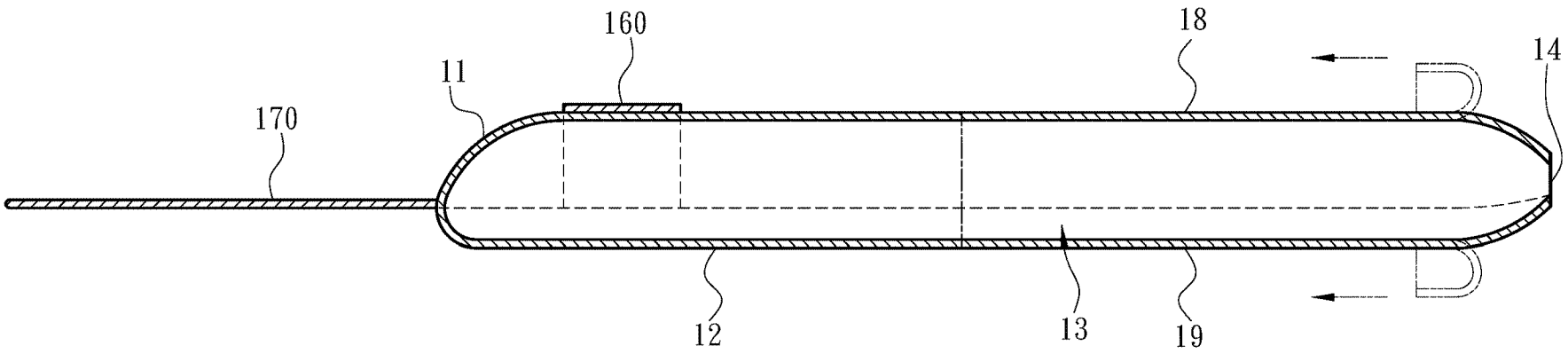
FIG. 21A to FIG. 21E are first to fifth continuous schematic diagrams of a folding and overturning process according to the seventh embodiment of the present invention.
Figure 21B:
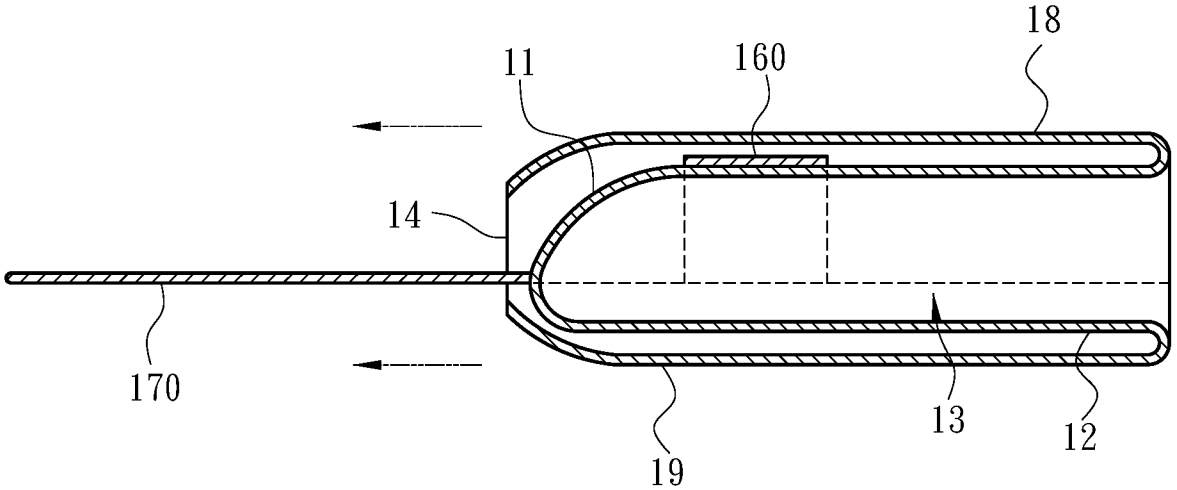
Figure 21C:
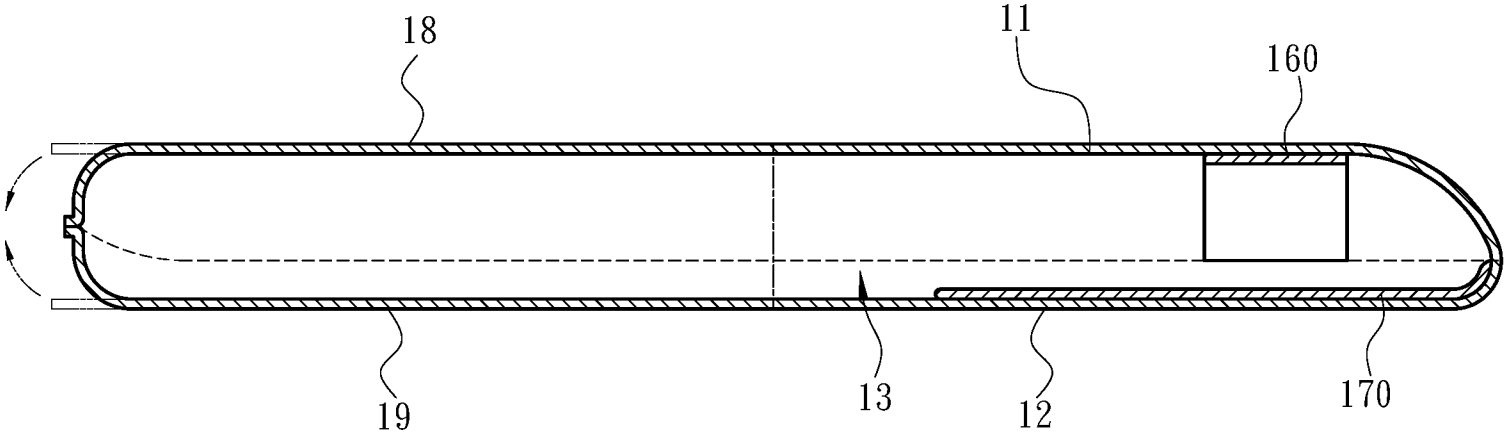
Figure 21D:
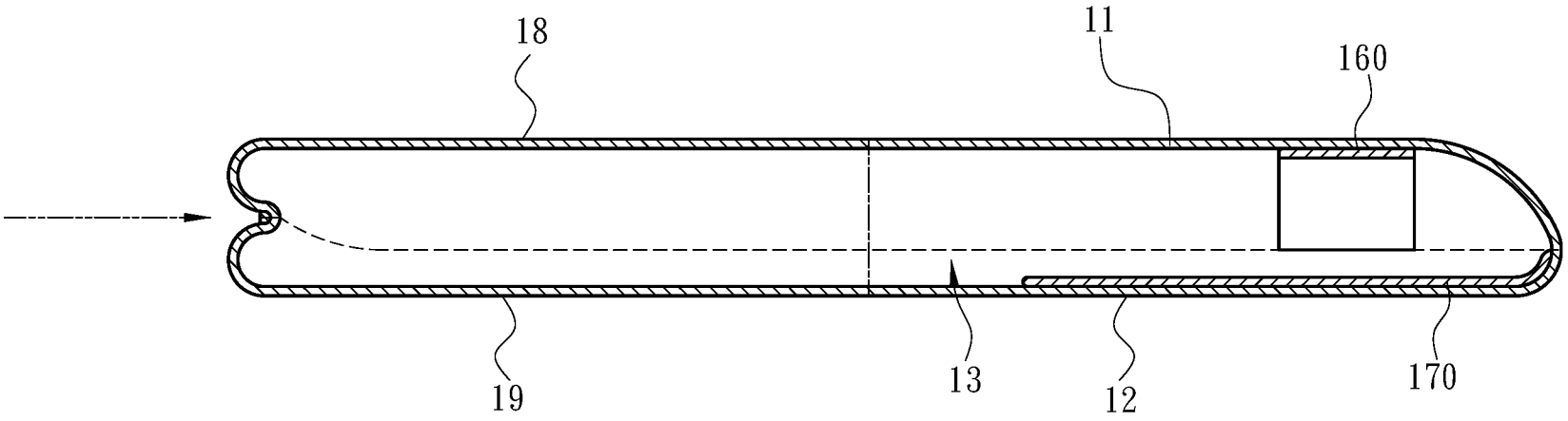
Figure 21E:
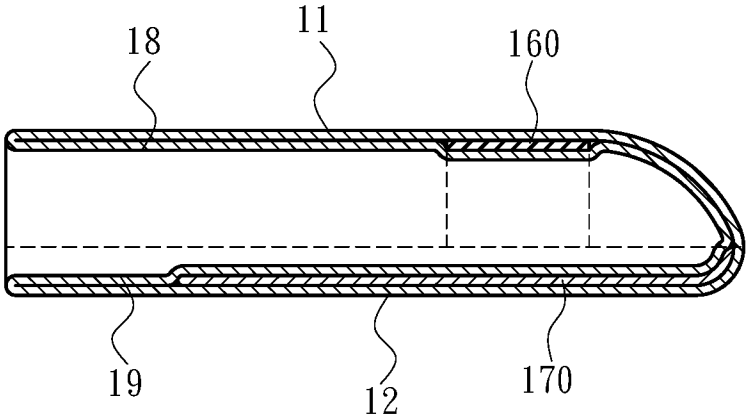

The side overturning step S26 is performed after the knitting process of the lining knitting step S25 is completed. The side overturning step S26 may be completed through a machine or a human operation without involving the flat knitting machine 90. At the beginning of the implementation, the reinforcement piece 160 is placed on the first shoe upper 11 or the second shoe upper 12, ends of the first lining 18 and the second lining 19 are held firmly, and the first lining 18 and the second lining 19 are folded from the shoe opening 14. During the process of folding the first lining 18 and the second lining 19, the first shoe upper 11 and the second shoe upper 12 are simultaneously drawn to be overturned, so as to locate the reinforcement piece 160 and the extension 170 in the in-shoe space 13 defined by the overturned first shoe upper 11 and second shoe upper 12. At this point, the position of the extension 170 may be adjusted in a way that the extension 170 may serve as the toe support piece or the sole piece. The lining tucking step S27 is performed after the side overturning process is completed. During the implementation of the lining tucking step S27, edges of ends of the first lining 18 and the second lining 19 may be first sewn, i.e., the shoe opening 14 is sewn. The first lining 18 and the second lining 19 are then tucked into the in-shoe space 13 according to a method shown in FIG. 21C to FIG. 21D. The tucked-in first lining 18 and second lining 19 are secured at the lower end of the in-shoe space 13 to complete the shoe blank 10, as shown in FIG. 21E.

In this embodiment, the two yarns 20 and 21 forming the shoe blank 10 may be in different colors, which present different colors at inner and outer surfaces of the first shoe upper 11 and the second shoe upper 12. In other words, when the two yarns 20 and 21 are in different colors, a technical front color of a fabric and a technical back color of the fabric are different. Further, one of the two yarns 20 and 21 may be clad by a hot melt layer. Thus, when the shoe blank 10 is completed, it may be placed into a mold and be appropriately heated to allow the yarn 20 (or 21) clad with the hot melt layer to melt, and the shoe blank 10 may then shape according to an appearance of the mold to complete a knitted shoe prototype 100. Further, the two yarns 20 and 21 of the present invention may be intertwined from twisting.

Figure 22:
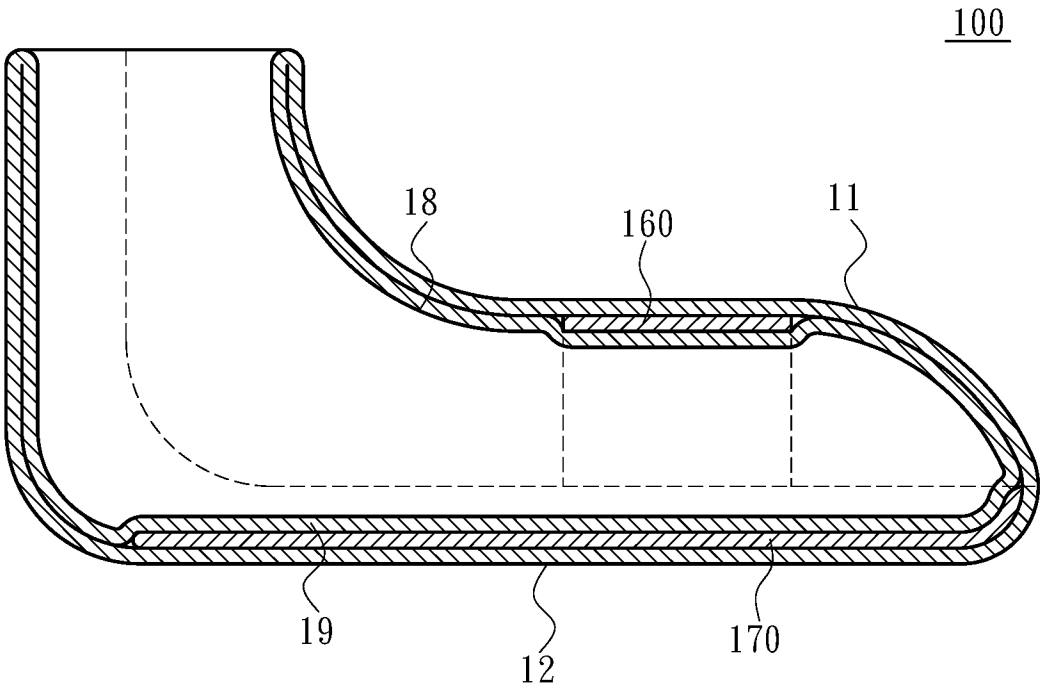
FIG. 22 is a sectional schematic diagram of a knitted shoe prototype according to the seventh embodiment of the present invention.

Accordingly, after the shoe blank 10 of the embodiment is manufactured, the reinforcement piece 160 and the extension 170 are clamped among the first shoe upper 11, the second shoe upper 12, the first lining 18 and the second lining 19. Thus, the reinforcement piece 160 and the extension 170 cannot be directly contacted in the in-shoe space 13, so as to prevent direct damages of the reinforcement piece 160 and the extension 170 caused by wearing. Further, by performing an appropriate processing on the shoe blank 10, e.g., a heating process or a paint spray process, the knitted shoe prototype 100 may be completed, as shown in FIG. 22. Further, during the knitting process of the present invention, at least one additional part having an identical pattern as the extension 170 may be woven in continuation from the extension 170. The additional part and the extension may be stacked to increase the structural strength provided by the extension 170.

Figure 23:
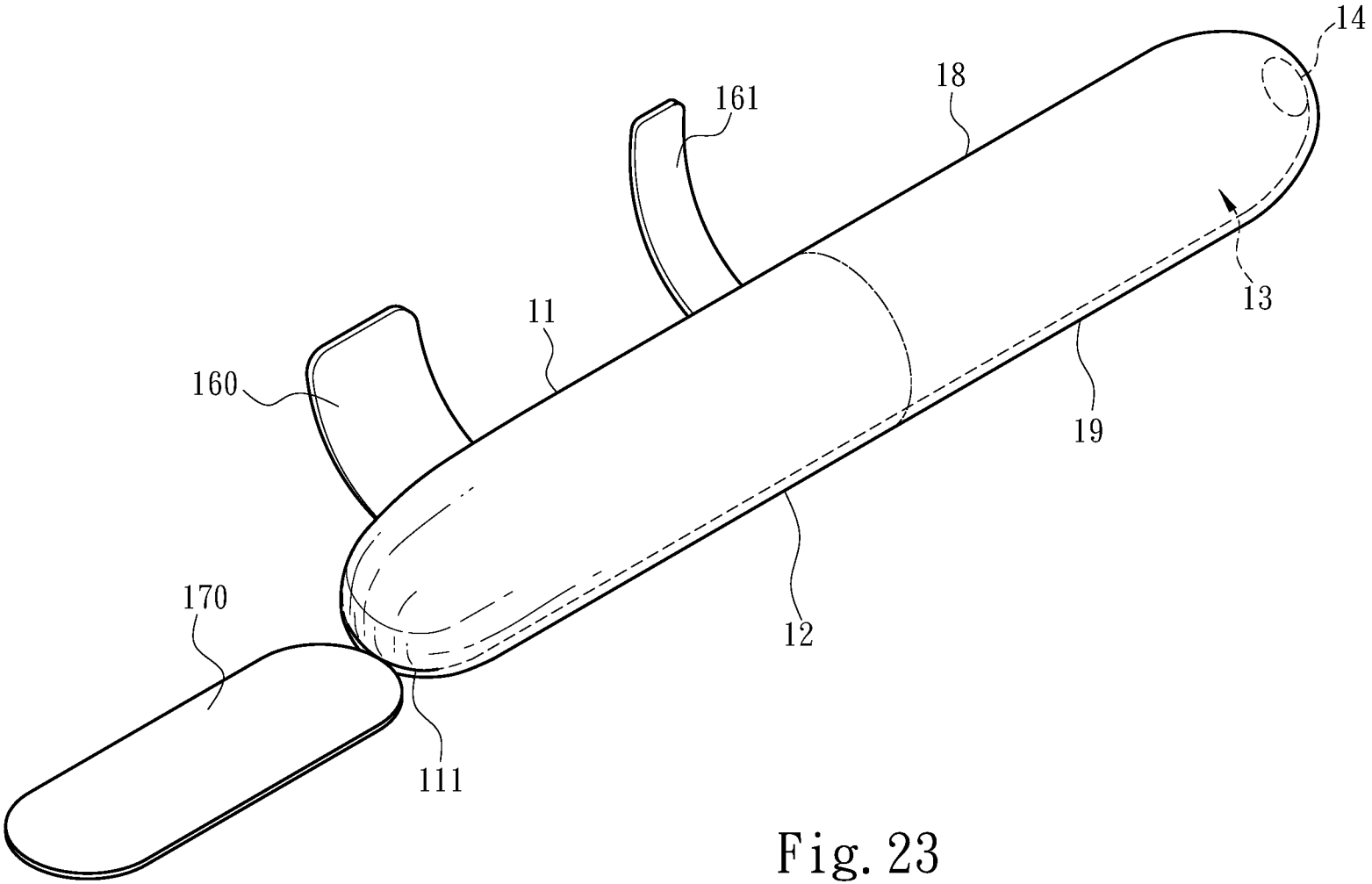
FIG. 23 is a perspective structural schematic diagram of a shoe blank according to the eighth embodiment of the present invention.
Figure 24:
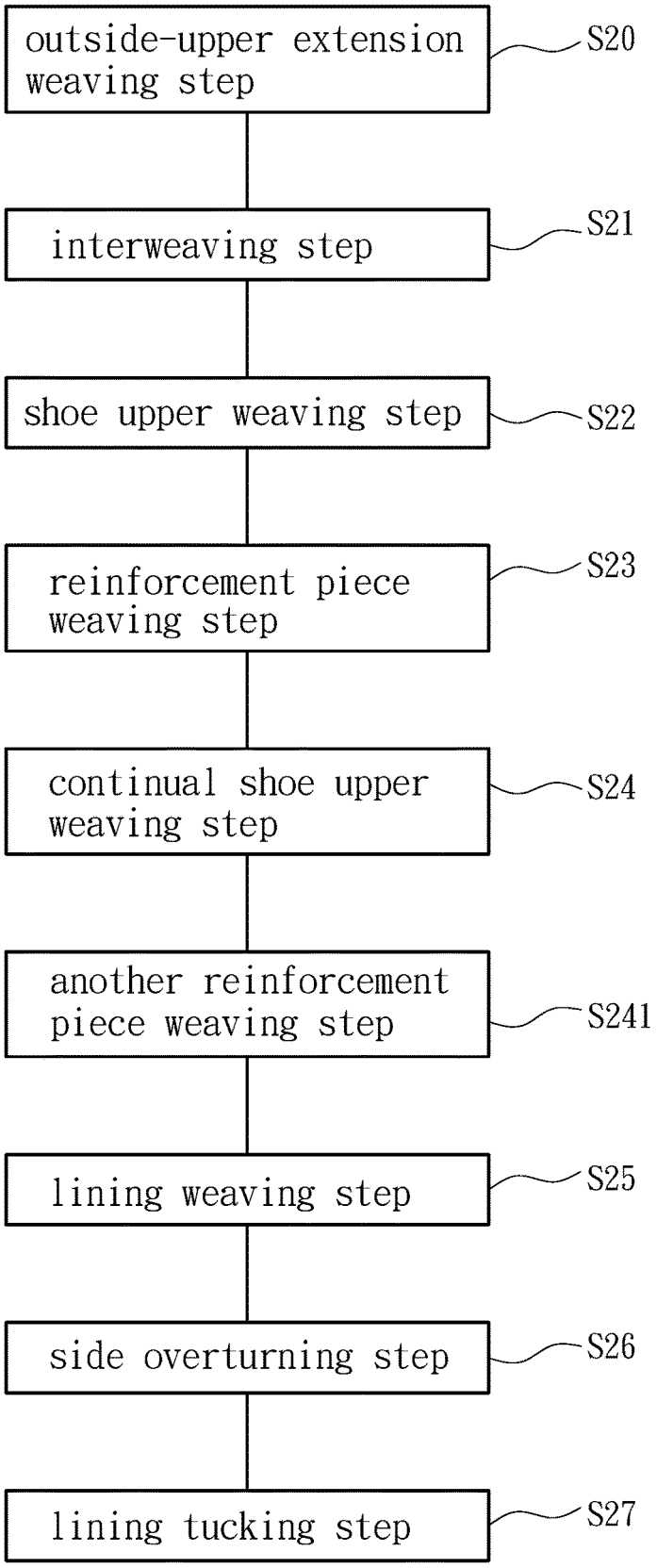
FIG. 24 is a flowchart of steps of a method according to the eighth embodiment of the present invention.
Figure 25A:
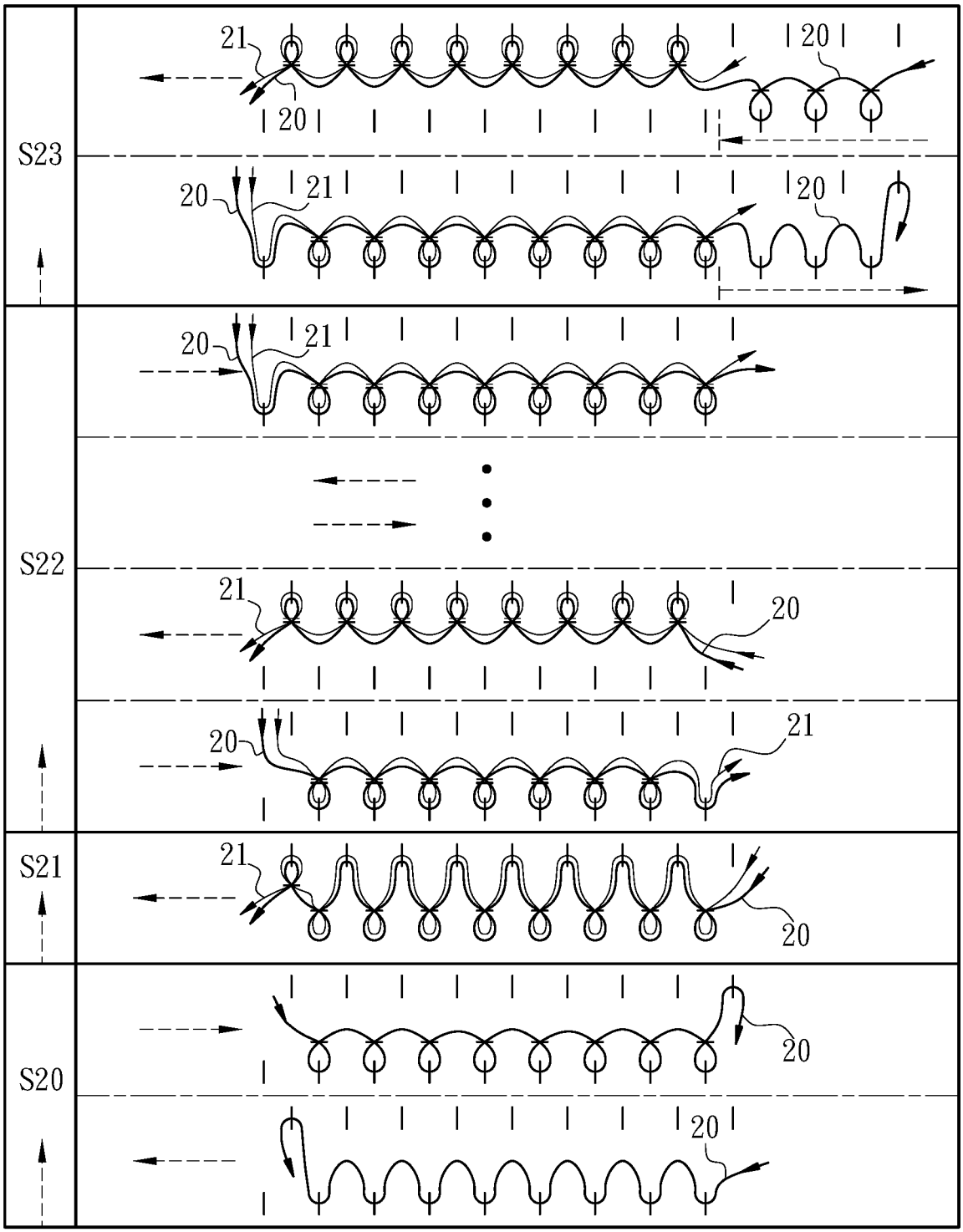
FIG. 25A and FIG. 25B are first and second schematic diagrams of a knitting process according to the seventh embodiment of the present invention.
Figure 25B:
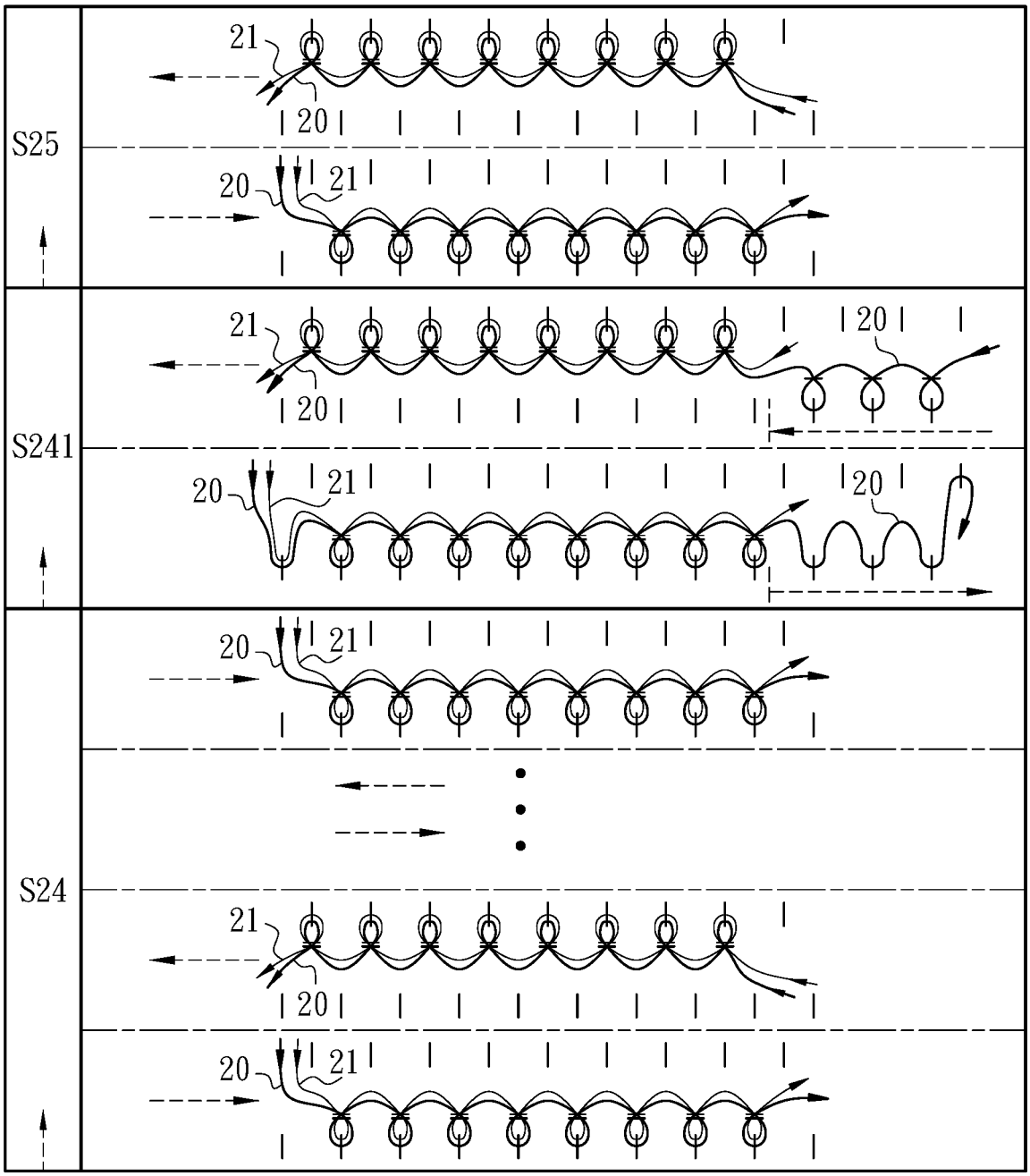
Figure 26:
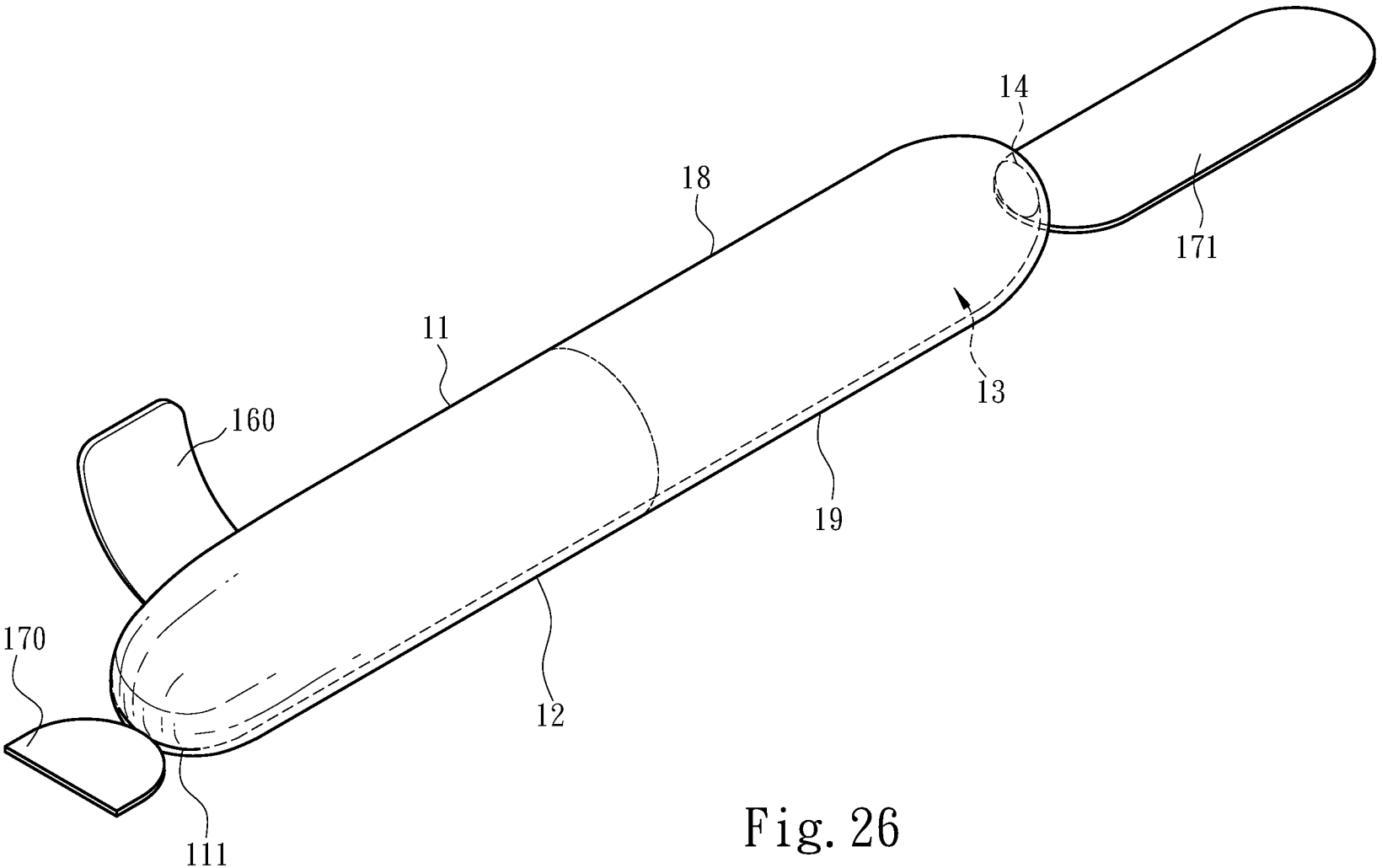
FIG. 26 is a perspective structural schematic diagram of a shoe blank according to a ninth embodiment of the present invention.
Figure 27:
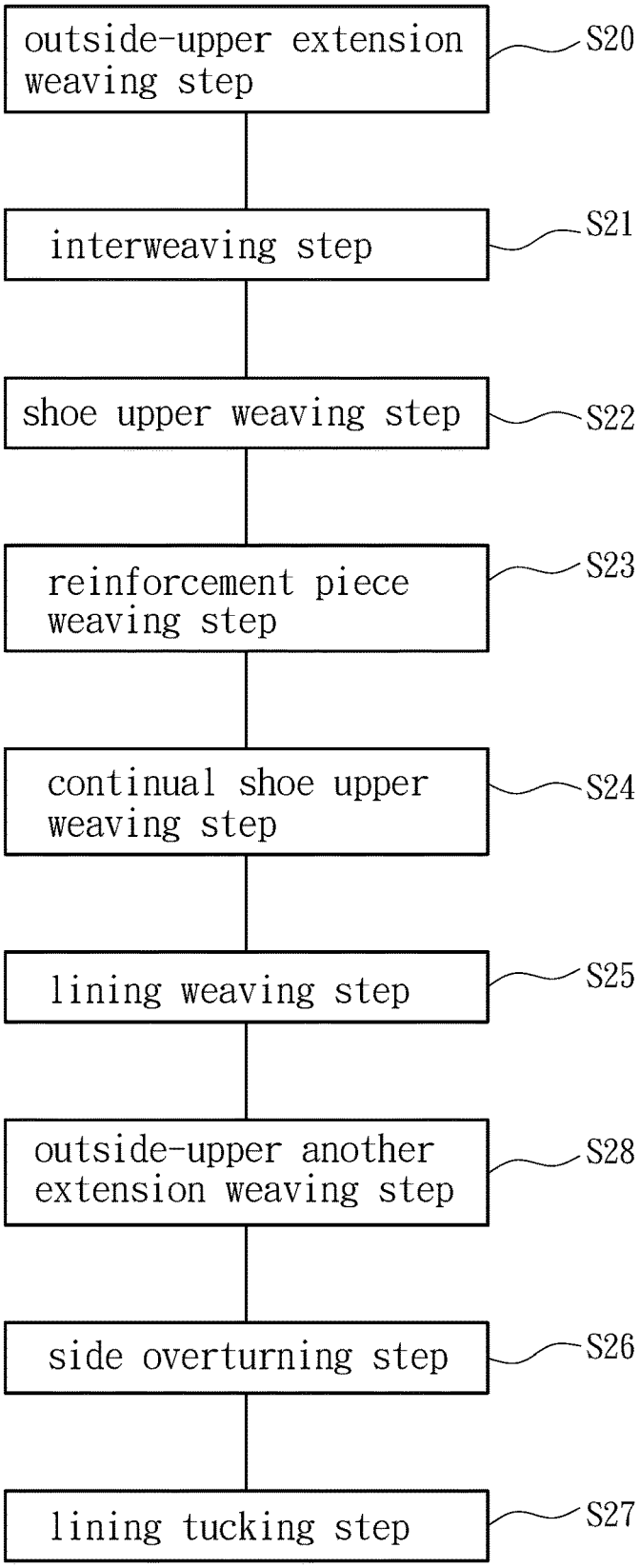
FIG. 27 is a flowchart of steps of a method according to the ninth embodiment of the present invention.
Figure 28A:
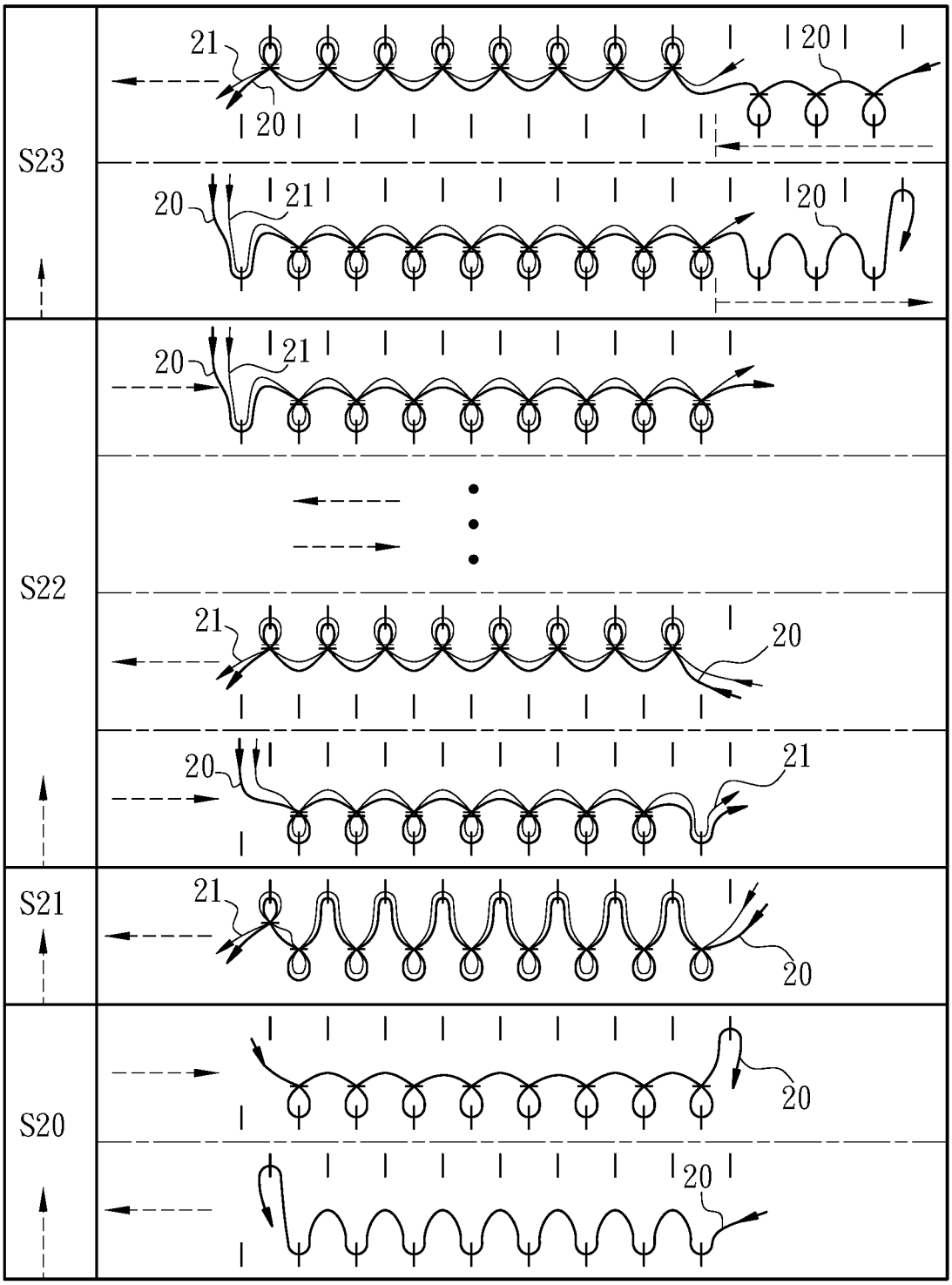
FIG. 28A and FIG. 28B are first and second schematic diagrams of a knitting process according to the ninth embodiment of the present invention.
Figure 28B:
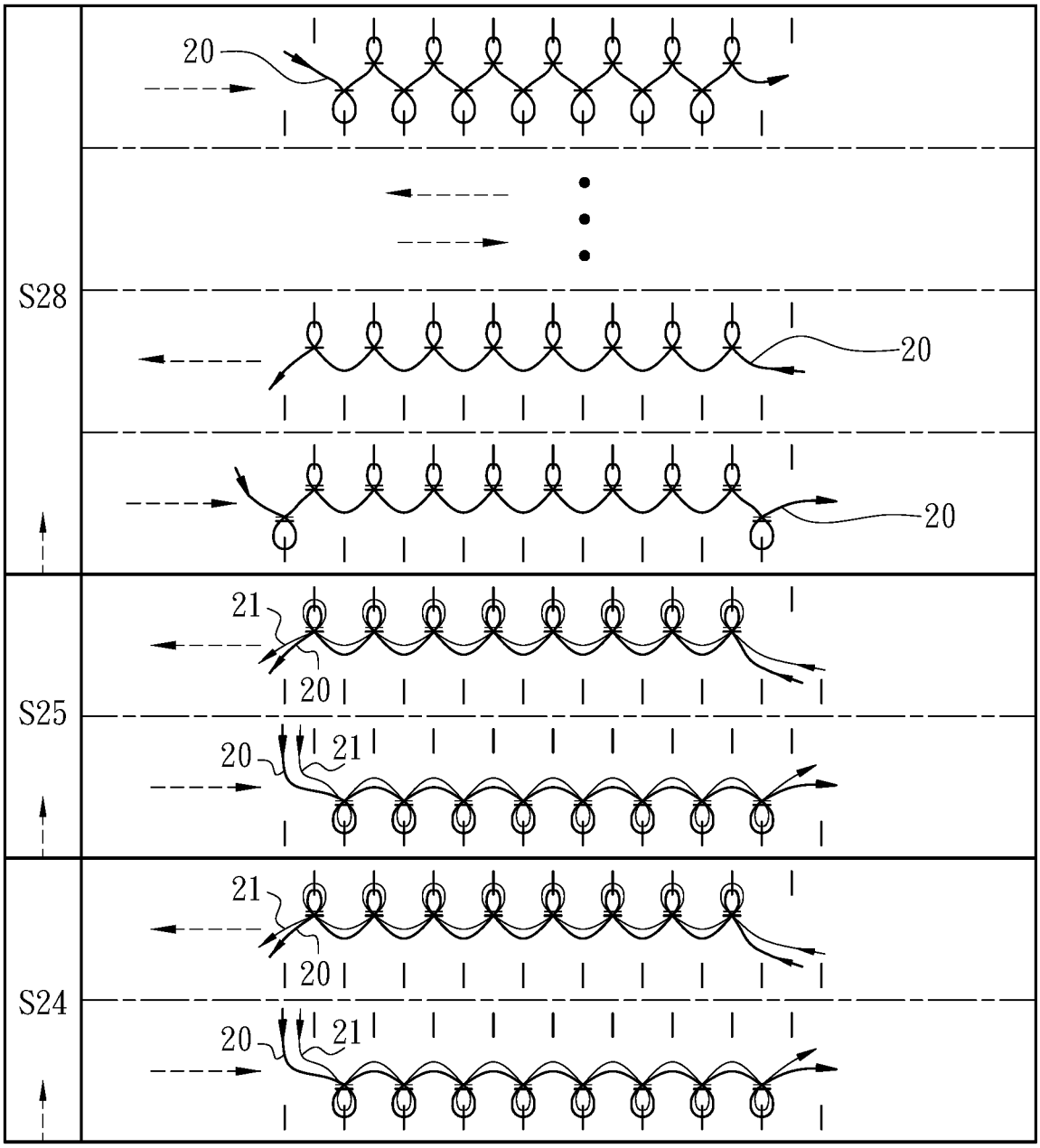
Figure 29A:
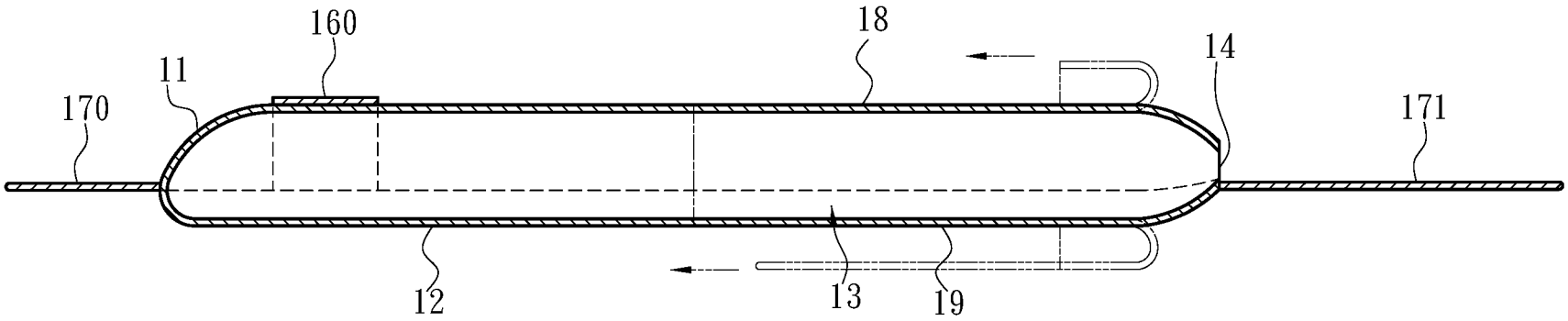
FIG. 29A to FIG. 29E are first to fifth continuous schematic diagrams of a folding and overturning process according to the ninth embodiment of the present invention.
Figure 29B:
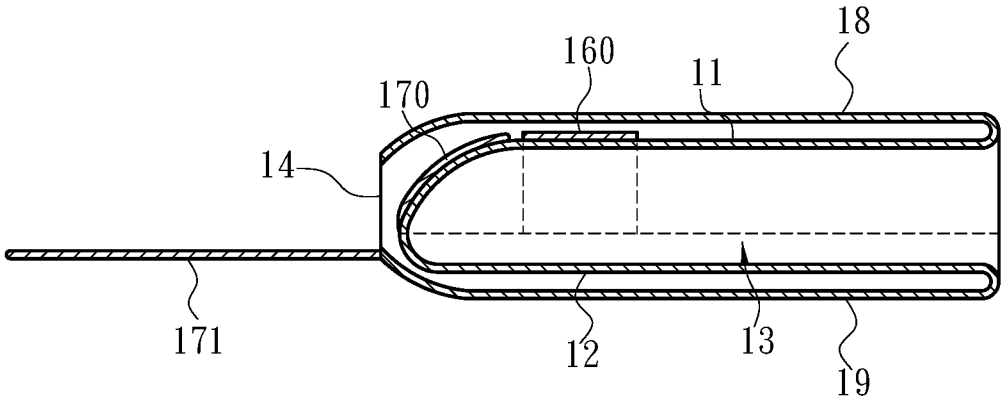
Figure 29C:
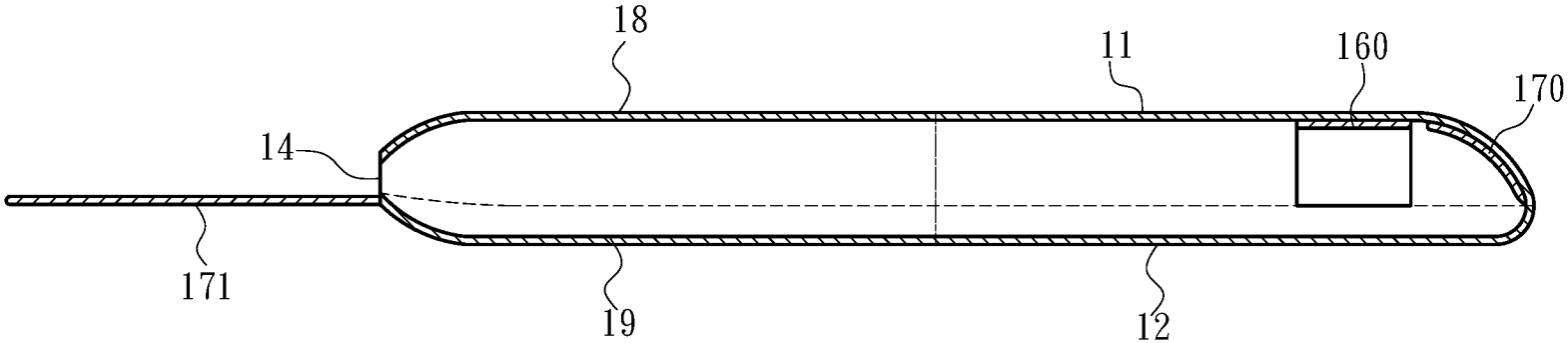
Figure 29D:
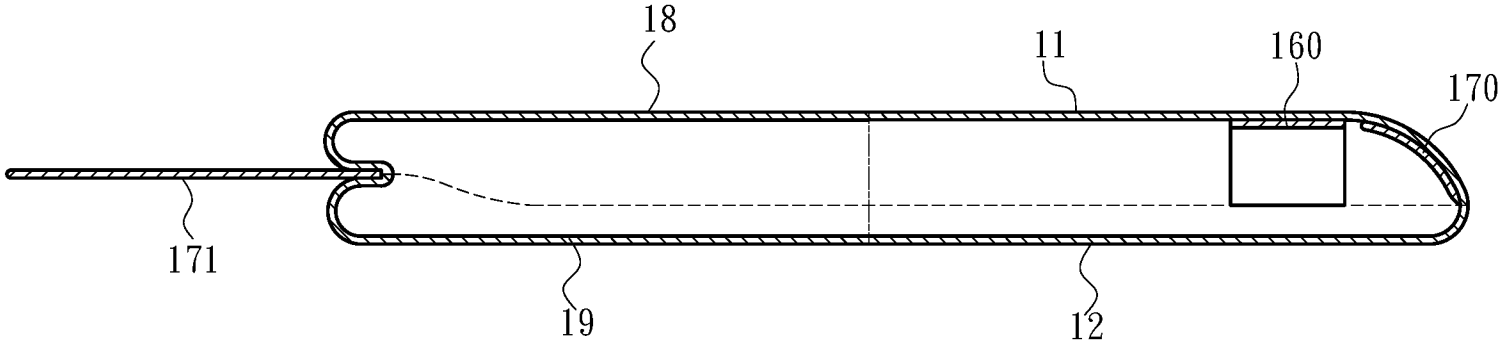
Figure 29E:
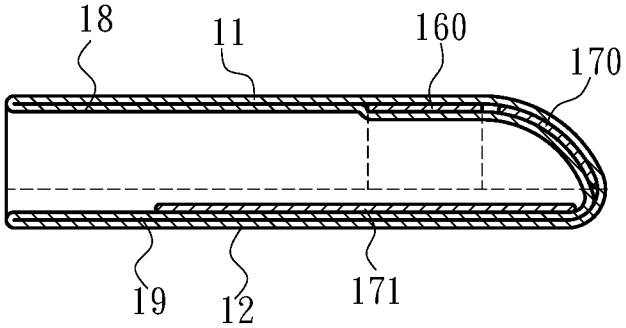
Figure 30:
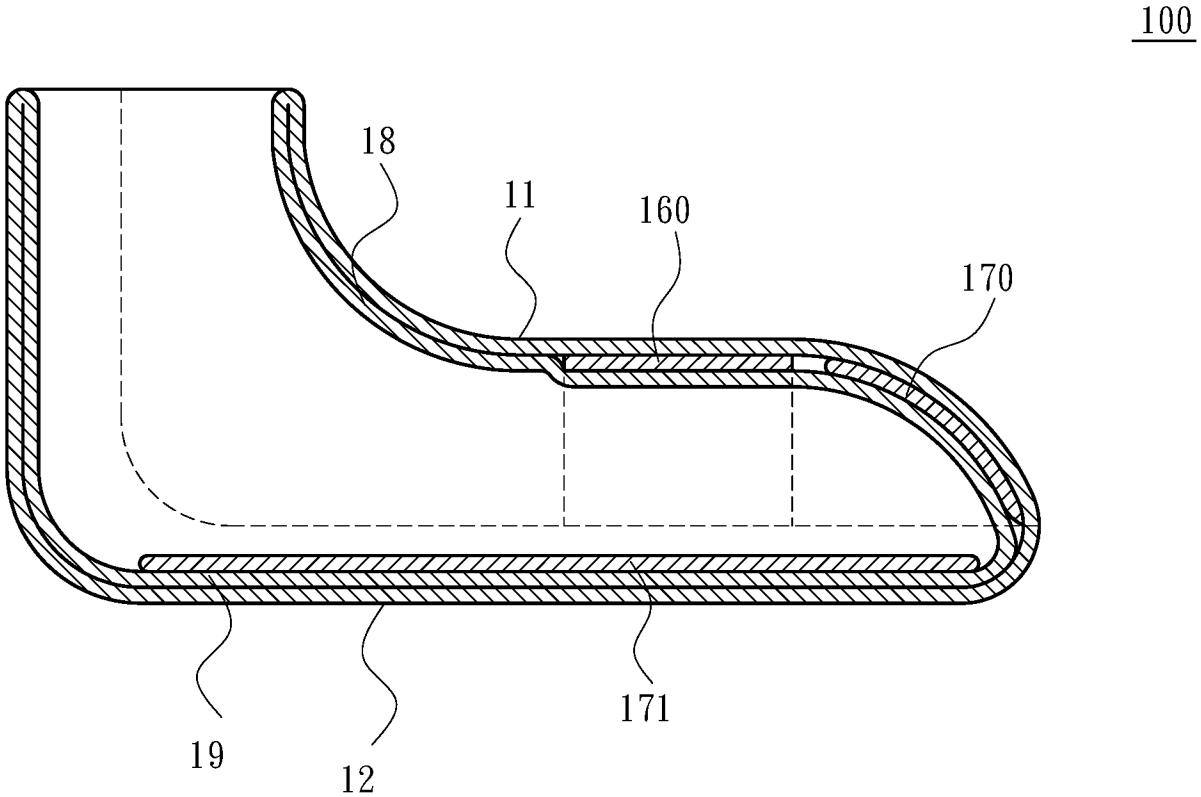
FIG. 30 is a sectional schematic diagram of a knitted shoe prototype according to the ninth embodiment of the present invention.
Figure 31:
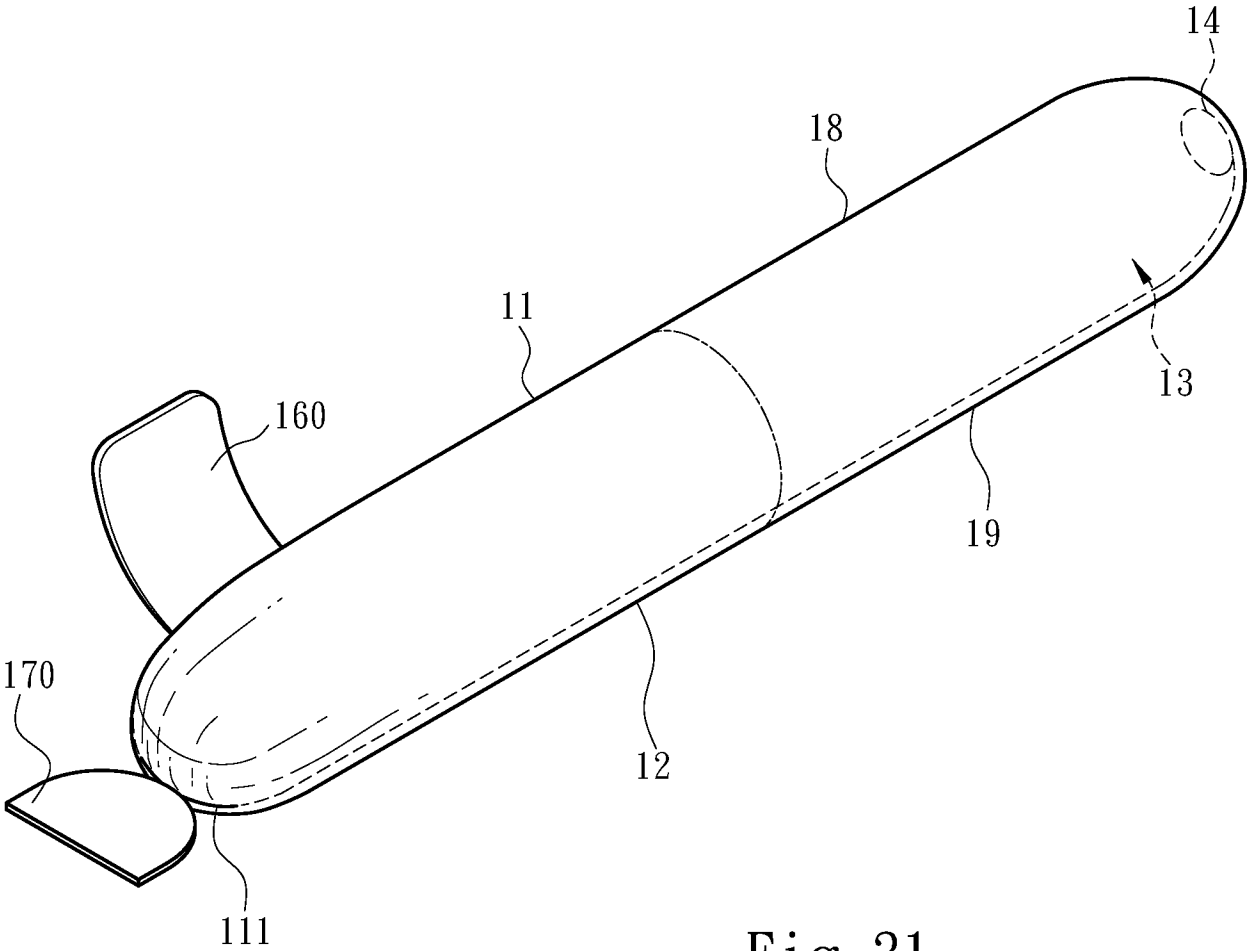
FIG. 31 is a perspective structural schematic diagram of a shoe blank according to a tenth embodiment of the present invention.
Figure 32:
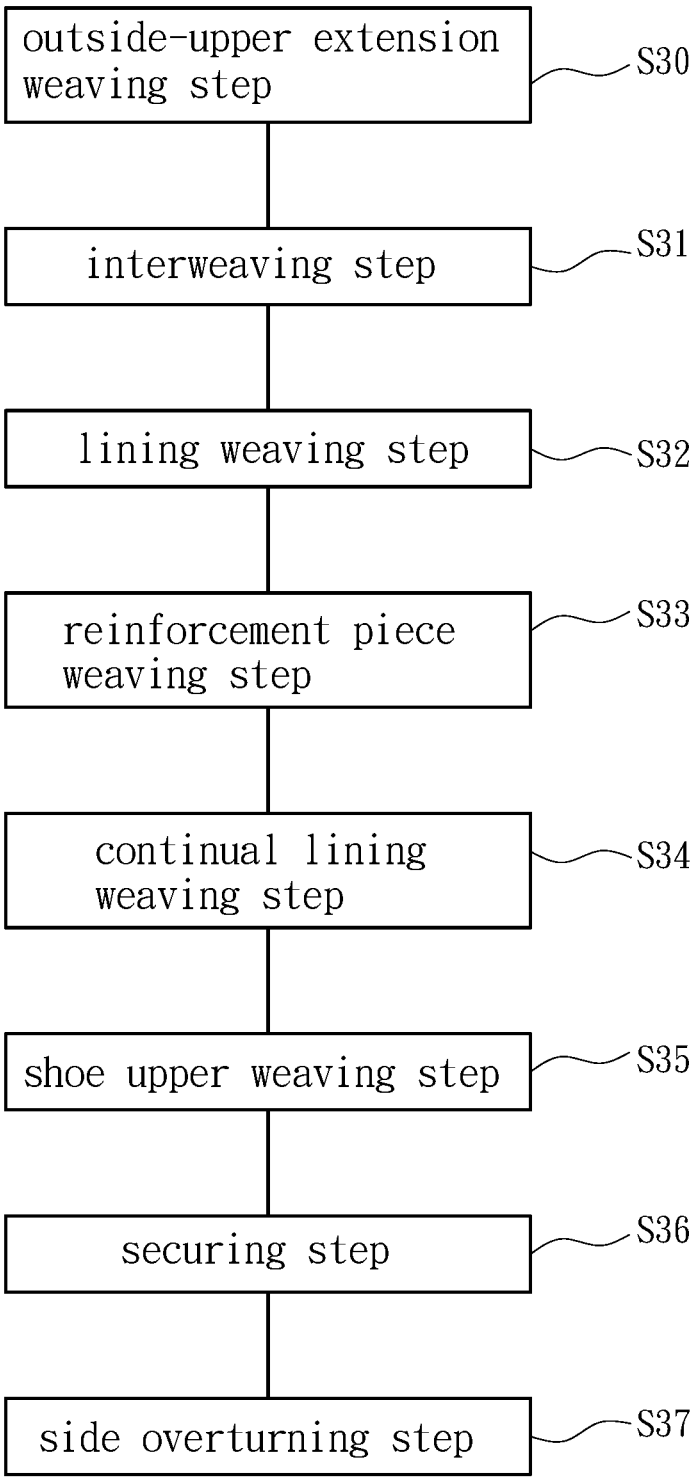
FIG. 32 is a flowchart of steps of a method according to the tenth embodiment of the present invention.
Figure 33A:
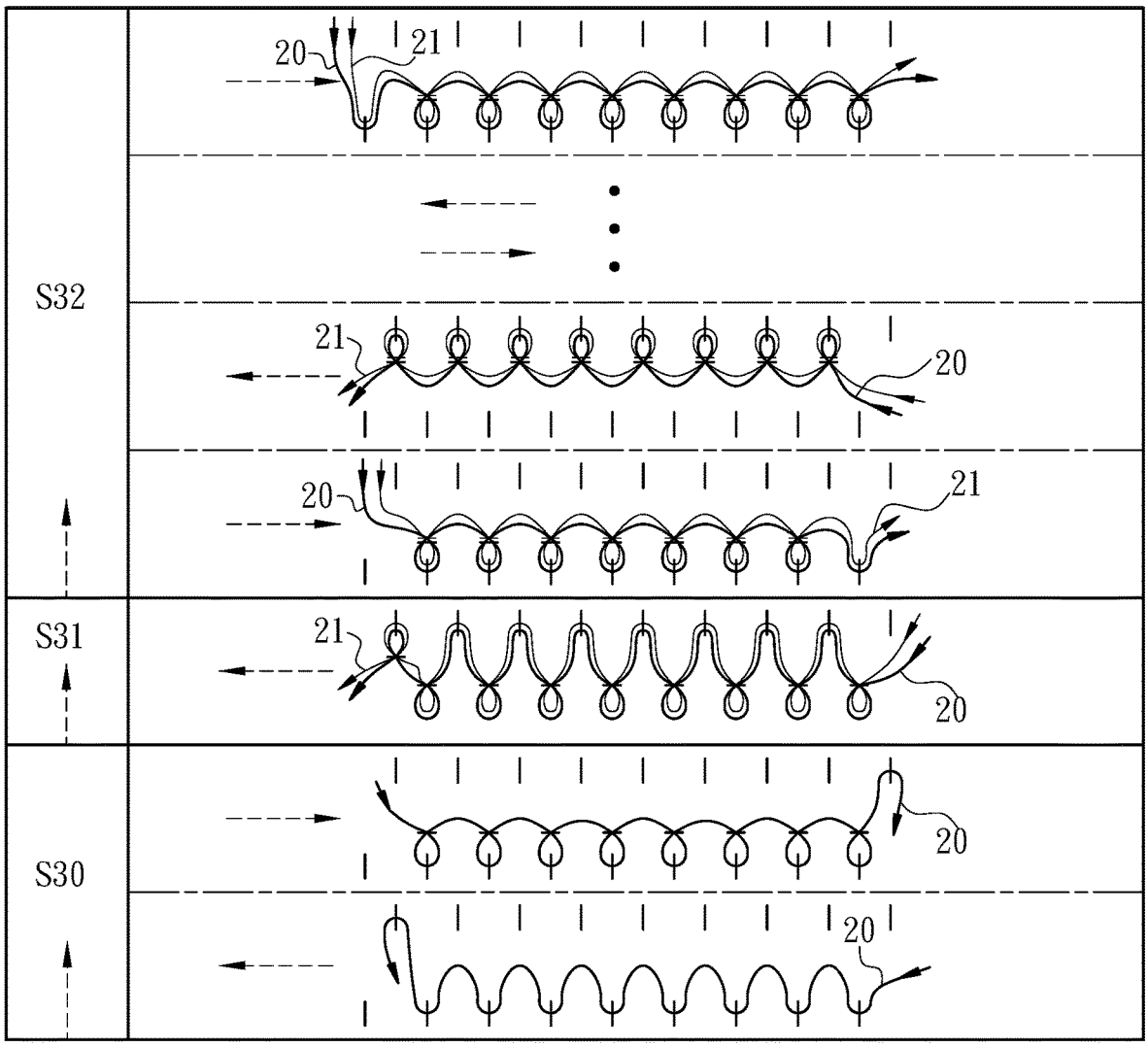
FIG. 33A and FIG. 33B are first and second schematic diagrams of a knitting process according to the tenth embodiment of the present invention.
Figure 33B:
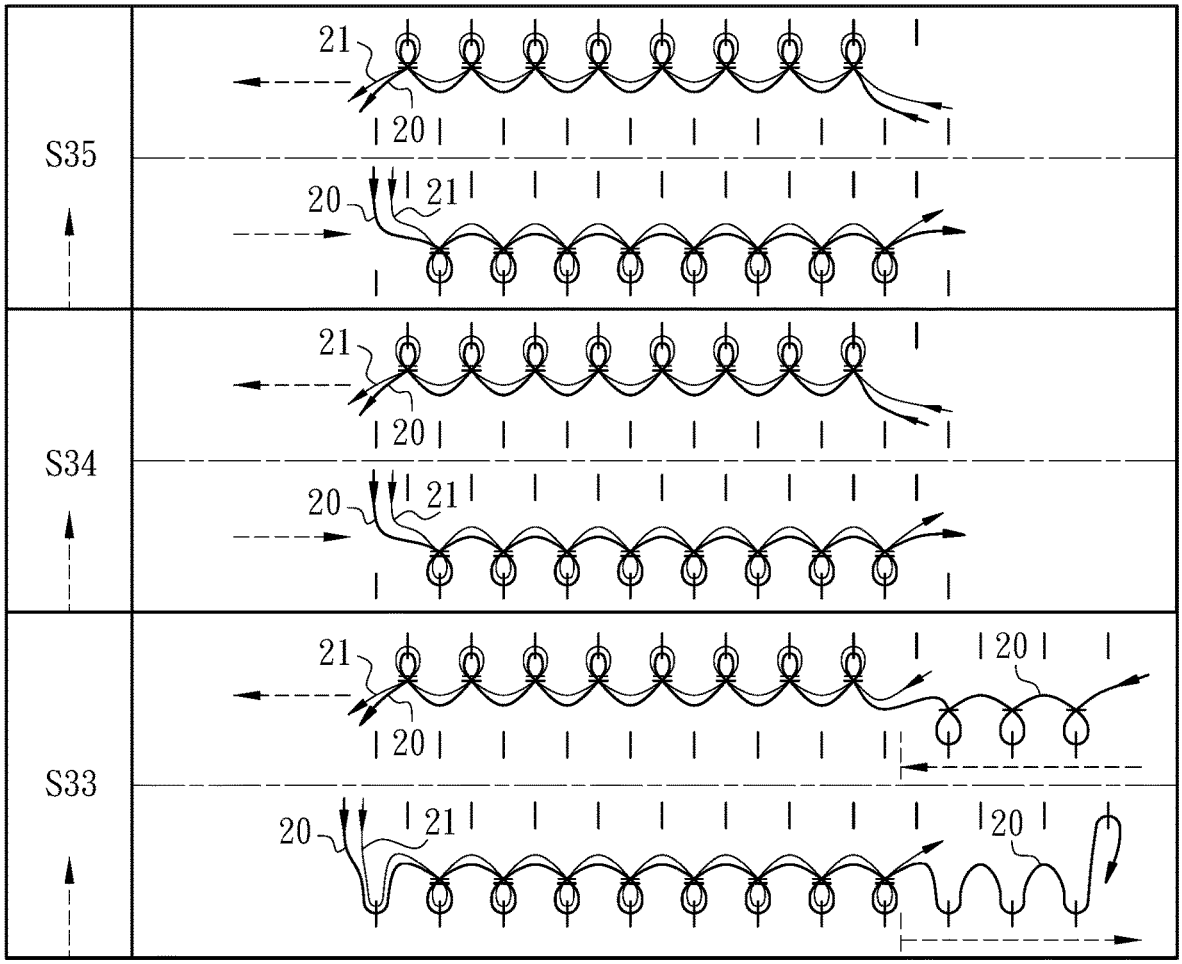
Figure 34A:
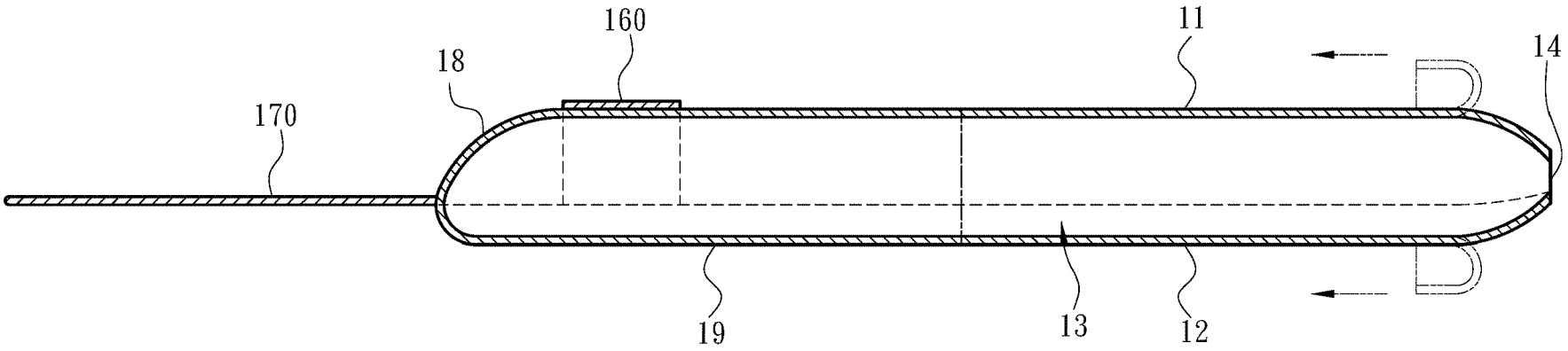
FIG. 34A to FIG. 34D are first to fourth continuous schematic diagrams of a folding and overturning process according to the tenth embodiment of the present invention.
Figure 34B:
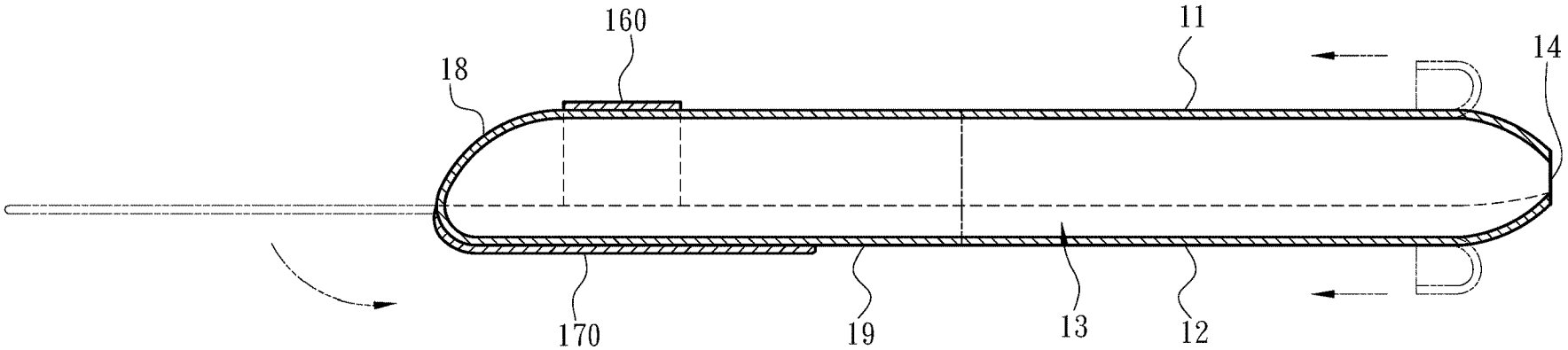
Figure 34C:
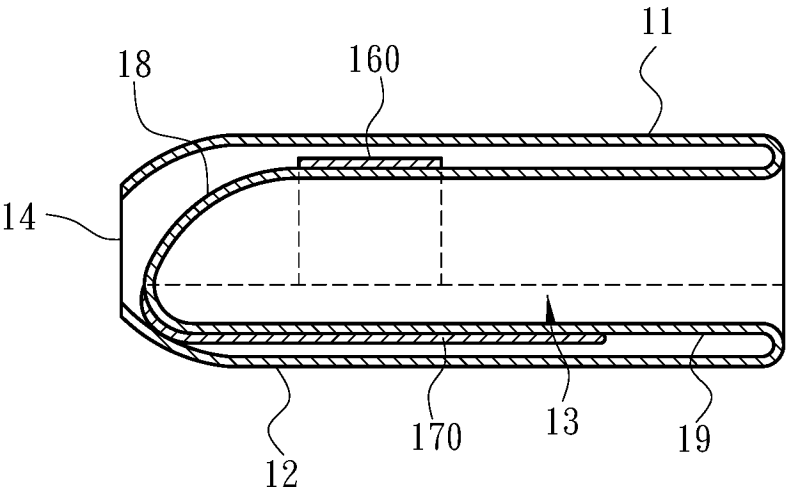
Figure 34D:
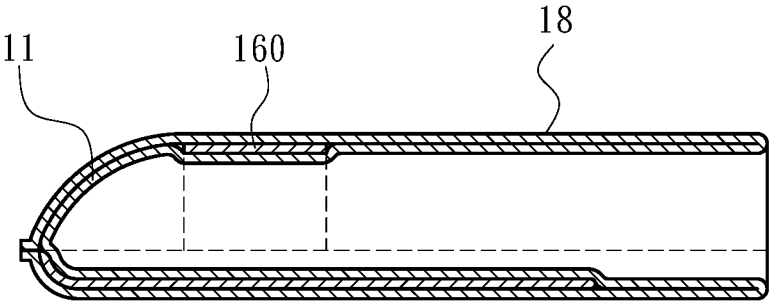

Referring to FIG. 23 to FIG. 25, in this embodiment, the continual shoe upper knitting step S24 further includes a sub-step S241. In the sub-step S241, another reinforcement piece 161 is woven by knitting at least one of the yarns 20 and 21 when the shoe upper stitch count is reached while knitting the first shoe upper 11 or the second shoe upper 12, knitting in a reverse direction is performed when the extension stitch count is reached while knitting the another reinforcement piece 161, and the first shoe upper 11 and the second shoe upper 12 are woven by knitting the at least two yarns 20 and 21 according to the shoe upper stitch count when the extension stitch count is again reached, hence cyclically knitting the another reinforcement piece 161, the first shoe upper 11 and the second shoe upper 12. Further, in the side overturning step S26, the another reinforcement piece 161 is together with the reinforcement piece 160 placed into the in-shoe space 13 defined by the overturned first shoe upper 11 and second shoe upper 12, and together with the reinforcement piece 160 provide the shoe blank 10 with support.

Referring to FIG. 26 to FIG. 30, in one embodiment, after the lining knitting step S25, the method further includes an outside-upper another extension knitting step S28, in which another extension 171 connected to the end of the first lining 18 or the end of the second lining 19 is woven by knitting at least one of the yarns 20 and 21. In the lining tucking step S27, the another extension 171 is together with the first lining 18 and the second lining 19 placed into the in-shoe space 13. The extension 170 and the another extension 171 are respectively the toe support piece disposed at the lower end of the in-shoe space 13 and the sole piece adhered to the second shoe upper 12. More specifically, after the knitting process of the lining knitting step S25 is completed, the flat knitting machine 90 performs unbroken-yarn knitting and weaves the another extension 171 at an edge of the first lining 18 or the second lining 19. The another extension 171 may be formed by single-sided knitting or dual-sided knitting, with associated details referred from the description on the knitting method of the reinforcement piece 160 of the present invention and omitted herein. During the implementation of the side overturning step S26, the another extension 171 is together overturned with the connected first lining 18 or second lining 19. In the lining tucking step S27, the another extension 171 is together with the first lining 18 and the second lining 19 tucked into the in-shoe space 13. At this point, a position for installing the another extension 171 may be adjusted according to actual requirements. The another extension 171 serves as the toe support piece when disposed at a toe section of the shoe blank 10, and serves as the sole piece when stacked on the second lining 19. Further, the knitting length of the extension 170 or the another extension 171 is shorter than the knitting lengths of the first shoe upper 11 and the second shoe upper 12.

Referring to FIG. 31 to FIG. 35, in one embodiment, the method includes following steps.

In an outside-upper extension knitting step S30, the extension 170 is woven by knitting at least one of the yarns 20 and 21.

In an interlacing step S31, the initial shoe edge 111 connected to the extension 170 is woven by knitting the at least two yarns 20 and 21 in an interlaced manner.

In a lining knitting step S32, the first lining 18 connected to the initial shoe edge 111 is woven by knitting the at least two yarns 20 and 21, knitting in a reverse direction is performed when the shoe upper stitch count is reached to weave the second lining 19 that faces the first lining 18 by knitting the two yarns 20 and 21, and the first lining 18 is woven in a reverse direction according to the shoe upper stitch count, hence cyclically knitting the first lining 18 and the second lining 19.

In a reinforcement piece knitting step S33, the reinforcement piece 160 is woven by knitting at least one of the yarns 20 and 21 when the shoe upper stitch count is reached in the lining knitting step S32, knitting in a reverse direction is performed when the extension stitch count is reached while knitting the reinforcement piece 160, and the first lining 18 and the second lining 19 are woven by knitting the at least two yarns 20 and 21 according to the shoe upper stitch count when the extension stitch count is again reached, hence cyclically knitting the reinforcement piece 160, the first lining 18 and the second lining 19.

In a continual lining knitting step S34, the first lining 18 and the second lining 19 are cyclically woven by knitting the two yarns 20 and 21.

In a shoe upper knitting step S35, the first shoe upper 11 connected to the first lining 18 is woven by knitting the at least two yarns 20 and 21, knitting in a reverse direction is performed when the shoe upper stitch count is reached to weave the second shoe upper 12 that faces the first shoe upper 11 and is connected to the second lining 19 by knitting the two yarns 20 and 21, and the first shoe upper 11 is woven in a reverse direction according to the shoe upper stitch count, hence cyclically knitting the first shoe upper 11 and the second shoe upper 12. Further, ends of the first shoe upper 11 and the second shoe upper 12 form the shoe opening 14.

In a securing step S36, the reinforcement piece 160 is secured on the first lining 18, and the extension 170 is folded to come into contact with the first lining 18 or the second lining 19.

In a side overturning step S37, the first shoe upper 11 and the second shoe upper 12 are folded from the shoe opening 14, such that the overturned first shoe upper 11 and second shoe upper 12 clad on the extension 170 and the reinforcement piece 160, and the ends of the first shoe upper 11 and the second shoe upper 12 are connected to complete the shoe blank 10. The extension 170 may be the toe support piece disposed at a toe section 150 of the shoe blank 10 or the sole piece adhered to the second shoe upper 12.

More specifically, referring to FIG. 31 to FIG. 34D, at the beginning of the implementation of the embodiment, the front needle bed 901 and the back needle bed 902 of the flat knitting machine 90 are set to first knit at least one of the yarns 20 and 21 at the beginning of knitting the shoe blank 10 to form the extension 170. After the extension 170 is completely woven, the interlacing step S31 is performed. In the interlacing step S31, the flat knitting machine 90 causes the front needle bed 901 and the back needle bed 902 to knit simultaneously to cause the two yarns 20 and 21 to be interlaced to form the initial shoe edge 111. After the initial shoe edge 111 is completely woven, unbroken-yarn knitting is continued to perform the lining knitting step S32. During the knitting process of the lining knitting step S32, the front needle bed 901 weaves the first lining 18 in an extended manner from an end of one side of the initial shoe edge 111. When the front needle bed 901 reaches the shoe upper stitch count while knitting the first lining 18, the flat knitting machine 90 continues unbroken-yarn knitting and performs yarn feeding in a reverse direction to cause the back needle bed 902 to continue knitting the second lining 19 by knitting the two yarns 20 and 21. After that, each time the front needle bed 901 or the back needle bed 902 reaches the shoe upper stitch count during the knitting process, the flat knitting machine 90 performs knitting in a reverse direction, hence cyclically knitting the first lining 18 and the second lining 19 The reinforcement piece knitting step S33 is then performed. At the beginning of the reinforcement piece knitting step S33, the flat knitting machine 90 is at the knitting ending point of the first lining 18 or the second lining 19, the yarn feeding mechanism 903 is controlled to progress in a non-reversed direction, and the flat knitting machine 90 weaves the reinforcement piece 160 along the current knitting direction by knitting the at least one of the yarns 20 and 21. During the process of knitting the reinforcement piece 160, the flat knitting machine 90 controls the nose to progress in a non-reversed direction and weaves reinforcement piece 160 by the front needle bed 901, such that the woven reinforcement piece 160 protrudes from edges of the first shoe upper 11 and the second shoe upper 12. Further, when the front needle bed 901 reaches the extension stitch count while knitting the reinforcement piece 160, the flat knitting machine 90 continues knitting the reinforcement piece 160 in a reverse direction, and then causes the front needle bed 901 and the back needle bed 902 to continue knitting the first lining 18 and the second lining 19 by knitting the two yarns 20 and 21 when the extension stitch count is again reached. The knitting process of the first lining 18 and the second lining 19 is as described in the lining knitting step S32, and shall be omitted herein. Further, the extension stitch count is greater than the shoe upper stitch count.

The continual lining knitting step S34 is performed after the reinforcement piece knitting step S33 is completed, and is similar to the lining knitting step S32. In the continual lining knitting step S34, the front needle bed 901 and the back needle bed 902 continue knitting from the knitting ending point of the reinforcement piece knitting step S33 to weave the first lining 18 and the second lining 19. The shoe upper knitting step S35 is performed after the continual lining knitting step S34 is completed. The knitting starting point of the shoe upper knitting step S35 is an end of the first lining 18 or the second lining 19, e.g., an intersection of the first lining 18 and the second lining 19. The flat knitting machine 90 causes the back needle bed 902 to weave the second shoe upper 12 connected to the second lining 19 by knitting the two yarns 20 and 21. When the back needle bed 902 reaches the shoe upper stitch count while knitting the second shoe upper 12, the flat knitting machine 90 performs unbroken-yarn knitting and causes the yarn feeding mechanism 903 to perform yarn feeding in a reverse direction to weave the first shoe upper 11 connected to the first lining 18 by the front needle bed 901, hence cyclically knitting the first shoe upper 11 and the second shoe upper 12 in an unbroken-yarn manner to complete the knitting process. Further, although the knitting process of the first shoe upper 11 is given as an example in this embodiment, the knitting sequences of the first shoe upper 11 and the second shoe upper 12 may be modified according to knitting scheduling settings in practice. Further, the knitting lengths of the first lining 18 and the second lining 19 may be similar to those of the first shoe upper 11 and the second shoe upper 12.

In continuation, the securing step S36 is performed after the shoe upper knitting S35, and may be completed through a machine or a human operation without involving the flat knitting machine 90. At the beginning of the implementation of the securing step S36, the reinforcement piece 160 is secured on the first lining 18, and the extension 170 is folded to come into contact with the first lining 18 or the second lining 19 according to a set function of the extension 170. Further, the extension 170 serves as a toe decoration piece when in contact with the first lining 18, or serves as the sole piece when in contact with the second lining 19. Further, during the knitting process of the present invention, at least one additional part having an identical pattern as the extension 170 may be woven in continuation from the extension 170. The additional part and the extension may be stacked to increase the structural strength provided by the extension 170.

The side overturning step S37 is performed after the securing step S36 is completed. During the implementation of the side overturning step S37, ends of the first shoe upper 11 and the second shoe upper 12 are held firmly and are folded from the shoe opening 14, such that the overturned first shoe upper 11 and second shoe upper 12 clad on the extension 170 and the reinforcement piece 160. Further, in the side overturning step S37, side overturning of the first shoe upper 11 stops at a connecting position of the first shoe upper 11 and the first lining 18, and side overturning of the second shoe upper 12 stops at a connecting position of the second shoe upper 12 and the second lining 19. Further, when the first shoe upper 11 and the second shoe upper 12 reach a predetermined folding level, the ends of the first shoe upper 11 and the second shoe upper 12 are connected to complete the shoe blank 10.

Figure 35:
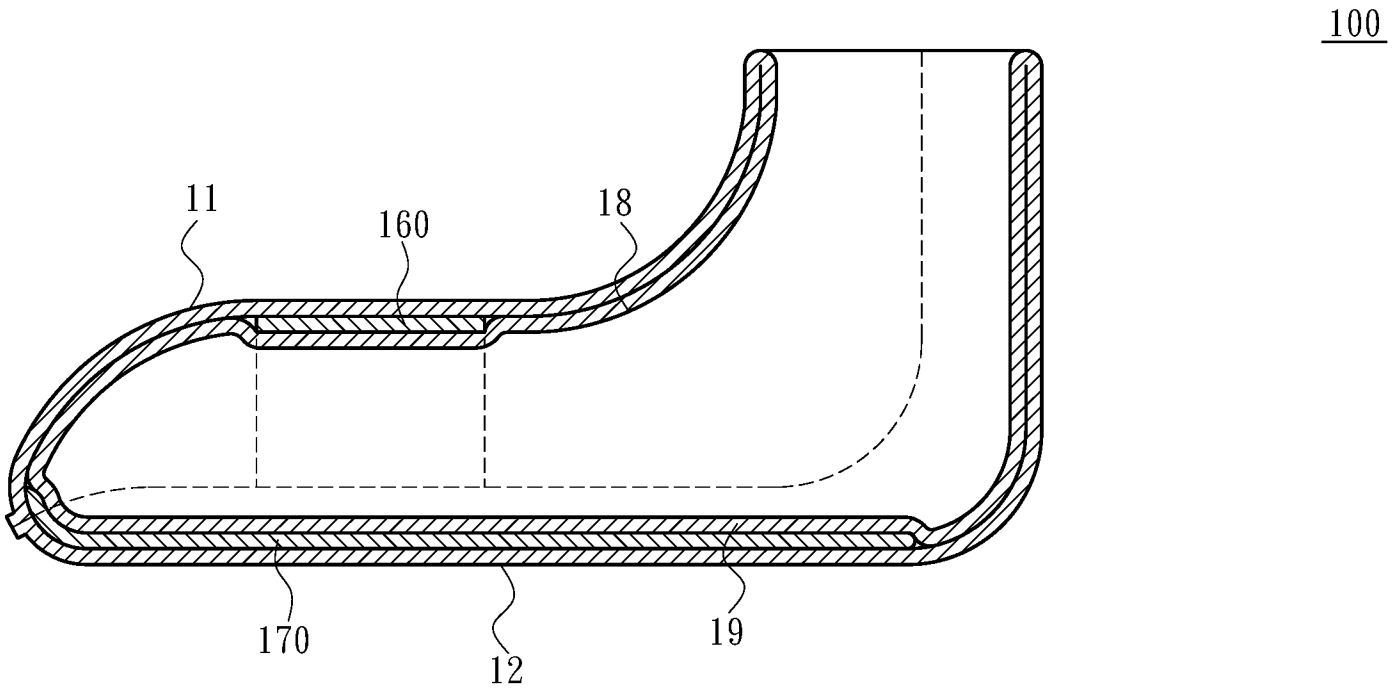
FIG. 35 is a sectional schematic diagram of a knitted shoe prototype according to the tenth embodiment of the present invention.

Further, in the embodiment, the two yarns 20 and 21 forming the shoe blank 10 may be in different colors, which present different colors at inner and outer surfaces of the first shoe upper 11 and the second shoe upper 12. In other words, when the two yarns 20 and 21 are in different colors, a technical front color of a fabric and a technical back color of the fabric are different. Further, one of the two yarns 20 and 21 may be clad by a hot melt layer. Thus, when the shoe blank 10 is completed, it may be placed into a mold and be appropriately heated to allow the yarn 20 (or 21) clad with the hot melt layer to melt, and the shoe blank 10 may then shape according to an appearance of the mold to complete a knitted shoe prototype 100, as shown in FIG. 35. Further, the two yarns 20 and 21 of the present invention may be intertwined from twisting.

Accordingly, after the shoe blank 10 of the embodiment is manufactured, the reinforcement piece 160 and the extension 170 are clamped among the first shoe upper 11, the second shoe upper 12, the first lining 18 and the second lining 19. Thus, the reinforcement piece 160 and the extension 170 cannot be directly contacted in the in-shoe space 13, so as to prevent direct damages of the reinforcement piece 160 and the extension 170 caused by wearing. Further, by performing an appropriate processing on the shoe blank 10, e.g., a heating process or a paint spray process, the knitted shoe prototype 100 may be completed, as shown in FIG. 35.

Figure 36:
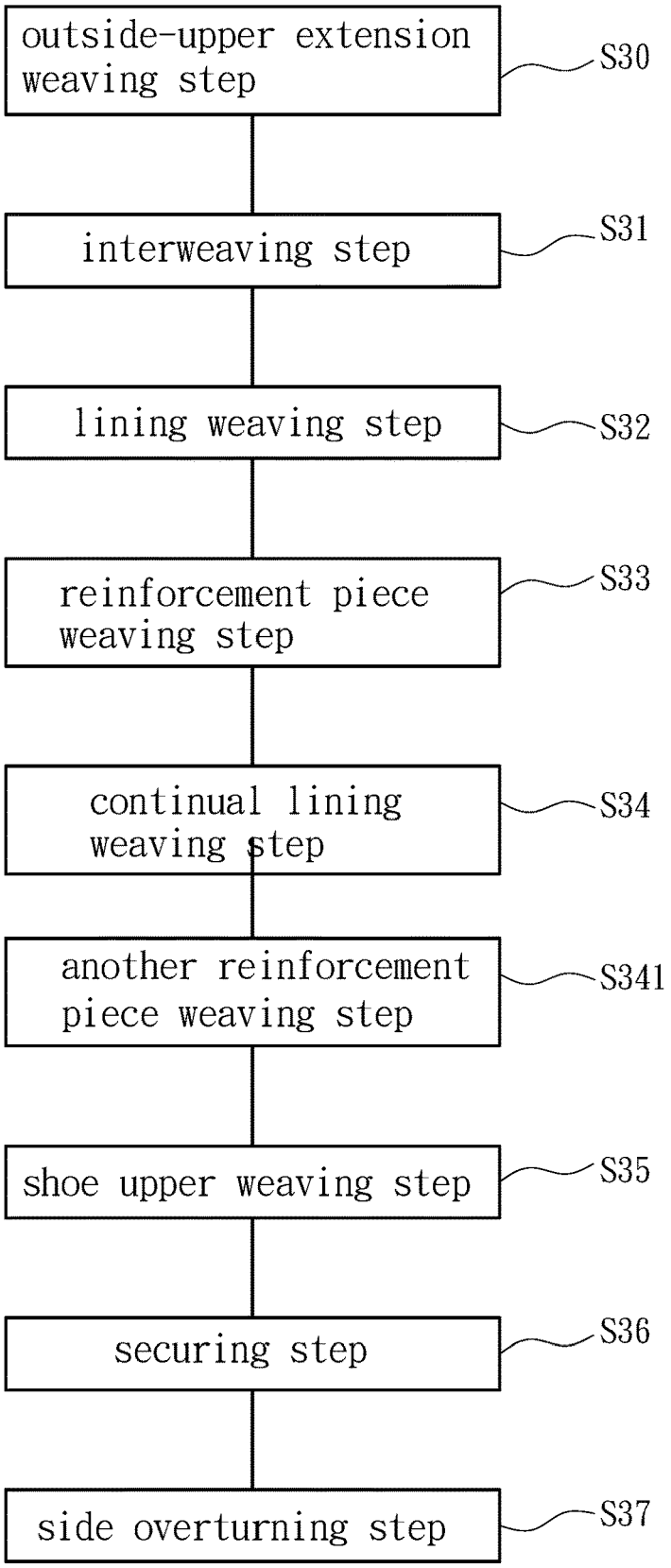
FIG. 36 is a flowchart of steps of a method according to an eleventh embodiment of the present invention.
Figure 37A:
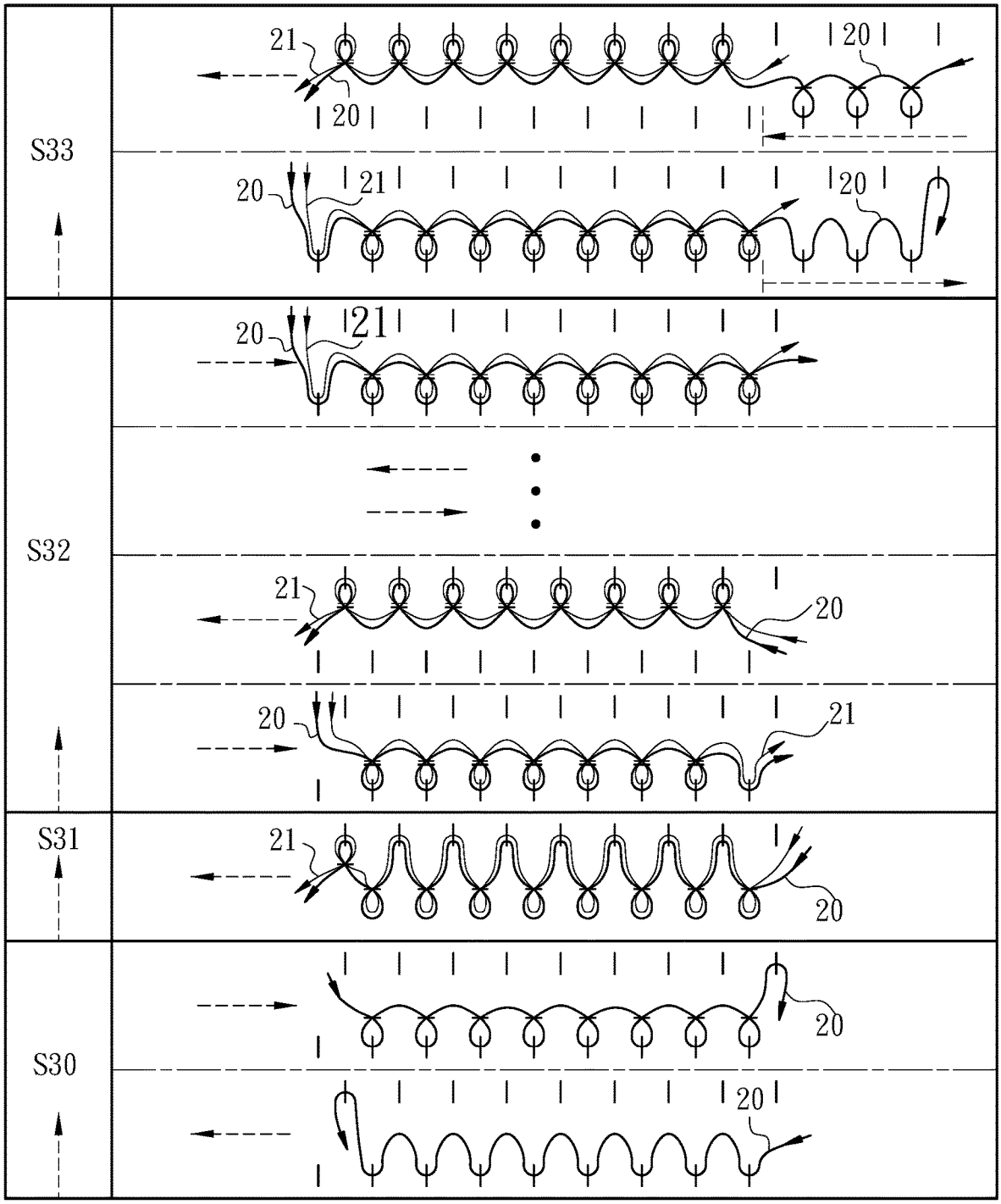
FIG. 37A and FIG. 37B are first and second schematic diagrams of a knitting process according to the eleventh embodiment of the present invention.
Figure 37B:
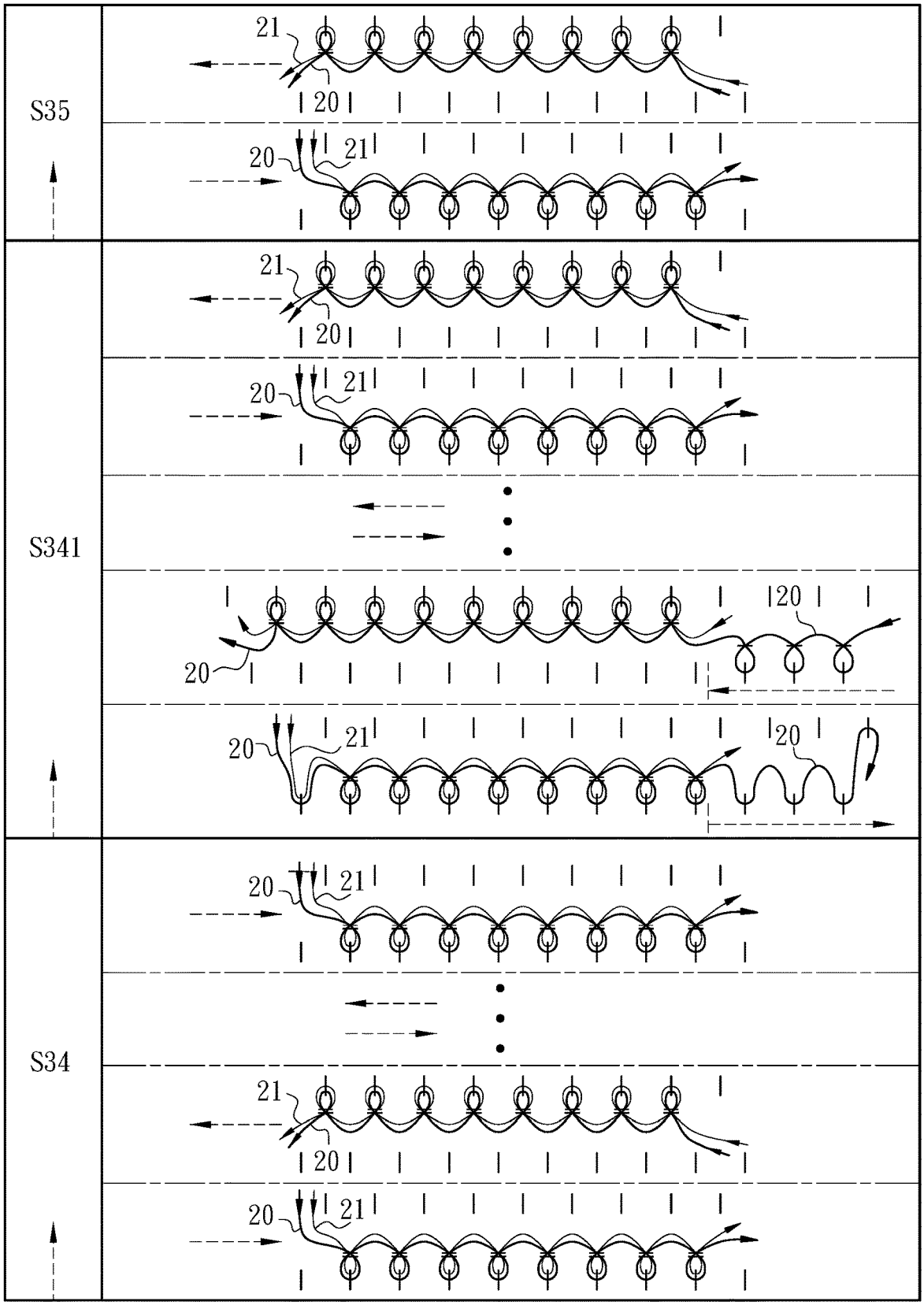
Figure 38:
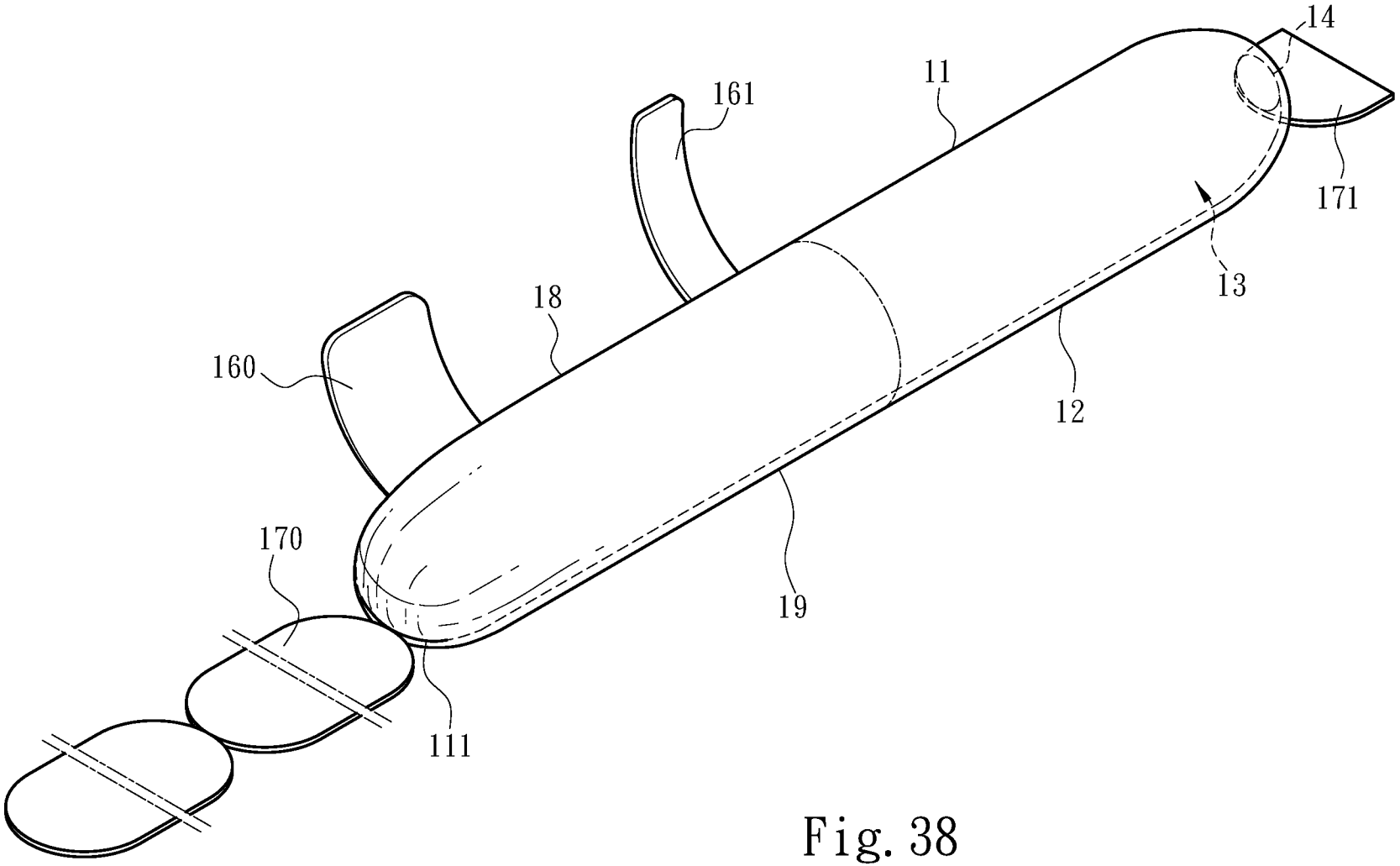
FIG. 38 is a perspective structural schematic diagram of a shoe blank according to the eleventh embodiment of the present invention.
Figure 39:
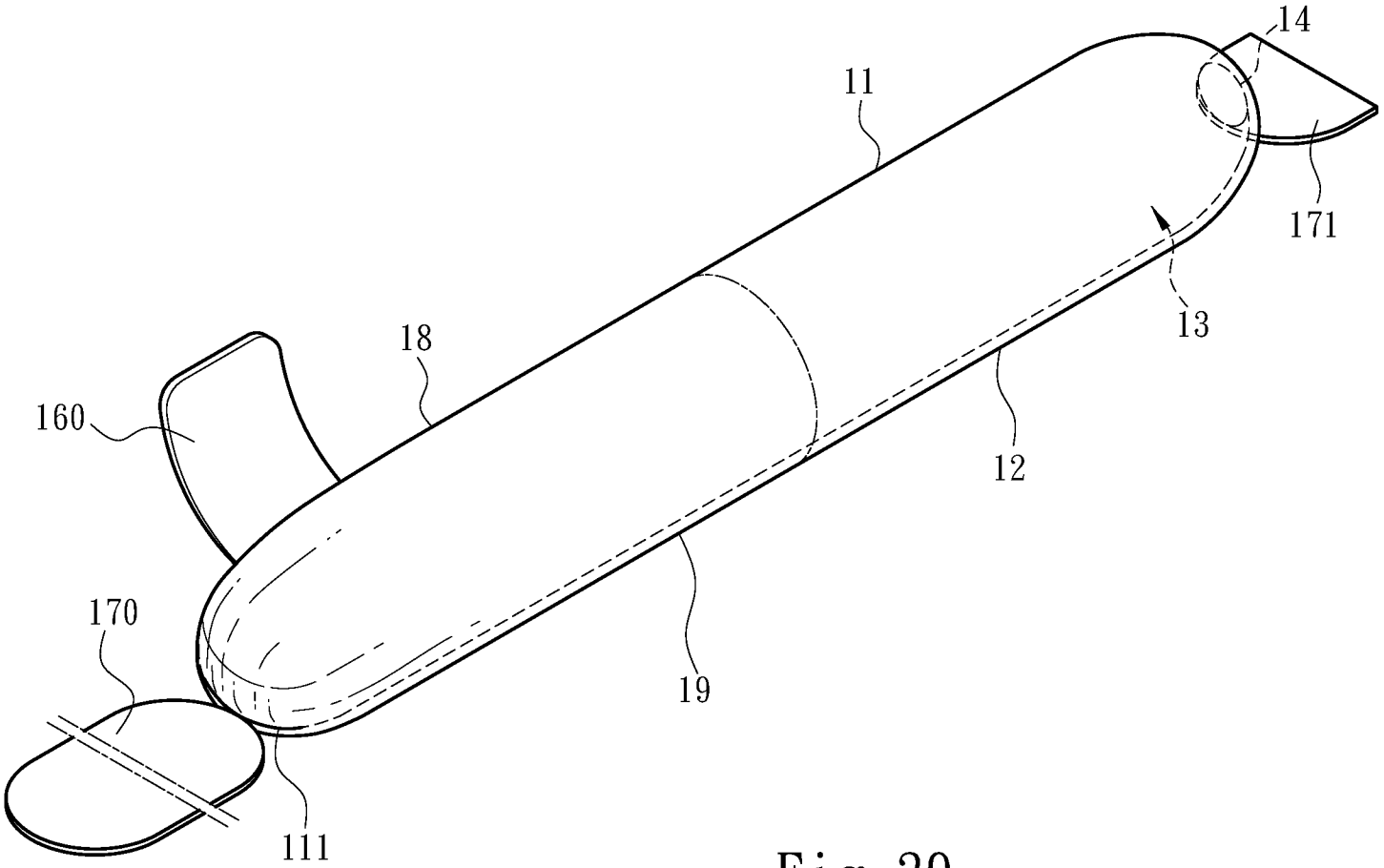
FIG. 39 is a perspective structural schematic diagram of a shoe blank according to a twelfth embodiment of the present invention.
Figure 40:
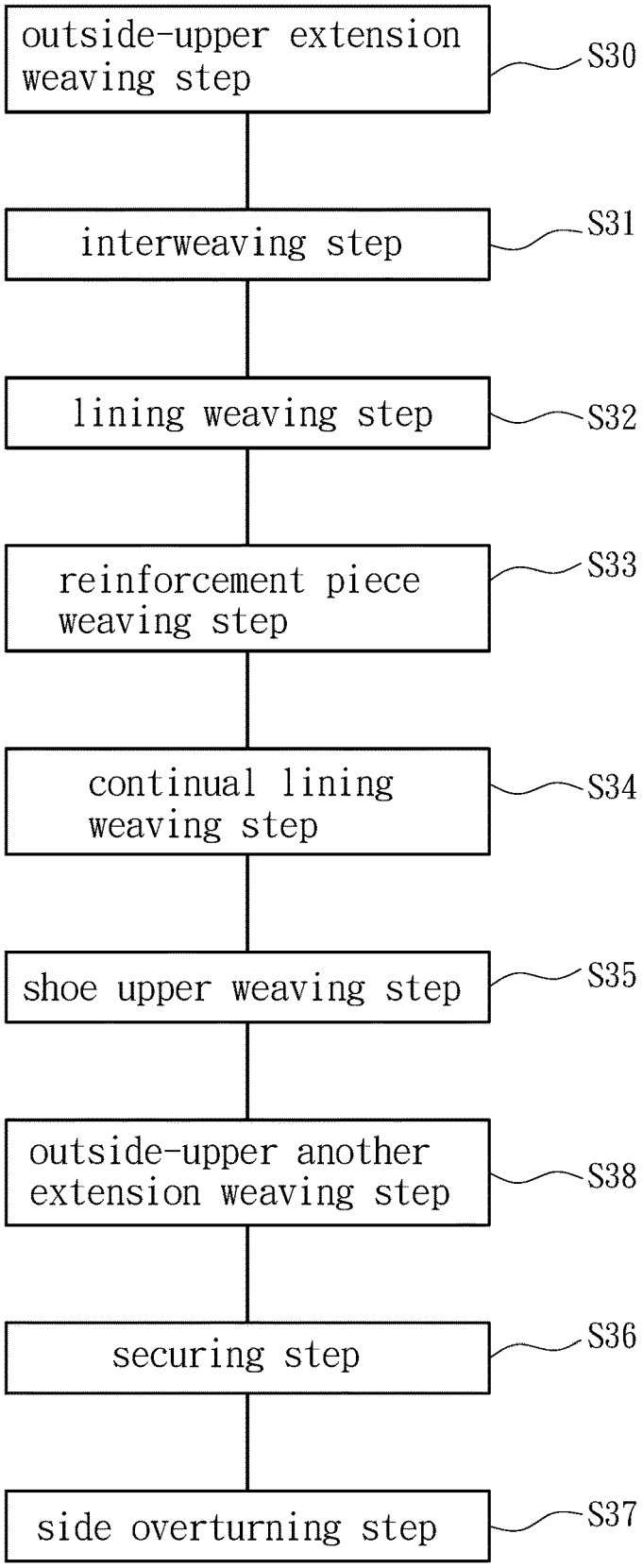
FIG. 40 is a flowchart of steps of a method according to the twelfth embodiment of the present invention.
Figure 41A:
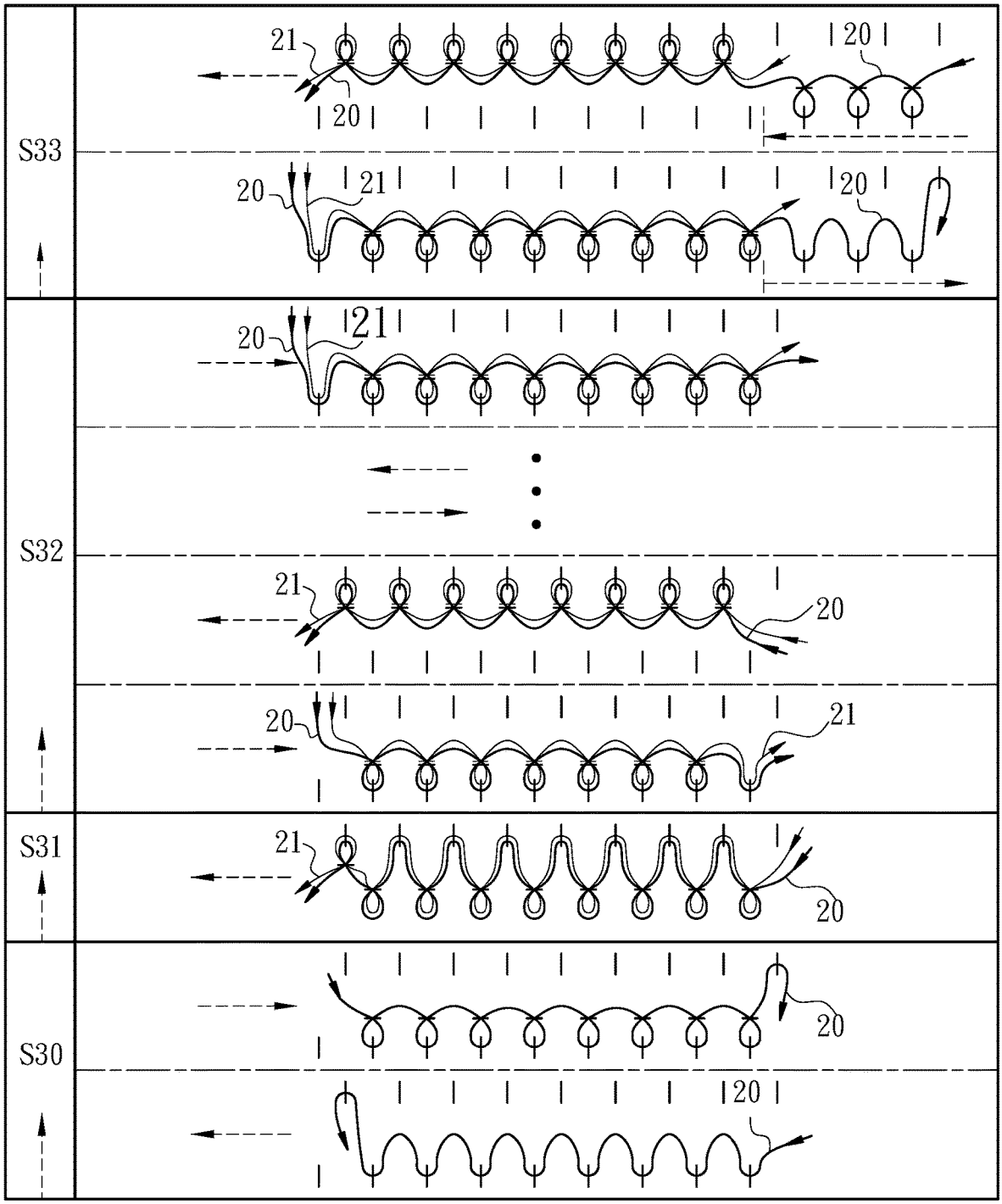
FIG. 41A and FIG. 41B are first and second schematic diagrams of a knitting process according to the twelfth embodiment of the present invention.
Figure 41B:
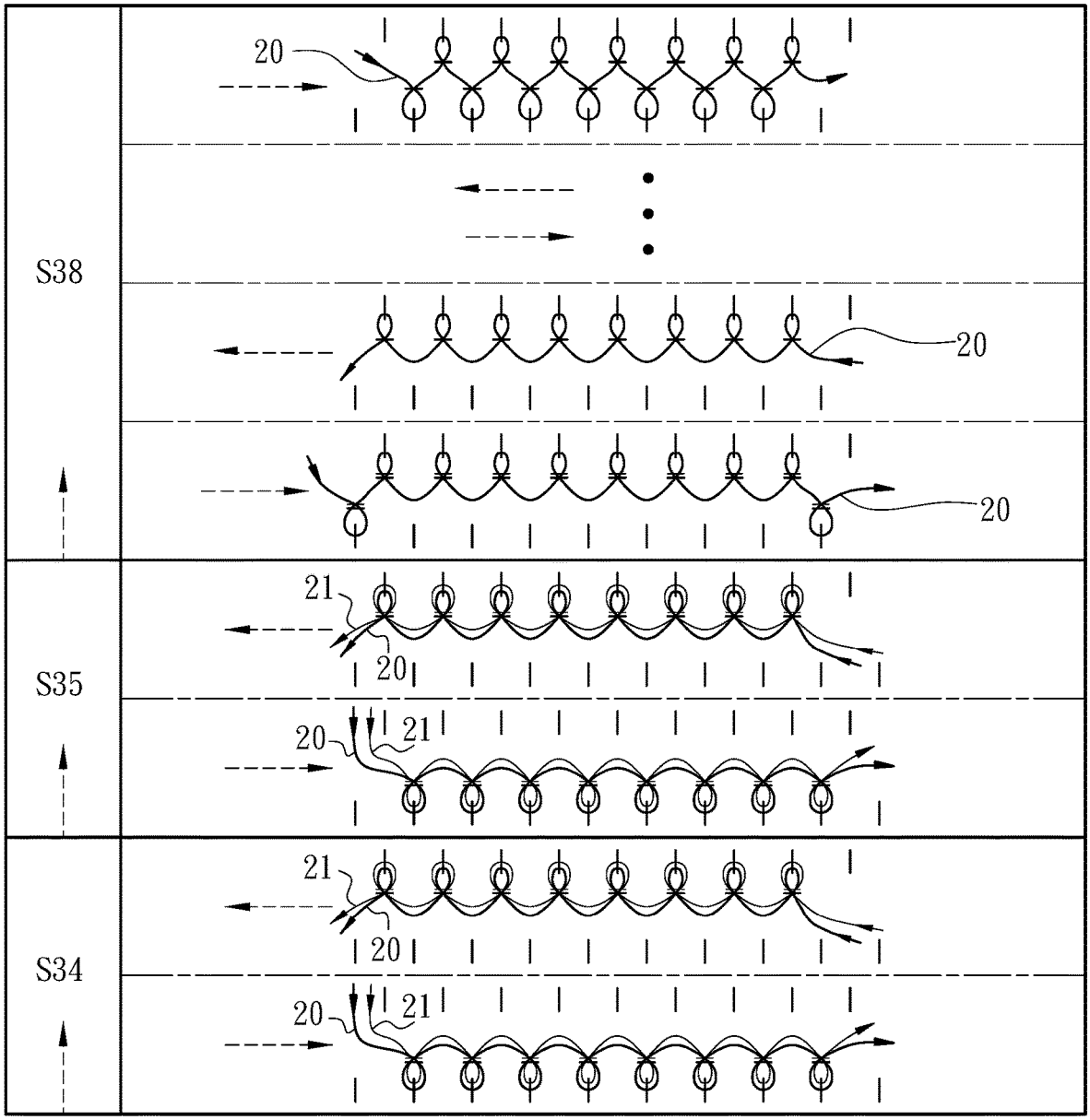
Figure 42A:
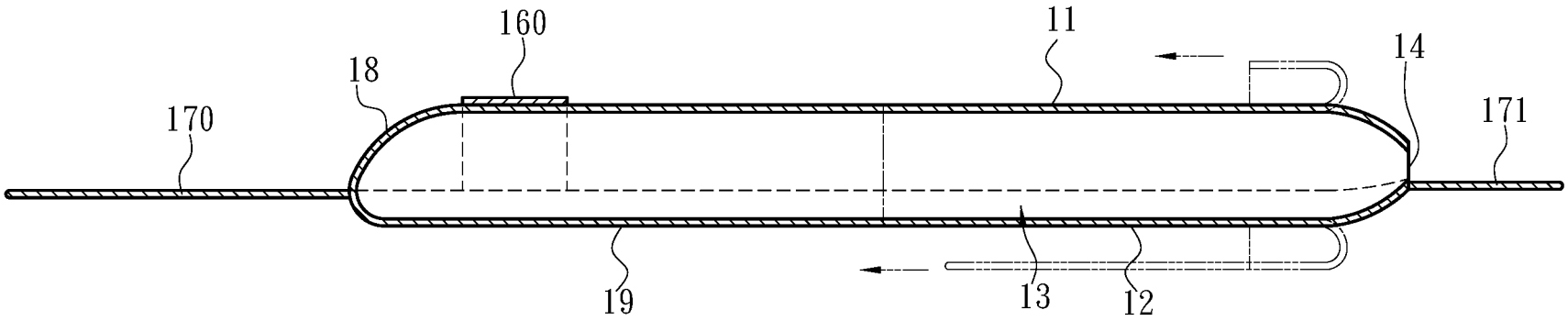
FIG. 42A to FIG. 42D continuous schematic diagrams of a folding and overturning process according to the twelfth embodiment of the present invention.
Figure 42B:
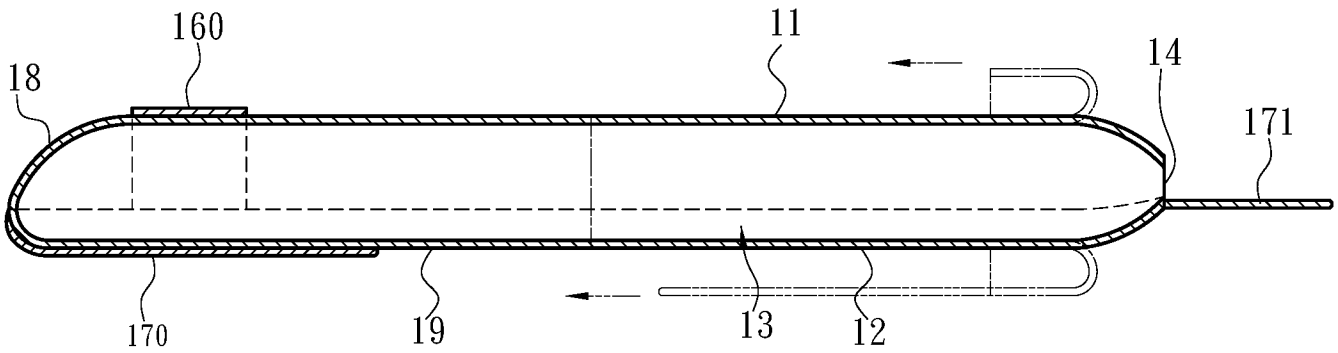
Figure 42C:
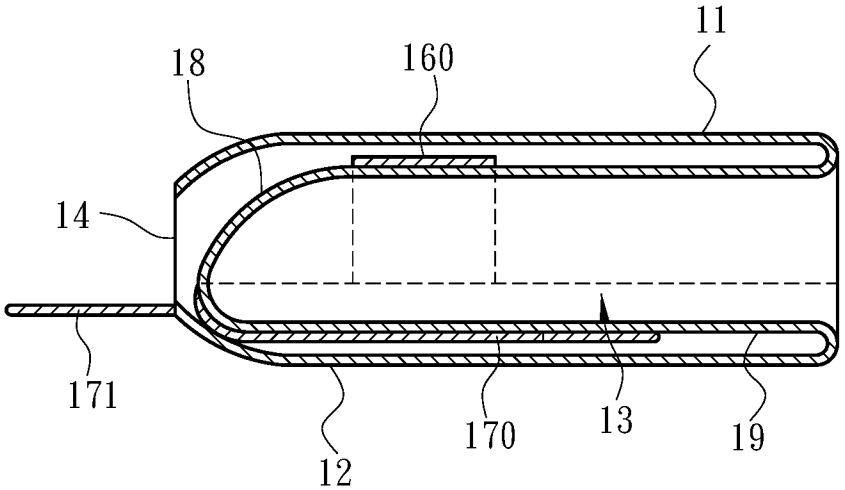
Figure 42D:
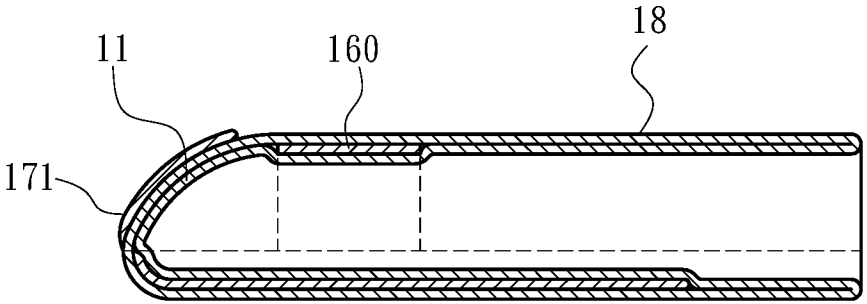

Referring to FIG. 36 to FIG. 38, in the embodiment, the continual lining knitting step S34 further includes a sub-step S341. In the sub-step S341, another reinforcement piece 161 is woven by knitting at least one of the yarns 20 and 21 when the shoe upper stitch count is reached while knitting the first shoe upper 11 or the second shoe upper 12, knitting in a reverse direction is performed when the extension stitch count is reached while knitting the another reinforcement piece 161, and the first shoe upper 11 and the second shoe upper 12 are woven by knitting the at least two yarns 20 and 21 according to the shoe upper stitch count when the extension stitch count is again reached, hence cyclically knitting the another reinforcement piece 161, the first shoe upper 11 and the second shoe upper 12. Further, in the securing step S36, the another reinforcement piece 161 and the reinforcement piece 160 are simultaneously secured on the first lining 18. In the side overturning step S37, the another reinforcement piece 161 is together with the reinforcement piece 160 clad by the first shoe upper 11. Thus, the structural strength of the shoe blank 10 is increased.

Figure 43:
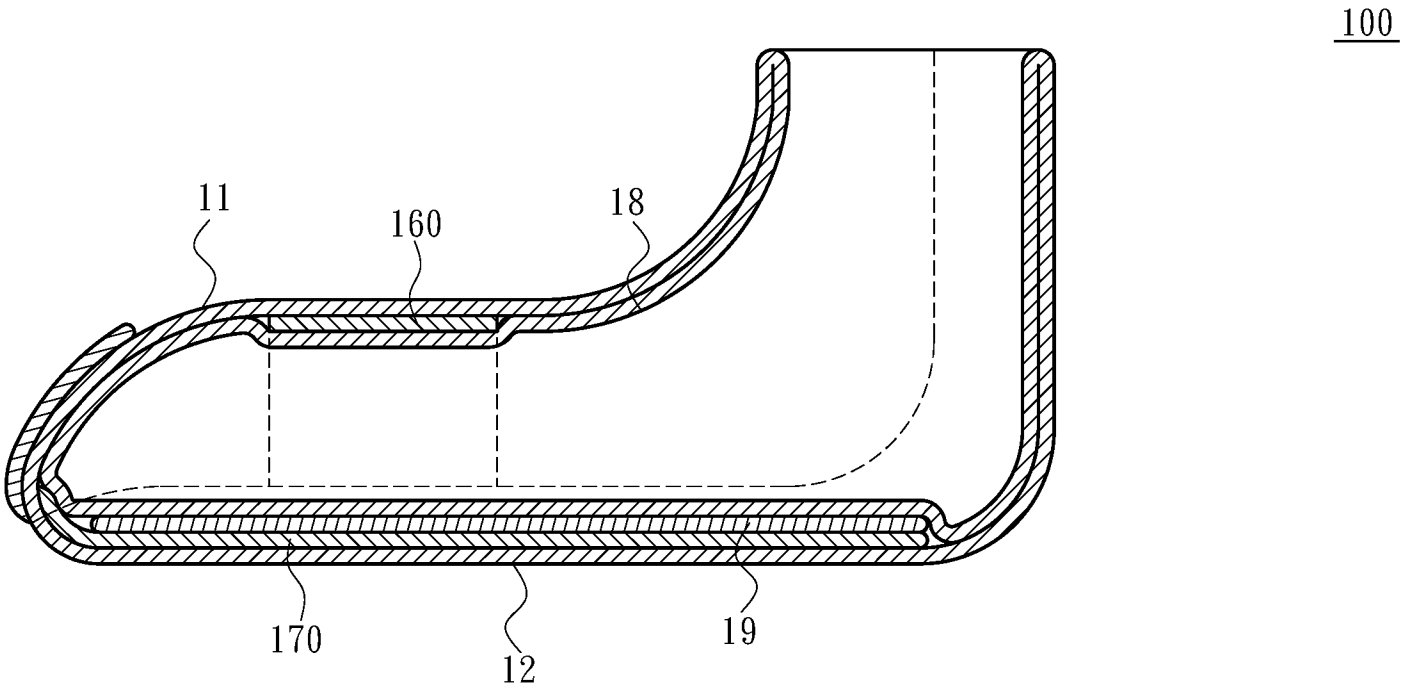
FIG. 43 is a sectional schematic diagram of a knitted shoe prototype according to the twelfth embodiment of the present invention.

Referring to FIG. 39 to FIG. 43, in one embodiment, after the shoe upper knitting step S35, the method further includes an outside-upper another extension knitting step S38, in which another extension 171 connected to the end of the first shoe upper 11 or the second shoe upper 12 is woven by knitting at least one of the yarns 20 and 21. In the side overturning step S37, the another extension 171 is stacked on the first shoe upper 11 or the second shoe upper after the first shoe upper 11 and the second shoe upper 12 are connected. The another extension 171 serves as the toe support piece when stacked on the first shoe upper 11, or serves as the sole piece when stacked on the second shoe upper 12. More specifically, the another extension 171 is not adhered in the securing step S36, and is driven by the connected first shoe upper 11 or second shoe upper 12 to move towards the initial shoe edge 111. When the first shoe upper 11 or the second shoe upper 12 moves to a predetermined level, after the ends of the first shoe upper 11 and the second shoe upper 12 are connected, the another extension 171 may become adhered to the first shoe upper 11 or the second shoe upper 12 to complete the shoe blank 10. Further, FIG. 43 shows the manufactured knitted shoe prototype 100 of the embodiment.

Known from the knitting details disclosed by the schematic diagrams of the knitting processes of the present invention, the first shoe upper 11 and the second shoe upper 12 of the present invention may respectively be woven from different yarns (20 and 21). That is to say, if the needle beds (i.e., the front needle bed 901 and the back needle bed 902) perform knitting using different yarns, when the needle bed (e.g., the front needle bed 901) currently performing knitting reaches an end, yarn stitching and securing is assisted by a needle of the other needle bed (e.g., the back needle bed 902) at the opposite side, thereby interlacing the first shoe upper 11 and the second shoe upper 12 to form a tubular shape.

What is claimed is:

1. A method for manufacturing an integral shoe blank, comprising:

an outside-upper extension knitting step: knitting at least one of at least two yarns to be an extension;

an interlacing step: knitting an initial shoe edge connected to the extension by knitting the at least two yarns in an interlaced manner;

a shoe upper knitting step: forward knitting the at least two yarns connected to the initial shoe edge to be a first portion of a shoe upper, then backward knitting the at least two yarns to be a second portion of the shoe upper that faces the first portion of the shoe upper when a number of a plurality of shoe upper stitches is reached to a predetermined count, further forward knitting the at least two yarns according to the number of the plurality of shoe upper stitches again to be the first portion of the shoe upper, and hence cyclically performing the above process to form the first portion of the shoe upper and the second portion of the shoe upper as a tubular fabric;

a reinforcement piece knitting step: continuing forward knitting at least one of the yarns to be a reinforcement piece when the number of a plurality of shoe upper stitches is reached to the predetermined count in the shoe upper knitting step, then backward knitting the at least one of the yarns when a number of a plurality of extension stitches is knitted to reached a predetermined count, further continuing forward and backward knitting the at least two yarns according to the number of the plurality of shoe upper stitches to be the first portion of the shoe upper and the second portion of the shoe upper when the number of a plurality of extension stitches is reached to the predetermined count again, and cyclically performing the above process to knit the reinforcement piece, the first portion of the shoe upper of the tubular fabric and the second portion of the shoe upper of the tubular fabric;

a continual shoe upper knitting step, cyclically forward and backward knitting the at least two yarns to be the first portion of the shoe upper and the second portion of the shoe upper;

a lining knitting step: knitting the at least two yarns to be a first lining connected to the first portion of the shoe upper, then backward knitting the at least two yarns to be a second lining that faces the first lining and is connected to the second portion of the shoe upper when a number of the shoe upper stitches is reached to a predetermined count, further forward knitting the at least two yarns according to the number of the plurality of shoe upper stitches again to be the first lining, and hence cyclically performing the above process to form the first lining and the second lining, and forming a shoe opening at ends of the first lining and the second lining;

a side overturning step: folding the first lining and the second lining from the shoe opening, and simultaneously drawing the first portion of the shoe upper and the second portion of the shoe upper for side overturning to locate the reinforcement piece and the extension in an in-shoe space of the tubular fabric defined by the overturned first portion of the shoe upper and second portion of the shoe upper, wherein the extension serves as a toe support piece at a lower end of the in-shoe space or a sole piece adhered to the second portion of the shoe upper; and a lining tucking step: tucking the overturned first lining and second lining towards the in-shoe space, and securing ends of the first lining and the second lining to the lower end of the in-shoe space to complete the shoe blank.

2. The method for manufacturing an integral shoe blank of claim 1, wherein before tucking the first lining and the second lining into the in-shoe space in the lining tucking step, edges of the first lining and the second lining are sewn.

3. The method for manufacturing an integral shoe blank of claim 2, wherein one of the two yarns is clad with a hot melt layer.

4. The method for manufacturing an integral shoe blank of claim 2, wherein the number of the plurality of extension stitches is greater than the number of the plurality of shoe upper stitches.

* * * * *